US011952171B2

(12) United States Patent
Lam et al.

(10) Patent No.: US 11,952,171 B2
(45) Date of Patent: Apr. 9, 2024

(54) DIVIDER AND DIVIDER PLATE

(71) Applicants: THE EXECUTOR OF THE ESTATE OF LAM CHOON SEN DAVID, Singapore (SG); Choon Sen David Lam, Singapore (SG); Zhi Loong Lam, Singapore (SG); Zhiqun Lam, Singapore (SG); Zhixiu Lam, Singapore (SG)

(72) Inventors: Choon Sen David Lam, Singapore (SG); Zhi Loong Lam, Singapore (SG); Zhiqun Lam, Singapore (SG); Zhixiu Lam, Singapore (SG)

(73) Assignees: Yat Fang Liew, Singapore, Republic of Singapore (SG); Zhi Loong Lam, Singapore, Republic of Singapore (SG); Zhiqun Lam, Singapore, Republic of Singapore (SG); Zhixiu Lam, Singapore, Republic of Singapore (SG)

( * ) Notice: Subject to any disclaimer, the term of this patent is extended or adjusted under 35 U.S.C. 154(b) by 181 days.

(21) Appl. No.: 17/054,042

(22) PCT Filed: May 8, 2019

(86) PCT No.: PCT/SG2019/050258
§ 371 (c)(1),
(2) Date: Nov. 9, 2020

(87) PCT Pub. No.: WO2019/216827
PCT Pub. Date: Nov. 14, 2019

(65) Prior Publication Data

US 2021/0229866 A1 Jul. 29, 2021

(30) Foreign Application Priority Data

May 8, 2018 (SG) ..... 10201803890U
Jun. 4, 2018 (SG) ..... 10201804737Q
(Continued)

(51) Int. Cl.
*B65D 19/44* (2006.01)
*B65D 21/08* (2006.01)
(Continued)

(52) U.S. Cl.
CPC ..... *B65D 25/06* (2013.01); *B65D 19/44* (2013.01); *B65D 21/083* (2013.01);
(Continued)

(58) Field of Classification Search
CPC ..... B65D 25/103; A47L 15/50; A47L 15/505
(Continued)

(56) References Cited

U.S. PATENT DOCUMENTS 4,798,292 A * 1/1989 Hauze ..... A61L 2/26 206/439
5,405,042 A 4/1995 Apps et al.
(Continued)

FOREIGN PATENT DOCUMENTS

CN 201042798 Y 4/2008
CN 101522072 A 9/2009
(Continued)

OTHER PUBLICATIONS

Smailes, Allan; International Search Report; PCT/SG2019/050258; dated Aug. 1, 2019; 6 pages.

*Primary Examiner* — Mollie Impink
(74) *Attorney, Agent, or Firm* — Bradley Arant Boult Cummings LLP

(57) ABSTRACT

An object transport system includes a plate having an array of apertures; and a plurality of dividers, each of the dividers
(Continued)

including an elongate throat connecting a head to a base, wherein the base is arranged to be inserted into one of the apertures.

19 Claims, 60 Drawing Sheets

(30) Foreign Application Priority Data

Jul. 4, 2018 (SG) ..... 10201805803U
Dec. 6, 2018 (SG) ..... 10201810961S

(51) Int. Cl.
*B65D 25/06* (2006.01)
*B65D 25/10* (2006.01)
*B65D 81/05* (2006.01)
*B65D 19/00* (2006.01)

(52) U.S. Cl.
CPC ..... *B65D 25/102* (2013.01); *B65D 81/05* (2013.01); *B65D 19/0002* (2013.01); *B65D 2519/00815* (2013.01)

(58) Field of Classification Search
USPC ..... 206/722
See application file for complete search history.

(56) References Cited

U.S. PATENT DOCUMENTS 5,599,512 A * 2/1997 Latulippe ..... A61L 2/26 24/453
5,681,539 A * 10/1997 Riley ..... A61B 50/22 206/370
6,311,852 B1 11/2001 Ireland
6,648,569 B2 * 11/2003 Douglass ..... B60P 7/0892 410/46
6,685,034 B1 * 2/2004 Cooke ..... G11B 33/0461 211/41.12
6,890,138 B1 * 5/2005 Myrick ..... B60P 7/0892 410/97
7,458,474 B2 * 12/2008 Bewsky ..... B43K 23/001 211/69.1
2002/0096445 A1 * 7/2002 Austin ..... B65D 19/38 108/51.11
2016/0331131 A1 * 11/2016 Ghaeni ..... A47F 5/0823
2017/0027411 A1 * 2/2017 Gobl ..... B65D 19/44

FOREIGN PATENT DOCUMENTS

CN 201400353 Y 2/2010
CN 106388299 A 2/2017
DE 229370 A1 11/1985
EP 0207479 A2 * 6/1986 ..... B65D 19/44
EP 0207479 A2 1/1987
EP 2279832 A2 2/2011
EP 2952439 A1 * 12/2015 ..... B65D 19/0002
WO WO-9411264 A1 5/1994

* cited by examiner

Figure 6B
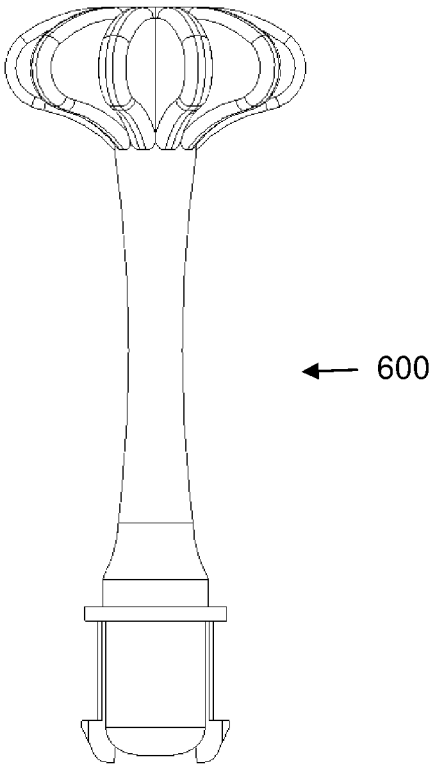
Figure 6C
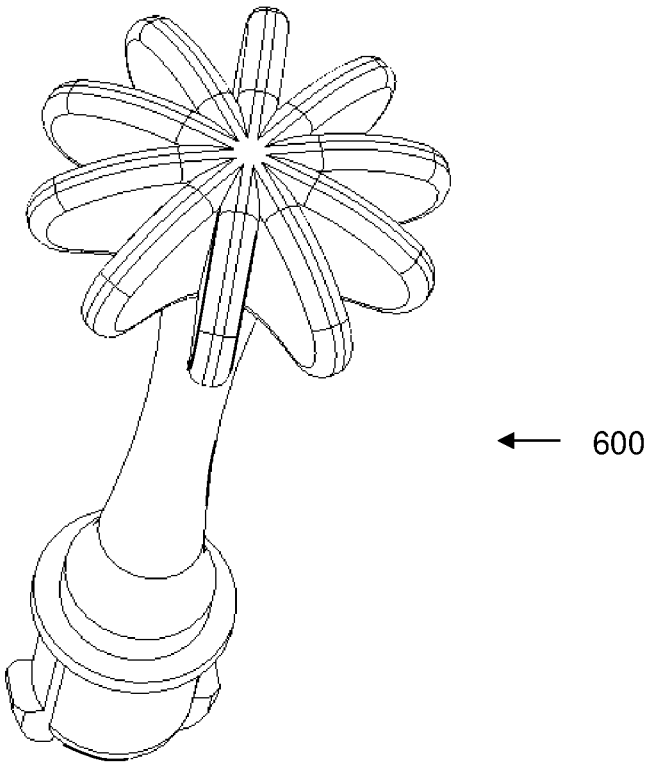
Figure 7A
Figure 7B
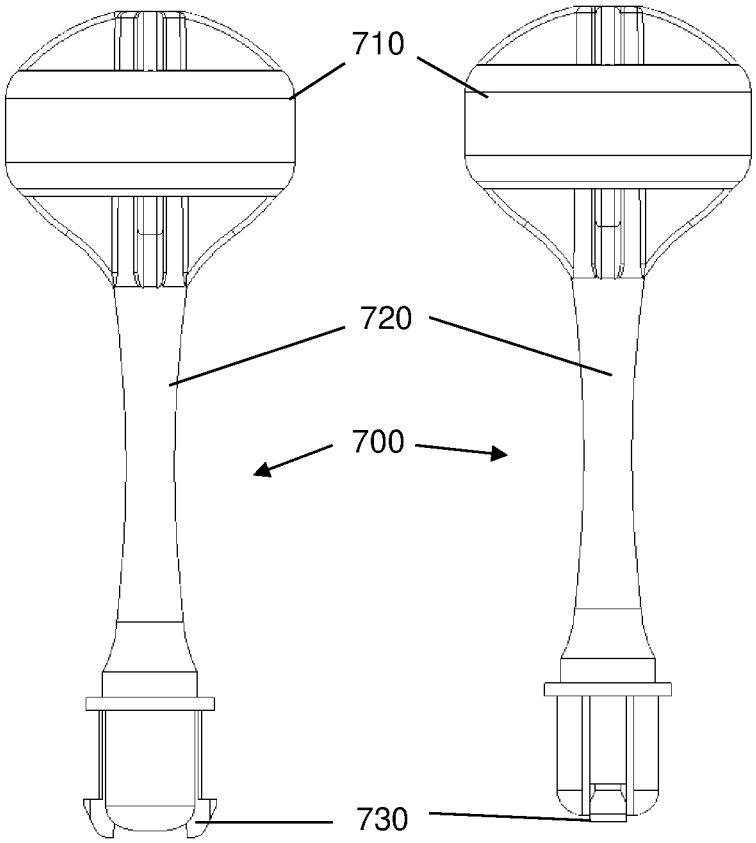

Figure 11A
Figure 11B
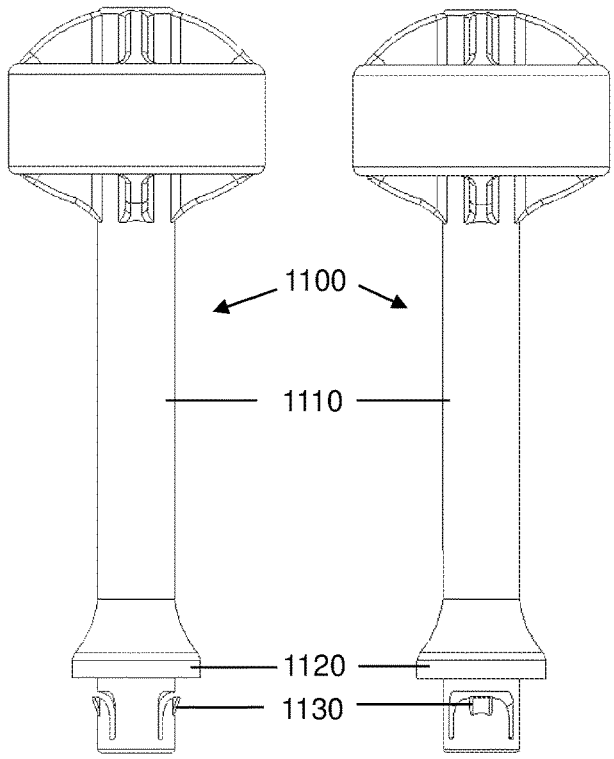
Figure 11C
Figure 11D
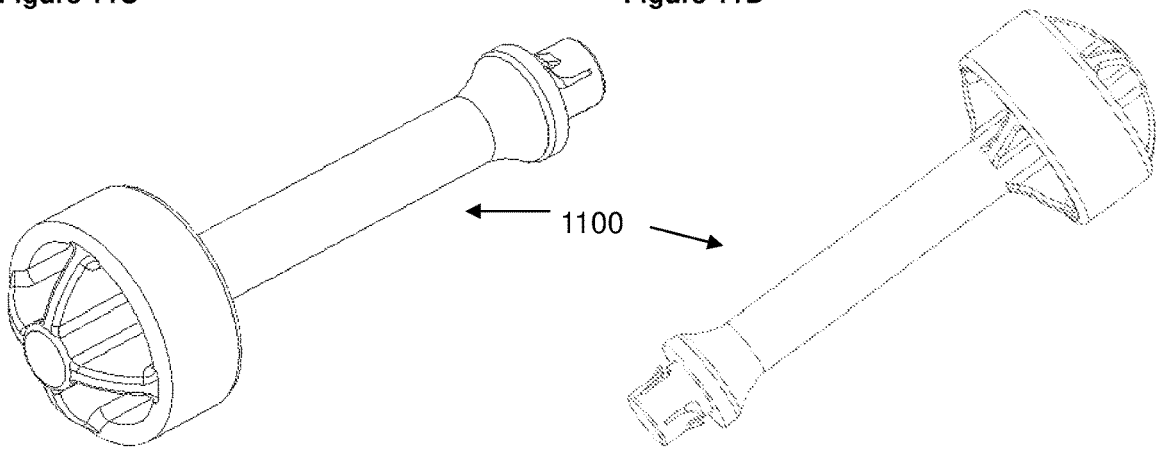
Figure 11E
Figure 11F
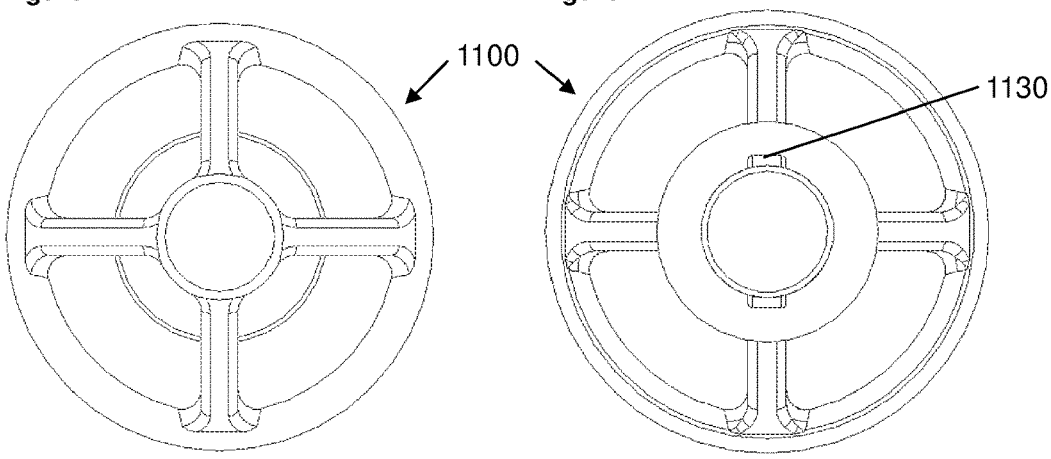

Figure 12
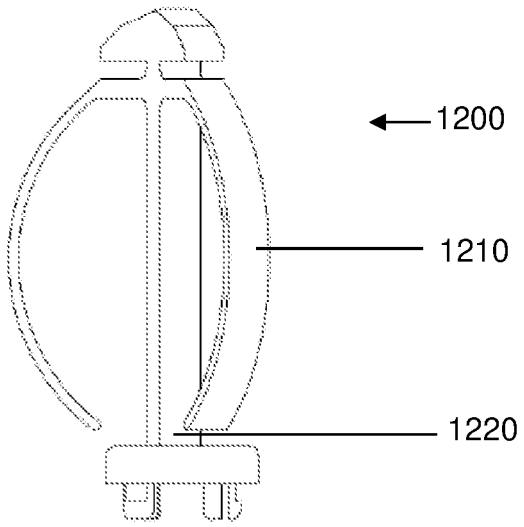
Figure 13A
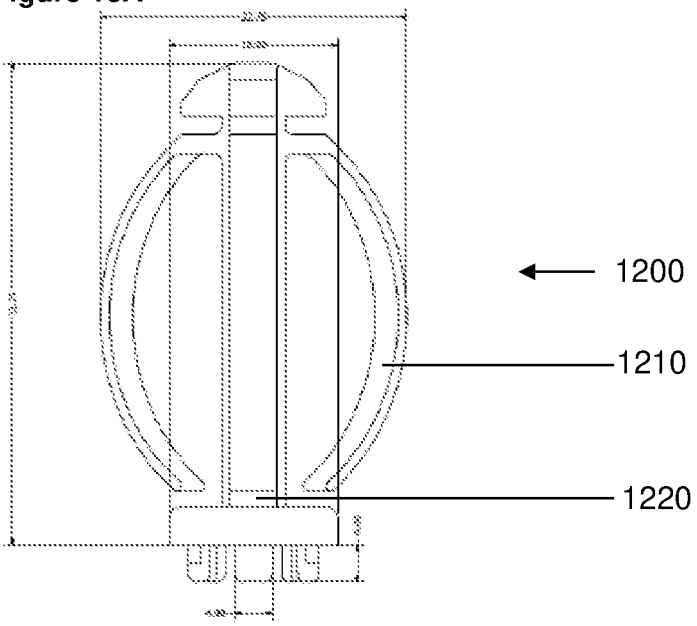
Figure 13B
Figure 13C
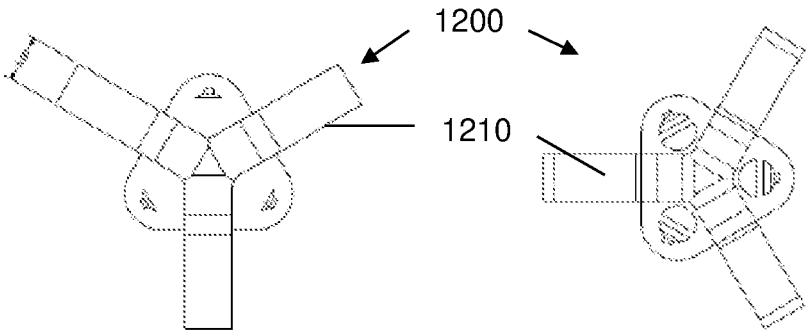

Figure 17A
Figure 17B
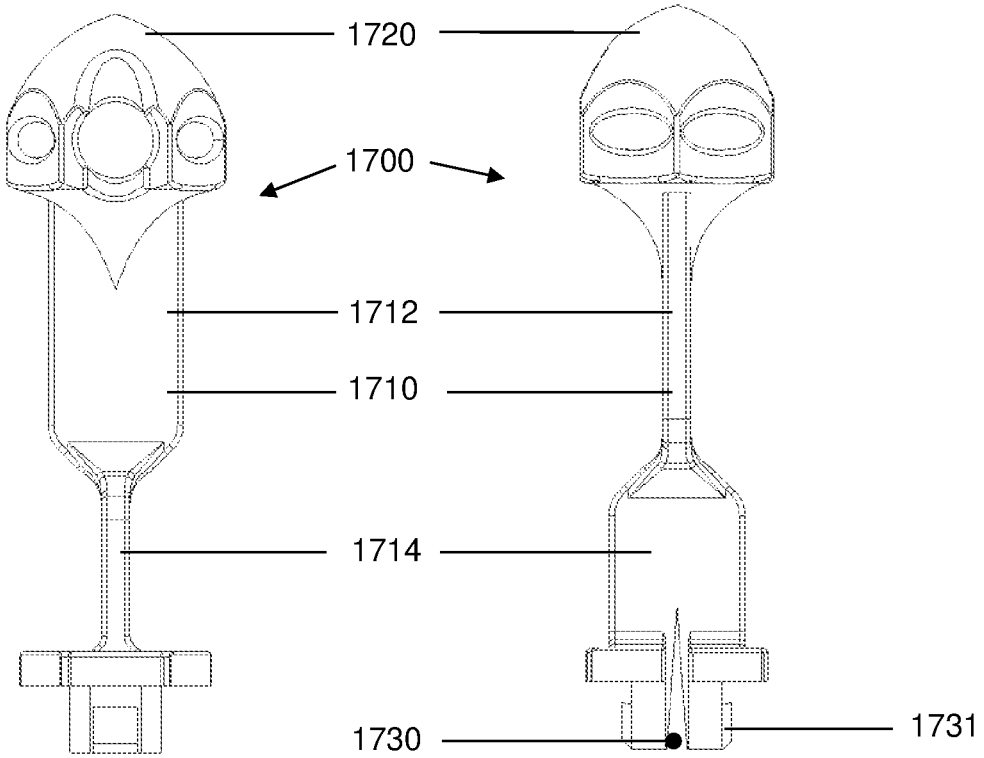
Figure 17C
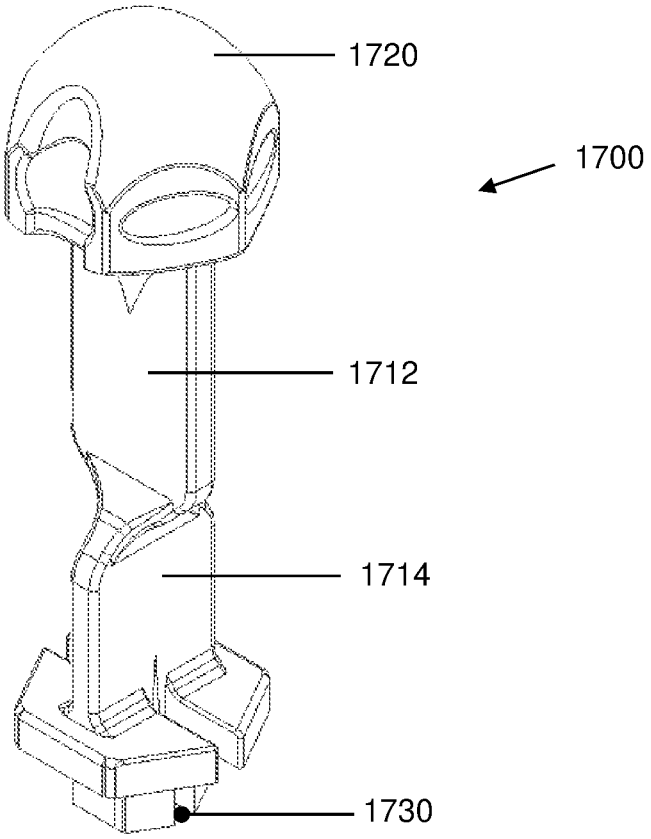

Figure 23A
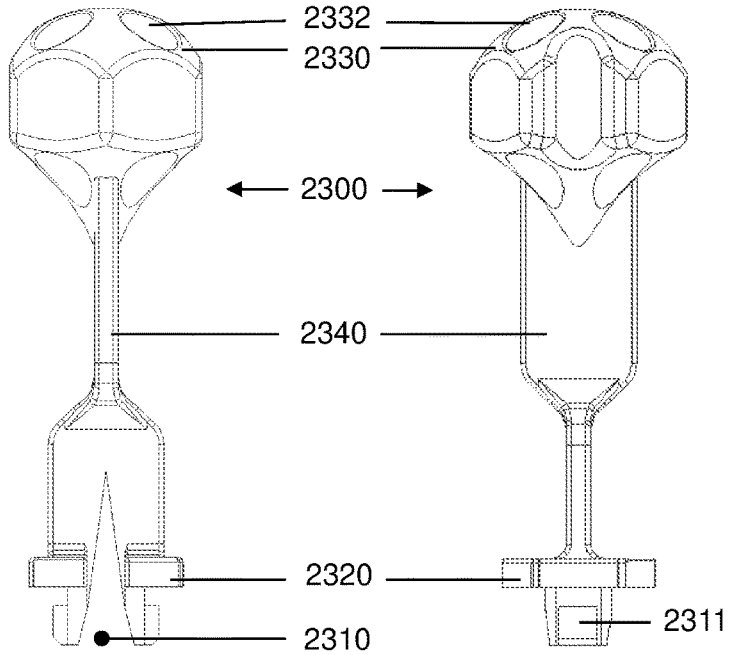
Figure 23B
Figure 23C
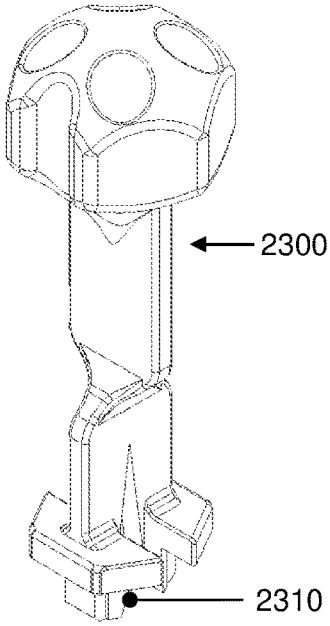
Figure 23D
Figure 23E
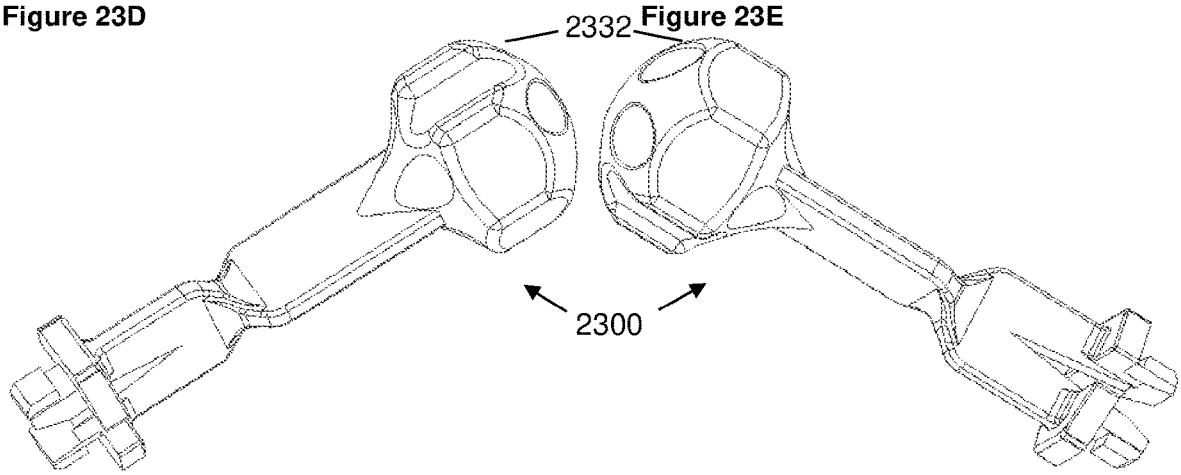
Figure 24A
Figure 24B
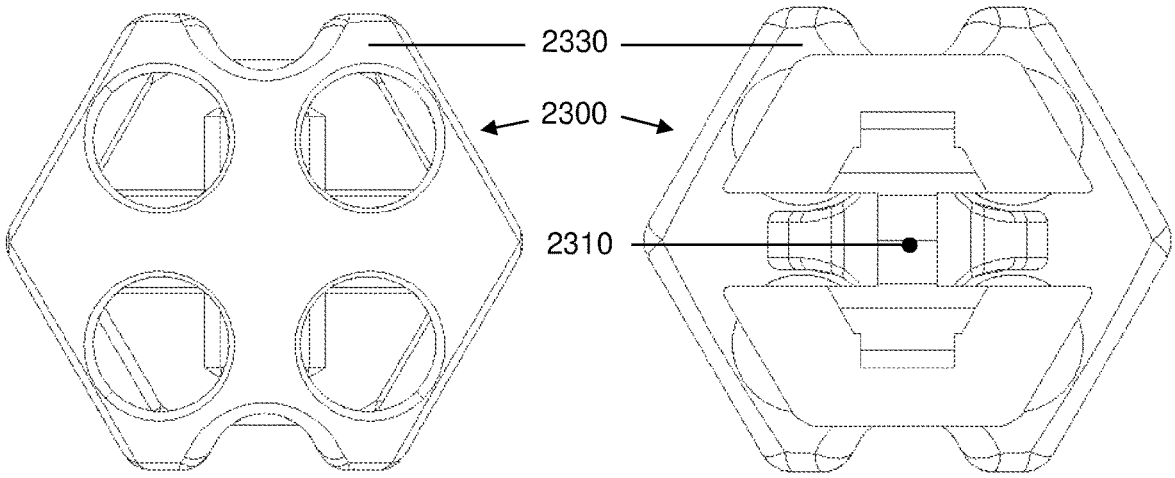

3600

3601

Figure 37
Figure 38
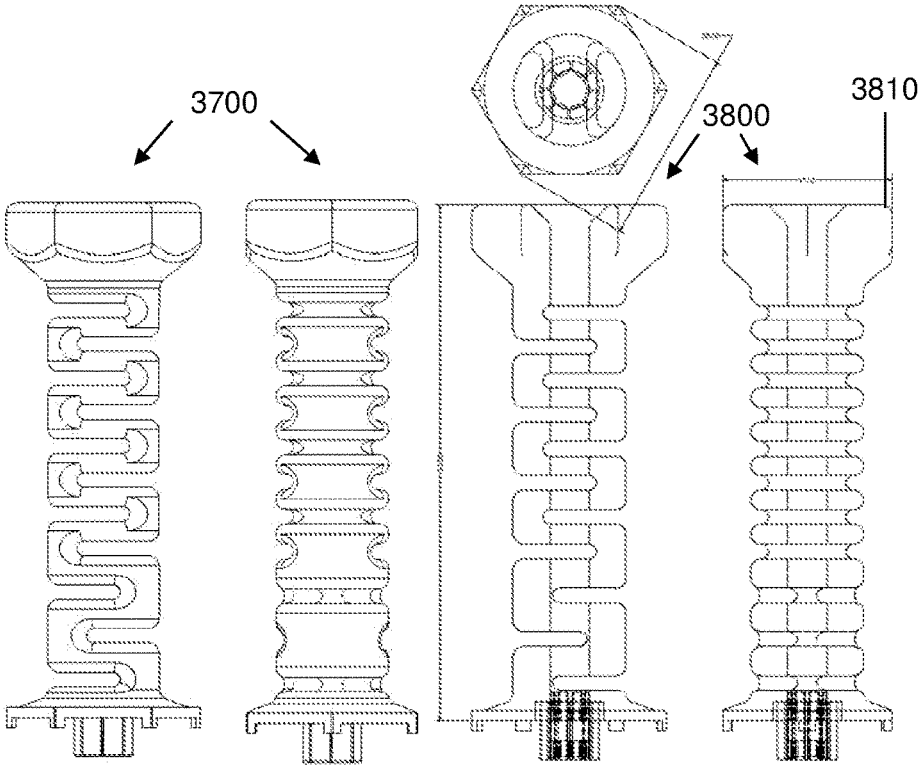
Figure 39
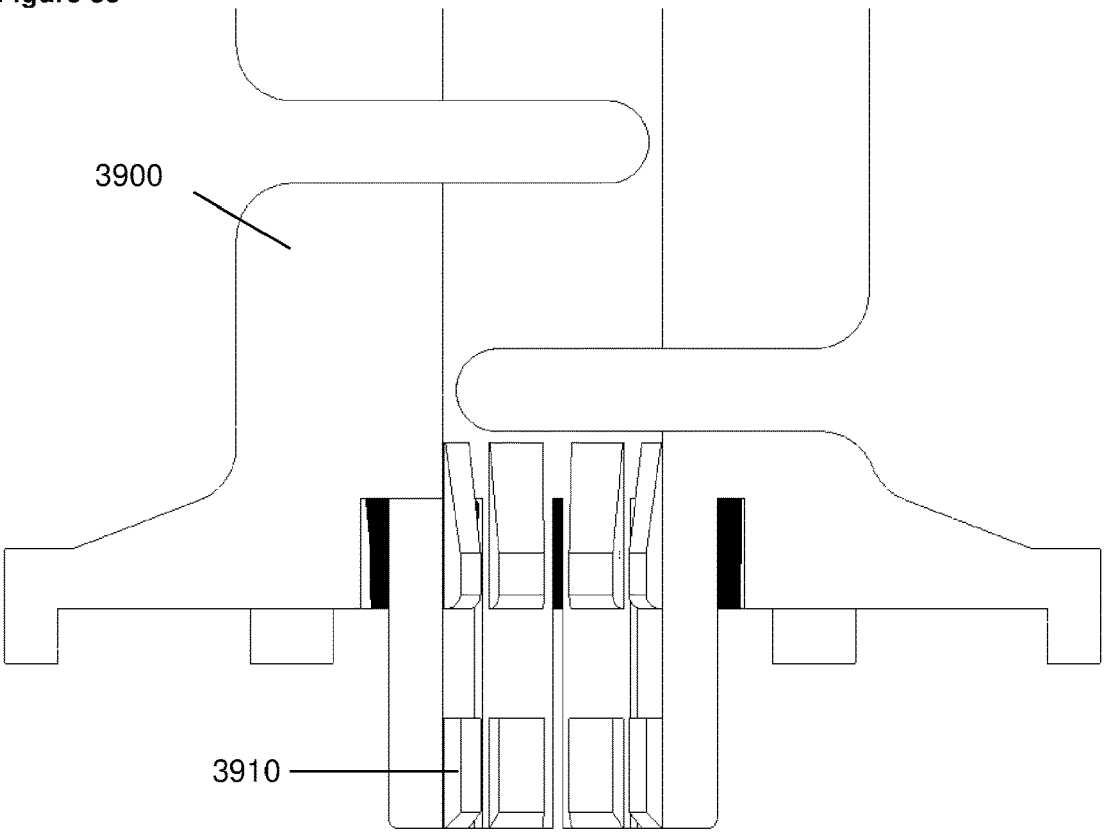

4400

4400

4400

Figure 50
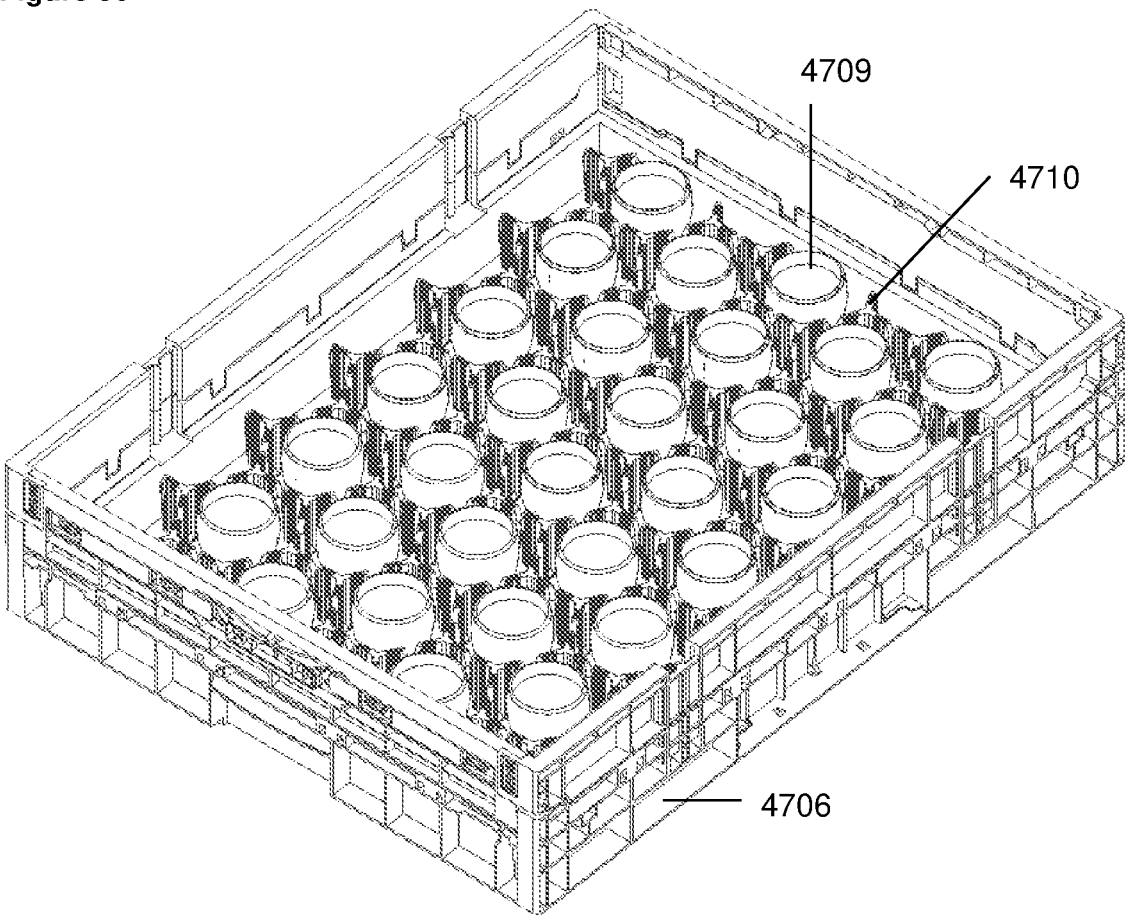
Figure 51A
Figure 51B
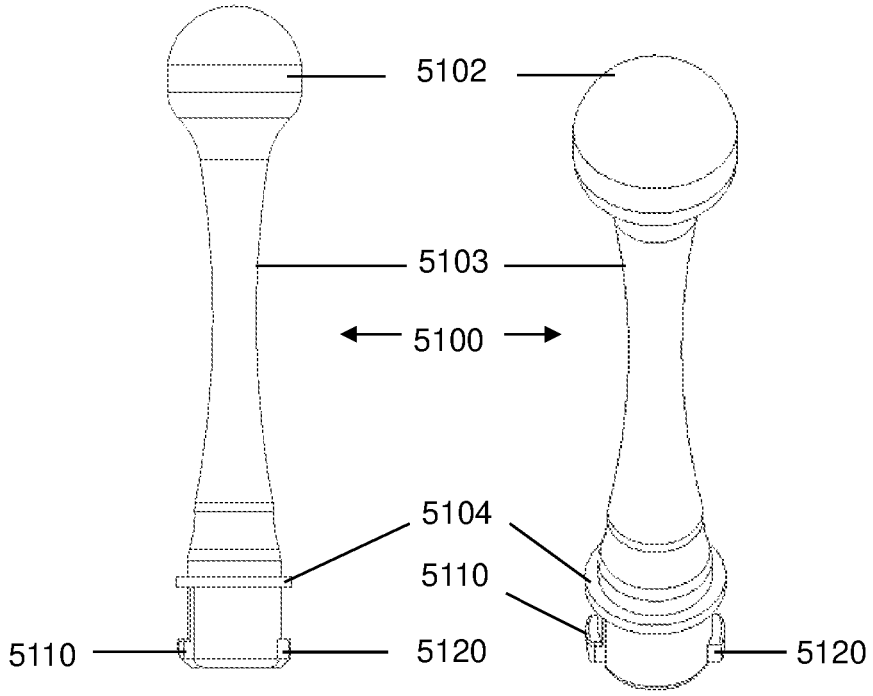

DIVIDER AND DIVIDER PLATE

FIELD OF THE INVENTION

The invention relates to the transport of goods and cargo. In particular the invention relates to assemblies used to contain, separate and protect such goods and cargo.

BACKGROUND OF THE INVENTION

Containers for transporting objects have packing material such as Styrofoam pellets and bubble wrap to hold the objects in place and prevent damage. Typically in cross-continental shipment, packing material is disposed of at the destination due to the high cost of return shipping. Therefore, conventional packing material is not environmentally-friendly and incurs high costs for transportation companies to constantly purchase and store them.

Hence, there is a need for an improved packaging material that overcomes these problems.

SUMMARY OF THE INVENTION

In a first aspect, the present invention relates to an object transport system comprising a divider plate having an array of apertures; and a plurality of dividers, each of said dividers comprising an elongate throat connecting a head to a divider base, wherein the divider base is arranged to be inserted into one of said apertures.

The divider plate may be a separate item which may be placed into a box/container. Alternatively, the divider plate may be permanently fixed in the box. In a further alternative, the divider plate may be an assembly of plates.

Each divider may have a head and that head may be circular in plan. The dividers may be arranged to act as a separator, by placing several dividers at specific locations to form groups. These groups of dividers may be placed in a range of shapes to match the shape, and number, of goods being transported. By forming groups into any types of shapes and sizes, these can take the shape of the product and placed in areas surrounding the product. Thus the dividers as described herein demonstrate packing flexibility and modularity. In an embodiment, the dividers may be positionable to collectively define an enclosure for said object. In an embodiment, the heads of the dividers may be shaped to accommodate a close packed arrangement. In a further embodiment, the apertures may be in a close packed arrangement. For example, the apertures may be circular or polygonal.

The head of the divider may be shaped to receive an end effector arranged to rotate said divider. During packing and transportation, an object may be contacted by heads of a plurality of dividers. Therefore, the shape, size and surface texture of the head may vary depending on the object. The head may be small and compact to accommodate bigger objects and do not block adjacent apertures. The head may be shaped such that divider heads can transfer forces across the divider plate or to a container wall. For example, the head may have a circular plan section. A spherical head with a smooth surface texture may reduce the likelihood of damage to the object and entanglement among dividers. Alternatively, the head may have an isotoxal cross-section. The head may have a circumference of any one of: milled, fluted, external polygon shape, internal polygon shape.

The dividers may be elongate with a throat portion extending away from the base and terminating at a head. The throat of the divider may be shaped to have differential flexural stiffness lengthwise.

The individual dividers may be unitary devices, and include a base having a projection for insertion into the aperture of the divider plate. For example, the divider base may have an inverted frusto conical shape. The divider base and apertures may be cooperatively shaped for insertion for any one of: snap fit, bayonet fit, or screw fit. The dividers may further provide a means for release.

In an embodiment, the divider base has an H-beam cross-section. The H-beam resists transverse loads applied to the divider. A divider base may comprise a trunk and two legs connected to the trunk. Each leg may contain a depressible tab and wedge. The tab is moveable between an extended position to a squeezed position. When the divider is inserted into a neck through an aperture of a divider plate, the tabs are depressed to a squeezed position. Upon further insertion, the tabs enter a void and move into the extended position. In this embodiment, the divider is symmetrical, so the orientation of the divider on the divider plate is not critical.

A divider removal device may be used to release the divider. When the divider is pushed further into the aperture, the wedges are depressed by the neck of the aperture. The tabs move into a receiving end of the divider removal device, and are retracted in a squeezed position. This allows the divider to be released from the divider plate. Alternatively, the device may have inclined surfaces arranged to contact and move the tabs directly into a squeezed position.

In another embodiment, the divider base may comprise a rigid tab and a flexurally depressible tab. In this arrangement, the dividers may be orientated in the same direction across the divider plate. In a preferred embodiment, the tabs may complementarily engage with recesses in the apertures.

The tabs may permit selective removal and so allow reuse of the dividers. The tabs may also be useful for automated insertion and removal.

The dividers may be relatively flexible so as to provide a cushioning effect on the goods being transported. A low glass transition temperature polymer, such as, polypropylene (PP) or high density polyethylene (HDPE), may enable the dividers to bend repeatedly without breaking, thus increasing durability and lowering cost. Depending upon the application, the material may have a glass transition temperature from just below ambient conditions, and so have a degree of rigidity to a glass transition temperature well below ambient temperature. For highly resilient applications, the dividers may be made from polyoxymethylene (POM) or acrylonitrile butadiene styrene (ABS). For softer applications, the dividers may be made from polypropylene, polyethylene or an elastomer such as rubber. It will be appreciated that different sections of a single divider may be made from different materials. For example, the divider head, or a portion thereof, may be made from a more resilient material (POM) surrounded by a softer material (an elastomer). This may be achieved through a co-injection molding process, or chemically or mechanically fitting a soft member to the head.

The dividers may be injection molded; however, certain embodiments where tolerance is less critical may permit other forms of manufacture.

A height of said dividers may be in the range of 25-50 mm. Alternatively, they may be in the range 50-75 mm. Other appropriate heights may also be applicable.

The object transport system may further comprise flexible straps to connect two or more dividers on a plate. The straps help to hold bigger objects close to the divider plate, thus further minimizing movement of the objects during transportation.

In an embodiment, the container may comprise a hook system engageable with voids on the divider plate. The hook system may be integrally molded with the container, preferably with a side wall of the container. Alternatively, the container may comprise a ledge engageable with a side of a divider plate. The divider plate may have resilient members that exert a force against the container wall to hold the plate in place.

In a second aspect, the present invention relates to a divider comprising an elongate throat connecting a head to a divider base, wherein the divider base may be shaped to insert into an aperture on a divider plate. The head may be shaped to accommodate a close packed arrangement. In an embodiment, the divider base may comprise an H-beam cross-section. In another embodiment, the divider base may comprise two legs. Each leg may comprise a depressible tab and a wedge or ridge.

In a third aspect, the present invention relates to a method for manipulating a divider within an aperture of a divider plate, the method may comprise the steps of: said divider having depressible tabs, inserting a divider base into a neck of said aperture, said neck depressing the depressible tabs from an extended position to a squeezed position; further inserting the divider base such that the divider base enters a void, the tabs resiliently moving to an extended position within said void, and consequently locking said divider into said aperture. In an embodiment, the method may further include the steps of: inserting a divider removal device into said void; retracting said depressible tabs to the squeezed position; withdrawing said divider.

It is appreciated that the various embodiments relating to the head, throat and base are interchangeable to form different dividers, whilst still falling within the scope of the invention. Various embodiments relating to the apertures and divider plates are interchangeable to form different divider plates.

BRIEF DESCRIPTION OF THE FIGURES

FIG. 6B is a side view of a fluted divider.

FIG. 6C is a perspective view of a fluted divider.

FIGS. 7A and 7B are side views of a snap fit divider.

FIGS. 11A and 11B are side views of a divider.

FIGS. 11C and 11D are perspective views of the divider of FIGS. 11A and 11B.

FIG. 11E is a top view of the divider of FIGS. 11A-11D.

FIG. 11F is a bottom view of the divider of FIGS. 11A-11E.

FIG. 12 is a perspective view of a divider with buffer strips.

FIG. 13A is a side view of a divider with buffer strips.

FIGS. 13B and 13C are respective top and bottom views of a divider with buffer strips.

FIGS. 17A and 17B are side views of a divider.

FIGS. 17C and 17D are perspective views of the divider of FIGS. 17A-17B.

FIGS. 23A and 23B are side views of a divider.

FIGS. 23C, 23D and 23E are perspective views of the divider of FIGS. 23A-23B.

FIG. 24A is a top view of the divider of FIGS. 23A-23E.

FIG. 24B is a bottom view of the divider of FIGS. 23A-23E.

FIGS. 37 and 38 are side views of dividers.

FIG. 39 is a magnified side view of a divider base.

FIG. 50 is perspective view of cups and dividers in a container.

FIG. 51A is a side view of a divider.

FIG. 51B is a perspective view of the divider of FIG. 51A.

FIG. 66C is a top view of the sub-divider plate of FIG. 66B.

DETAILED DESCRIPTION OF THE INVENTION

The dividers are relatively flexible so as to provide a cushioning effect on the goods being transported. To this end materials suitable for this effect include polyoxymethylene (POM), polypropylene and polyethylene. Other appropriate materials may also be applicable.

The individual dividers are unitary devices, and include a divider base having a projection for insertion into the aperture of the divider plate. The projections may permit selective removal and so allow reuse of the dividers. The projection may also be useful for automated insertion and removal. The dividers are elongate with a throat portion extending away from the base and terminating at a head.

The dividers may be injection molded, however, certain embodiments where tolerance is less critical may permit other forms of manufacture.

Dividers

Figure 1A:
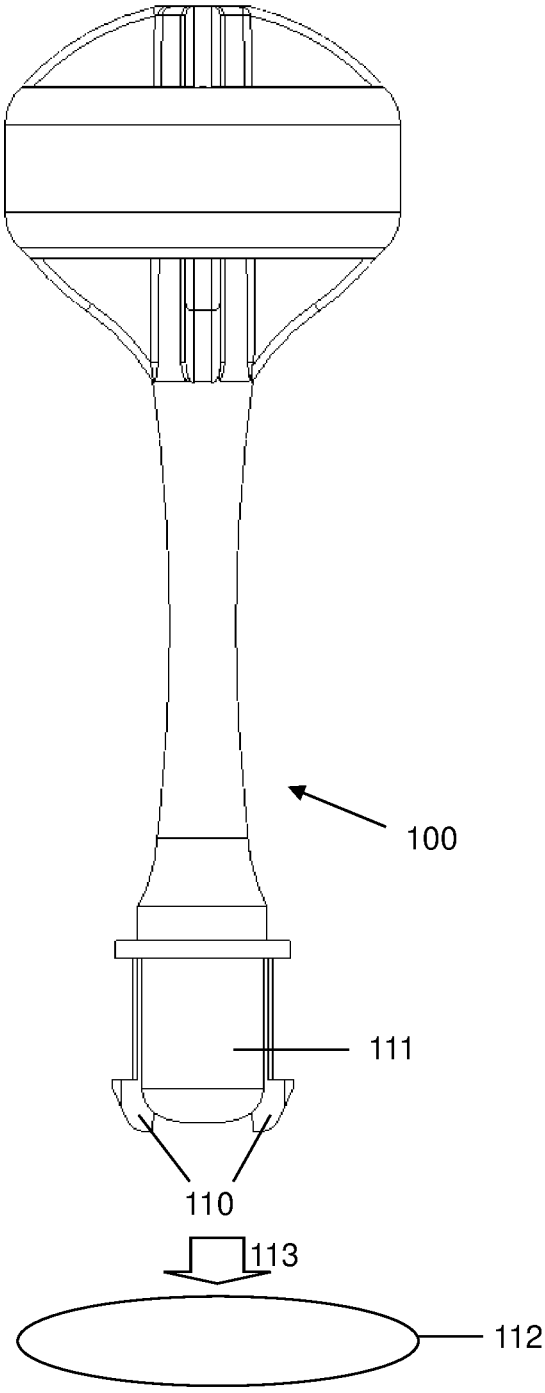
FIG. 1A is a side view of a snap fit divider.
Figure 1B:
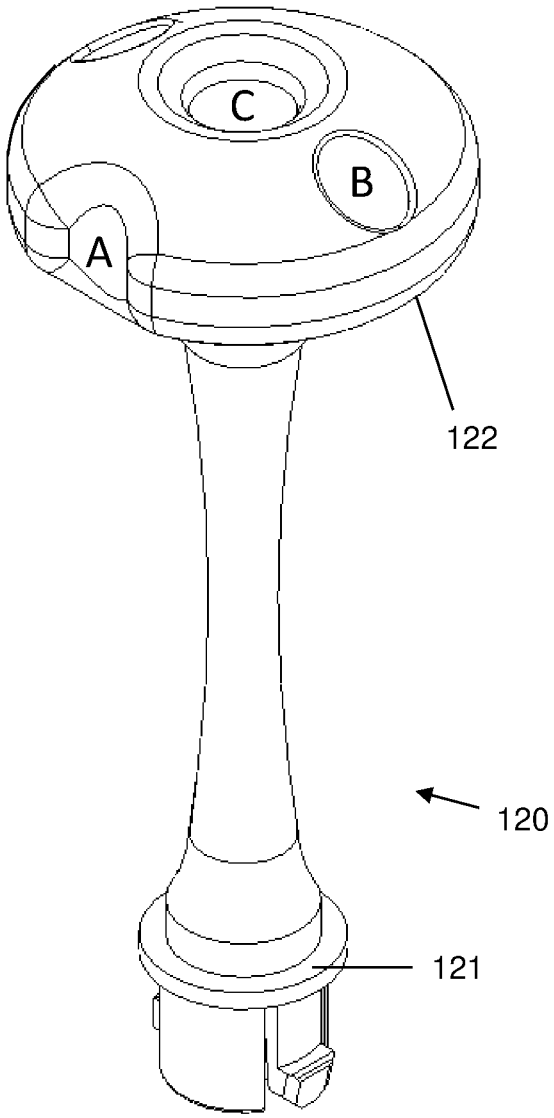
FIG. 1B is a perspective view of a bayonet fit divider.

There are various means by which the dividers can be inserted into a divider plate are varied with options including:

(a) Snap fitting (see FIG. 1A);

(b) Bayonet fitting (see FIG. 1B);

(c) Screw fitting; and (d) Other appropriate means.

The divider may further comprise a means for removal.

The snap fit divider 100 (FIG. 1A) contains two tabs 110 which extend beyond the divider base 111. When the divider 100 is pushed 113 into an aperture 112, the tabs 110 are depressed to fit into the aperture 112, then press outwards to lock the divider 100 in place. When the tabs 110 are pressed together from below, the tabs 110 disengage from the aperture 112 and the divider 100 is released. Looking from the bottom up, the snap-fit divider has an H-beam function to accept higher loads from heavy parts.

The bayonet fit divider 120 (FIG. 1B) reduces from the divider base 121. This allows the divider plate to sit flush to the box, reducing overall collapse height. The new design also reduces from the top of the divider head 122, further reducing collapse height. The bayonet fit divider requires precision to insert and remove from the divider plate. However, the force required to insert/remove is relatively low. Feature "A", being a depression in the peripheral edge of the head 122, is heavily rounded to eliminate part damage. This feature will be used by the automation team to align the divider correctly. Features "B" will be used to apply the required torque and twist the divider into/out of a locked position. Feature "C" was intended to cut the weight of the divider 120 but will also serve as another point of contact, if needed, in automation. Alternatively, an additional aperture may be placed in the head 122 whose position will inform the automated system as to the orientation. Should the automated system include a vision system, the alignment may be determined by fiduciary marks on the head 122 including arrows, lines, etc. In a further alternative, the aperture "C" instead of being circular may be elongate and pointing in a direction corresponding to the correct alignment for the divider 120.

Figure 2A:
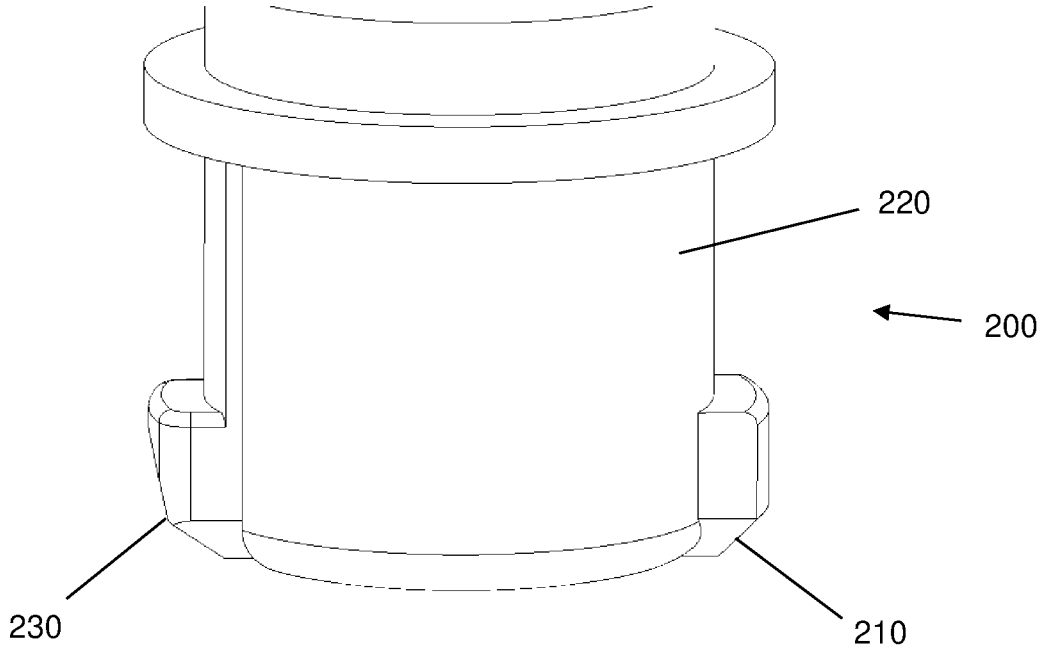
FIG. 2A is a magnified side view of a bayonet divider.
Figure 2B:
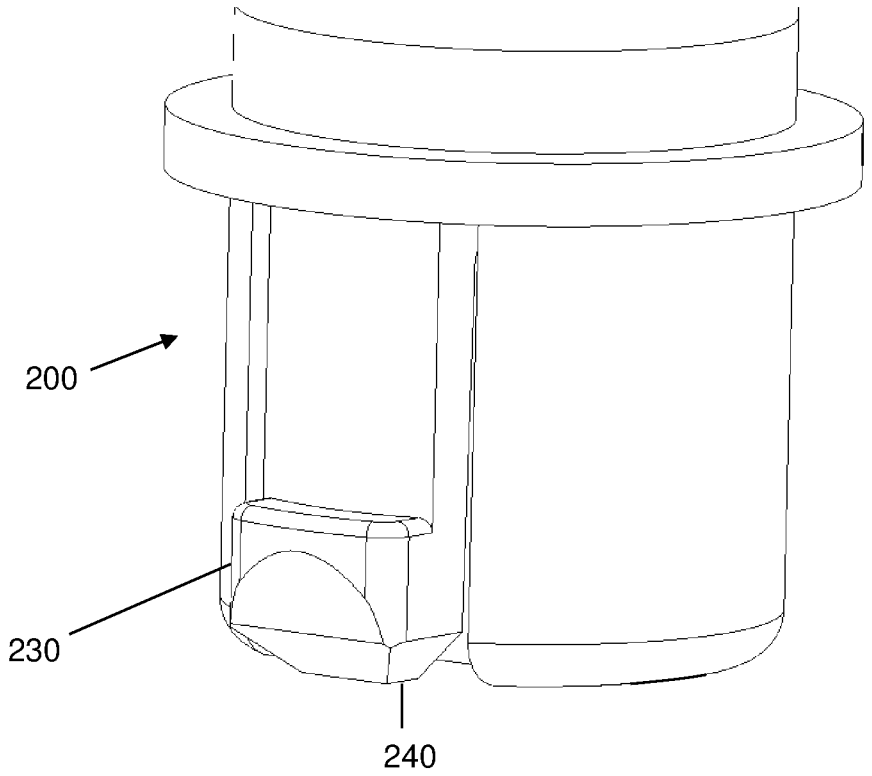
FIG. 2B is a magnified perspective view of a bayonet divider.

The invention to be described herein relates to a variation of the bayonet fit divider 200. FIGS. 2A and 2B show such an arrangement whereby a tab or corbel 210 is fixed to the divider base 220. The corbel or rigid tab 210 is not depressible and is intended to engage with a corresponding recess within a divider plate. Diametrically opposed from the rigid tab is a smart tab 230 which includes a flexurally depressible tab which again interacts with a recess in the divider plate to lock into place.

The bayonet fitting design has 2 tab features, 1 "Dumb" (Rigid) and 1 "Smart" (Flexurally Depressible): the rigid tab 210 acts as a support once the divider 200 is locked into place. It also provides exceptional pull out force. The flexurally depressible tab 230 is designed to bend slightly, at which point it will hit a wall, stopping it from breaking. This is the same as the snap-fit design. Both tabs feature a chamfer 240 on the bottom edges that correspond with the hole they will be inserted into. This allows for much greater variability in the automation process. The H-beam looks more like a "C" for a bayonet divider, and the C-beam also resists transverse loads applied to the divider.

Figure 2C:
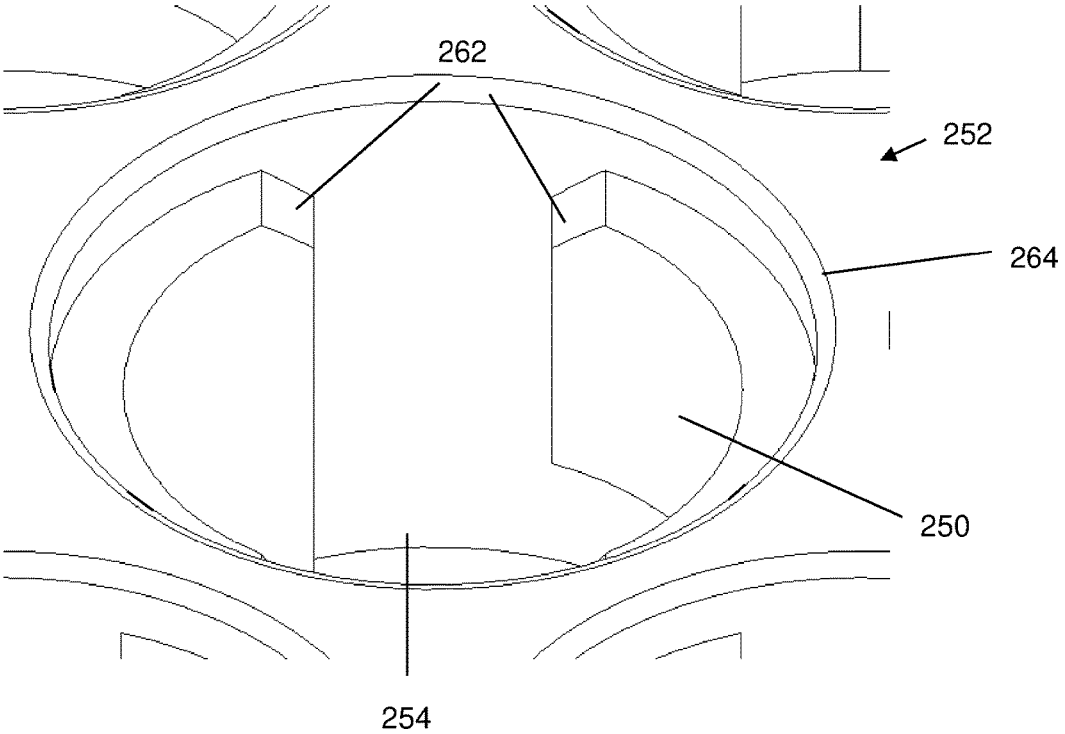
FIG. 2C is a magnified perspective view of a divider plate aperture.
Figure 2D:
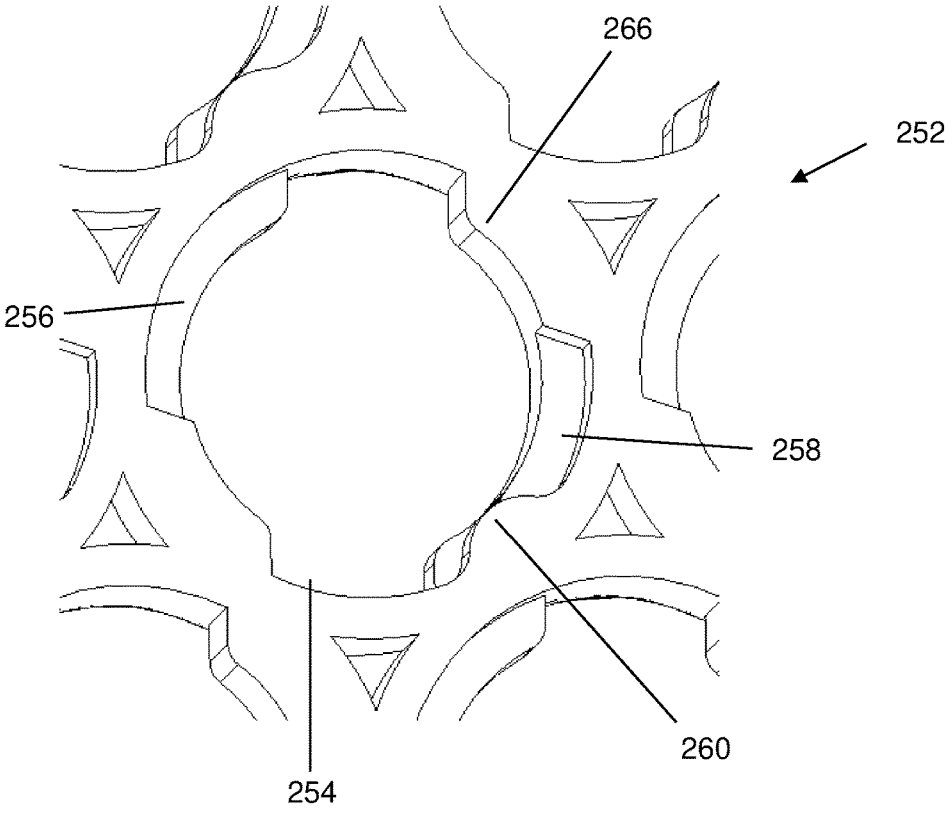
FIG. 2D is a magnified bottom view of a divider plate aperture.
Figure 2E:
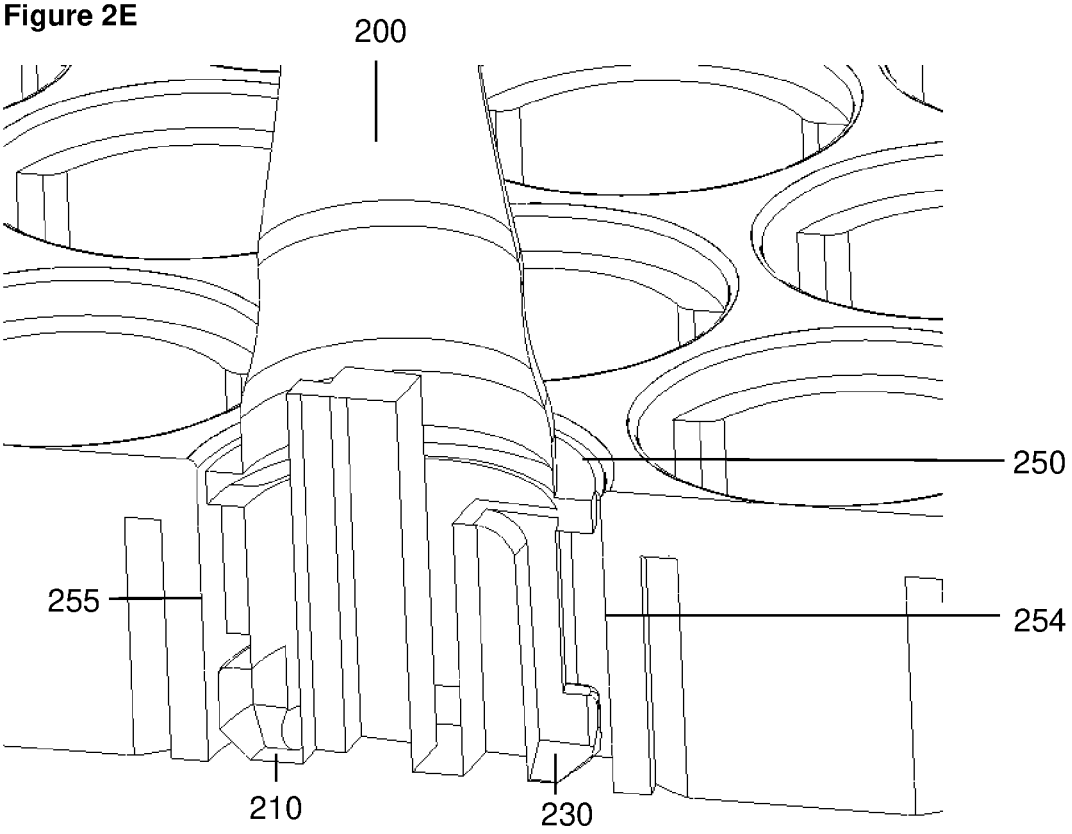
FIG. 2E is a magnified isometric cross-sectional view of a bayonet divider in an aperture in an unlocked position.
Figure 2F:
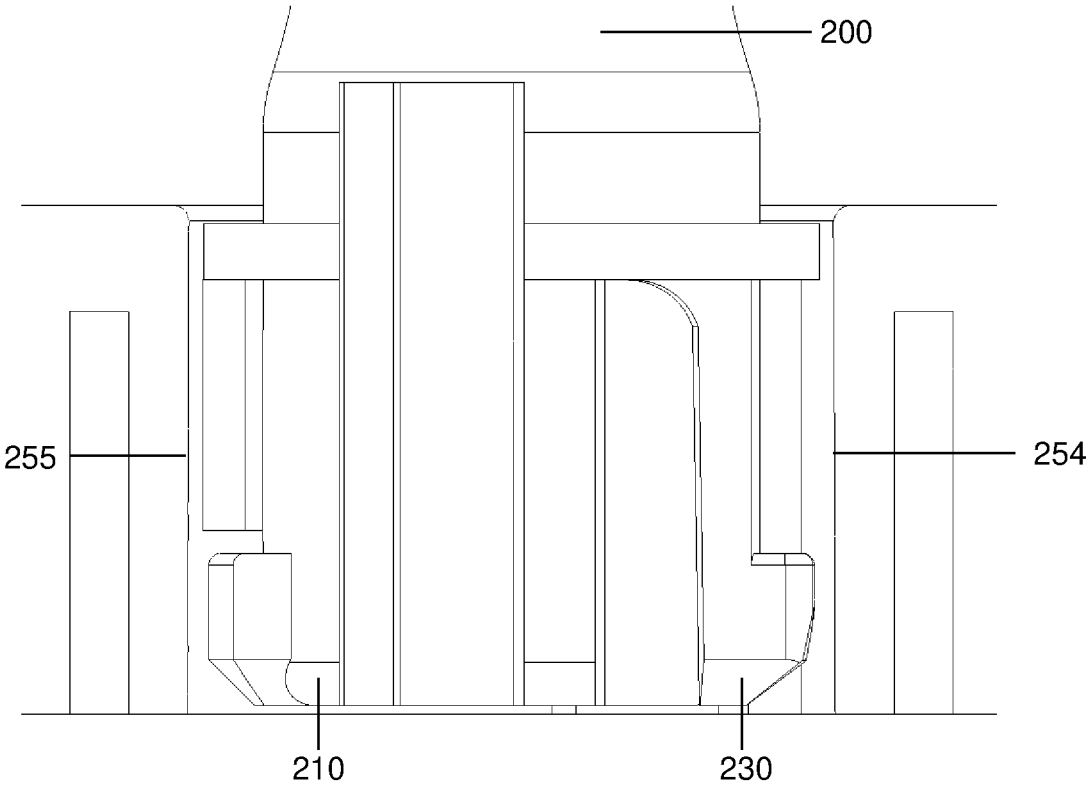
FIG. 2F is a magnified cross-sectional view of a bayonet divider in an aperture in an unlocked position.
Figure 2G:
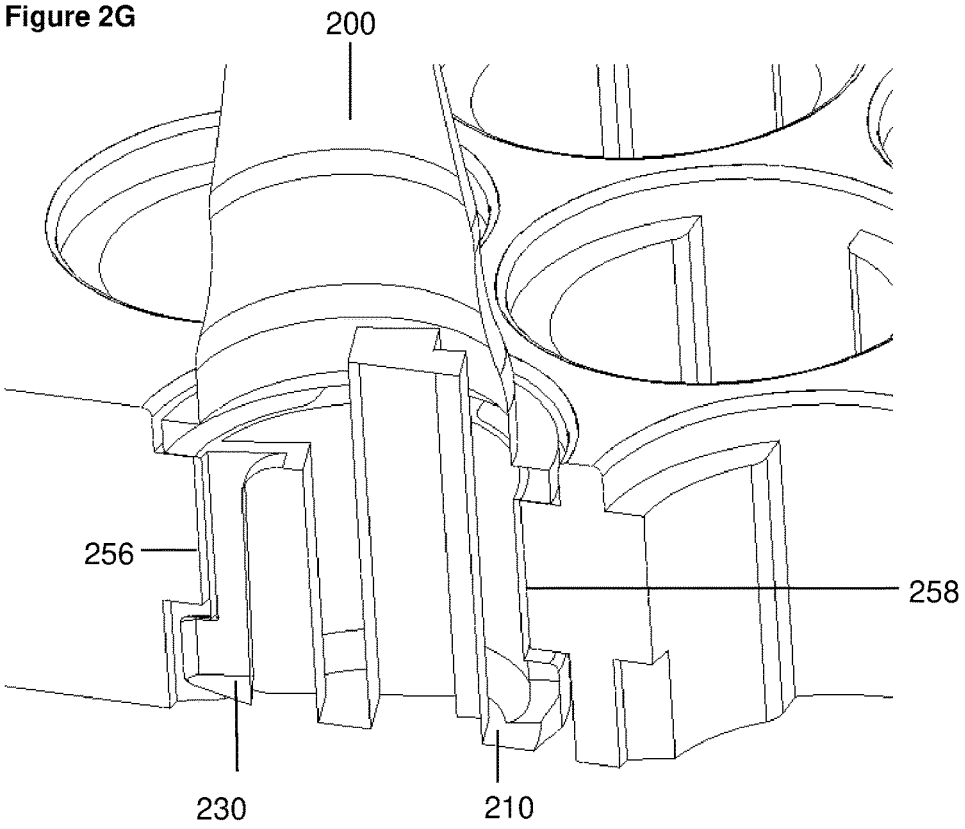
FIG. 2G is a magnified isometric cross-sectional view of a bayonet divider in an aperture in a locked position.
Figure 2H:
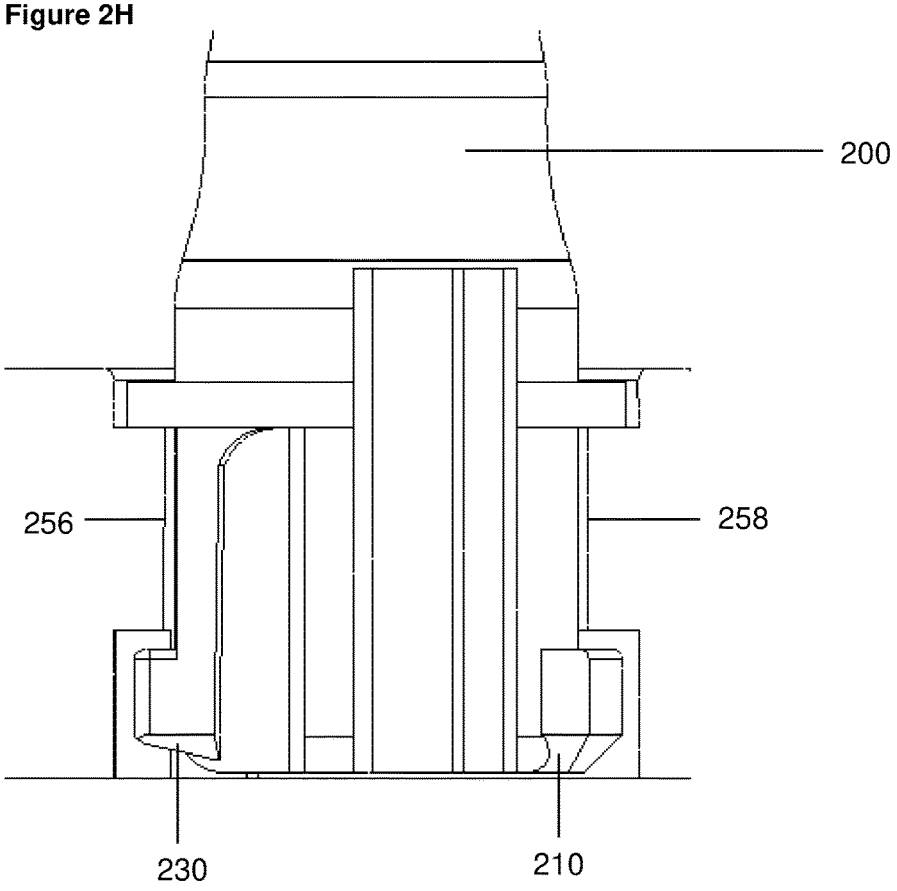
FIG. 2H is a magnified cross-sectional view of a bayonet divider in an aperture in a locked position.

FIGS. 2C and 2D show such a recess 250 in a divider plate 252 with FIG. 2C showing the top of the recess and FIG. 2D showing underneath. FIG. 2C shows a groove 254 projecting downwards which is arranged to engage with the rigid tab 210 to connect with a ridge 256 shown in FIG. 2D. The ridge 256 on the left of FIG. 2D acts as a barrier against the rigid tab 210 to prevent the lifting of the divider. On the right of FIG. 2D is a similar ridge 258 for engaging the flexurally depressible tab 230 and together the two ridges lock the divider into place once the divider 200 is rotated into the recess. FIG. 2D further includes a projection 260 arranged to depress the flexurally depressible tab as the divider 200 is rotated. Once the divider 200 is rotated past the projection 260, the flexurally depressible tab 230 clicks back into place locking the divider 200 into the recess. Thus the projection 260 and flexurally depressible tab 230 act cooperatively in order to prevent accidental rotation and subsequent unintended removal of the divider 200.

Other features of the recess include chamfered corners 262 at the top of the groove 254 shown in FIG. 2C, which act to locate the flexurally depressible and rigid tabs to facilitate easy engagement.

The top 264 of each hole has the corresponding chamfered edge 262 for easier insertion. The top 264 is also filleted to allow the countersink feature to find its location as well.

The bottom side 266 of each hole has 2 important features for successful locking. The 2 channels 256 and 258 are cut out to allow the tabs from the divider to slide with ease and more importantly act as a 'key' feature to keep the divider 200 from being pulled up and out of the hole. The flexurally depressible tab will have to compress its full distance to turn past that feature. Once past, it will take an intentional force to turn it back. Vibration will not be enough to move the tab past that bump.

It will be noted that the divider base 220 may also be an inverted frusto conical shape so that the diameter of the bottom of the divider base 220 is slightly less than that above it. This may further assist in locating the divider 200 into the recess facilitating more efficient automated insertion.

FIGS. 2E-2H are detailed cross-sectional views of the divider 200 inserted into the aperture 250. Base of the divider 200 comprises a rigid tab 210 and a flexurally depressible tab 230. The rigid tab 210 and depressible tab 230 slide into the aperture 250 through the grooves 255 and 254 respectively. When the divider is rotated past the projection 260 (not shown), the rigid tab 210 is moved to engage a ridge 258 that acts as a barrier against the rigid tab 210 prevents lifting of the divider. At the same time, the depressible tab 230 is moved to engage a ridge 256. The two ridges 256 and 258 lock the divider 200 into place.

Figure 3A:
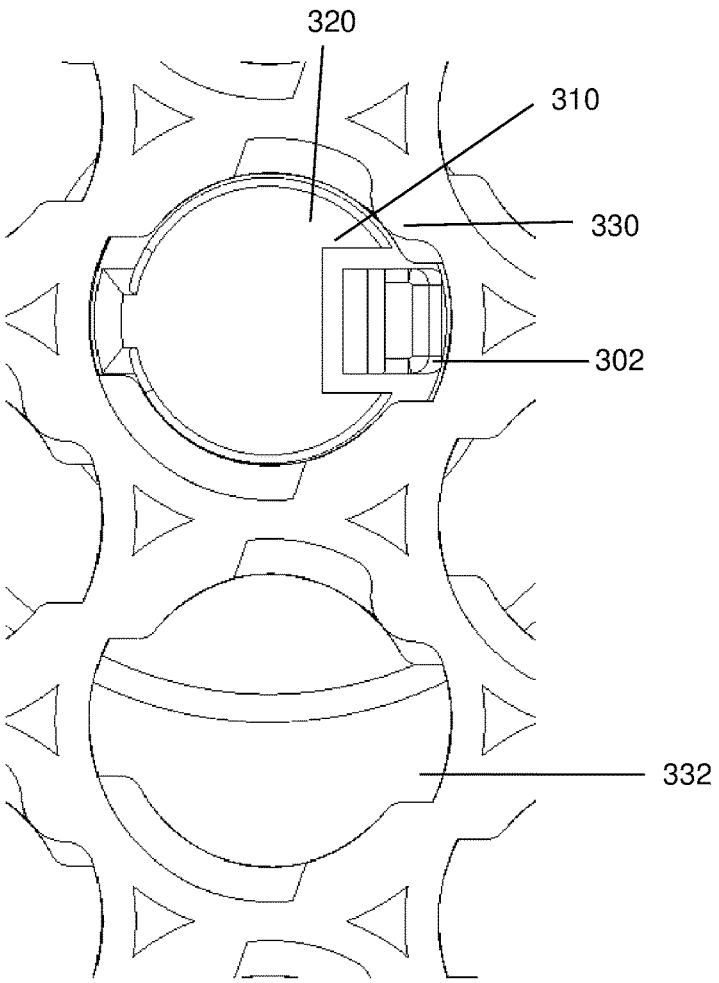
FIG. 3A is a magnified bottom view of 2 divider plate apertures, wherein a divider is inserted into the top aperture and the bottom aperture is empty.

FIG. 3A shows a top hole with a divider 320 inserted. The divider base 320 engaged with the recess 310 just prior to rotation. It can be seen that the projection 330 has not yet engage the flexurally depressible tab 302 and will not do so until rotation. The bottom hole 332 is empty.

Figure 3B:
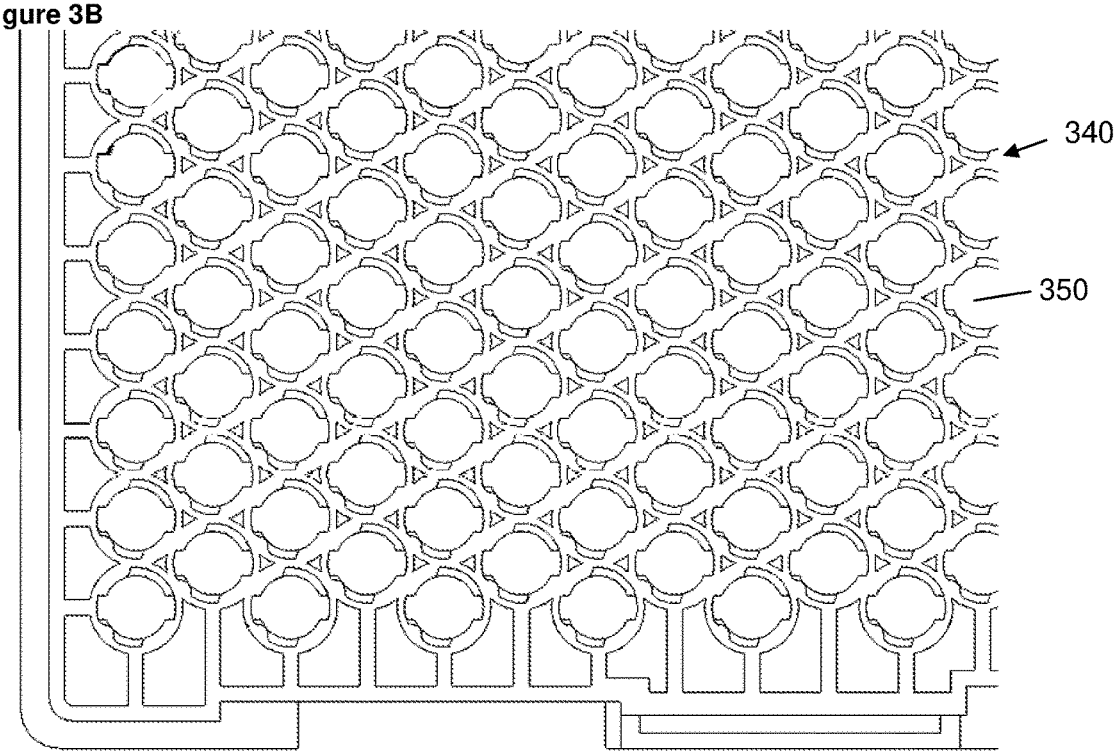
FIG. 3B is a bottom view of a section of a divider plate.

FIG. 3B shows a section of the bottom surface of the divider plate 340 with apertures 350.

Divider Plate

Figure 4A:
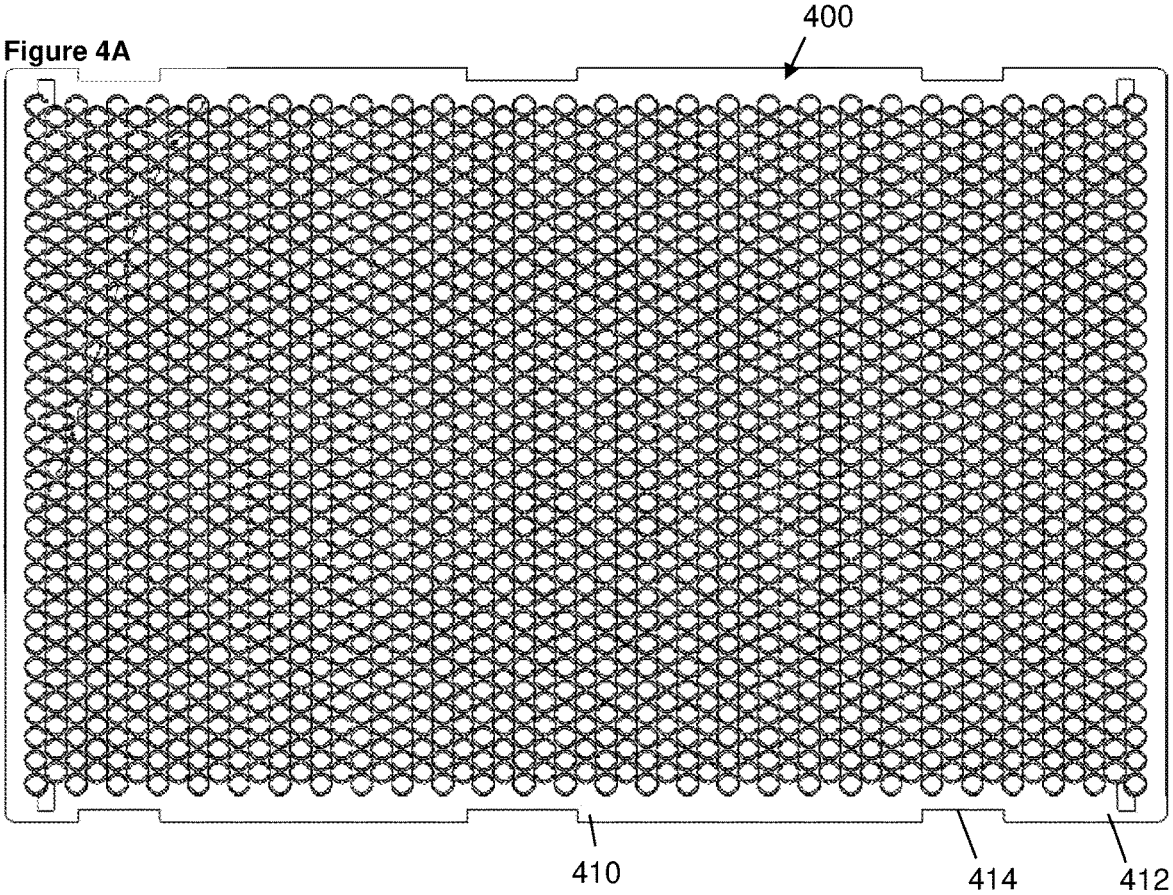
FIG. 4A is a top view of a divider plate.
Figure 4B:
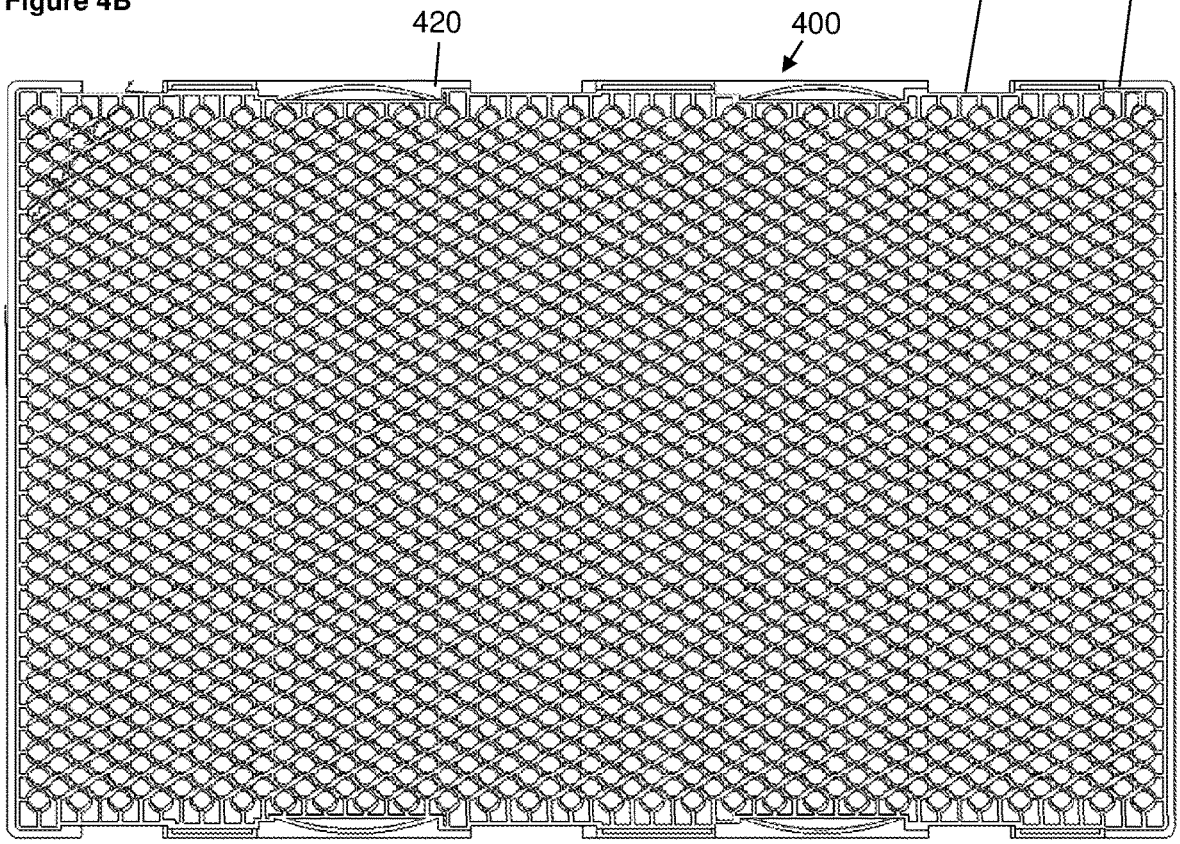
FIG. 4B is a bottom view of a divider plate.
Figure 5:
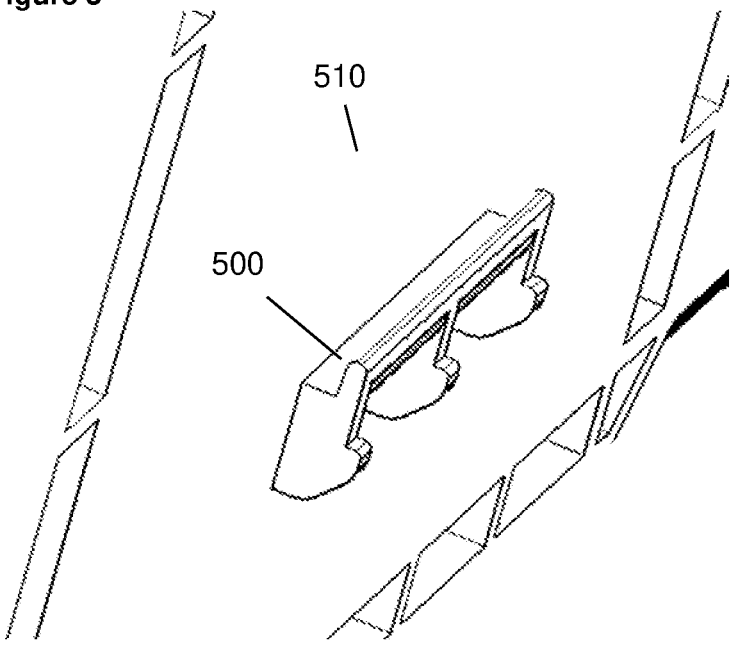
FIG. 5 is a perspective view of a hook system inside a container.

The following refers to FIGS. 4A, 4B and 5. FIG. 4A shows the top surface 410 of a divider plate 400, and FIG. 4B shows the bottom surface 420 of a divider plate 400.

A recess in one orientation cooperates to engage, and another orientation to slide past. The divider plate does not have rotational symmetry.

A hook system may be used with the divider system, or used in conventional box system. Springs on divider plate are a means to restrict accidental falling out. FIG. 5 shows a hook system 500 having an integrally molded portion on an inside wall of a box 510. The intention of the hook system 500 is to work with the divider plate 400 as shown in FIGS. 4A and 4B. It will be noted that at the longitudinal edges 412 of the divider plate there are three voids 414 on each side. It will be further noted that these are not uniformly spaced along the edge but instead offset such that the void 414 at one end is closer to the corner than the void 414 to the respective corner at the other end. These voids 414 are arranged to slide pass the hook 500 as shown in FIG. 5 and so when placing a divider plate 400 in a box 510, the divider plate 400 is slid down passed the hook 500 to settle at the bottom of the box 510. However, by having these offset voids 414, on rotating the divider plate 400, the voids 414 no longer line up with the hook 500 as shown in FIG. 5. Instead, the peripheral wall 412 about the divider plate 400 connects with the hook 500 and settles on the support surface to support the divider plate 400 above the bottom of the box. The hooks 500 as shown in FIG. 5 provide a secondary support so that the entire divider plate is supported on both the support surface and secondary support. The secondary support surface increases the bearing area of the divider plate on the hook 500. By having the divider plate 400 with no rotational symmetry, in one orientation the divider plate 400 will slide pass the hook system 500 and in the other will engage the hooks in order to be supported above it. The hook system therefore provides for additional storage and packing as compared to a conventional base and box.

Fluted Divider Head

Figure 6A:
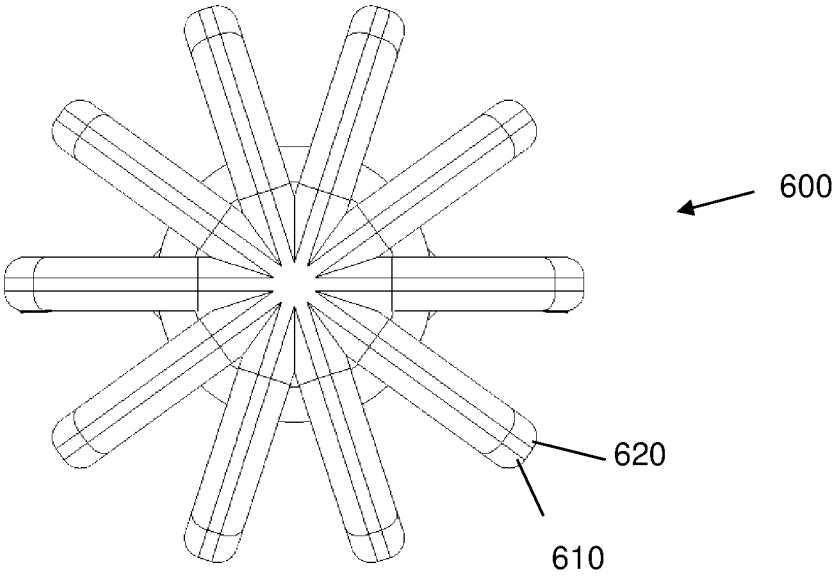
FIG. 6A is a top view of a fluted divider.
Figure 7C:
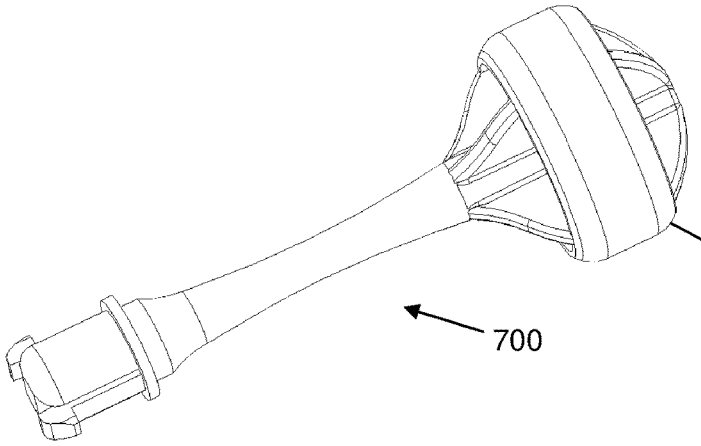
FIGS. 7C and 7D are perspective views of a snap fit divider.
Figure 7D:
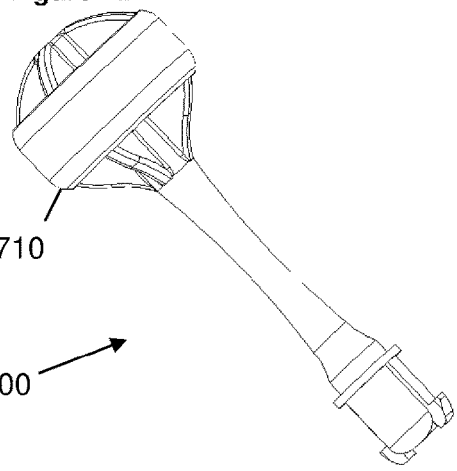
Figure 7E:
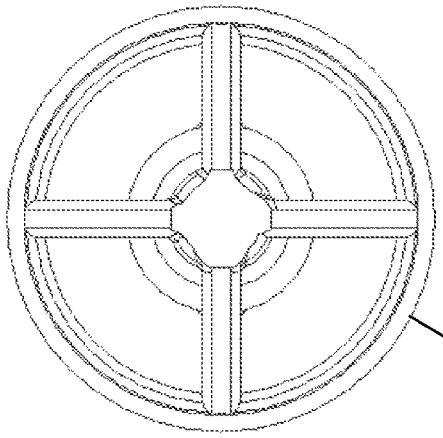
FIG. 7E is a top view of a snap fit divider.
Figure 7F:
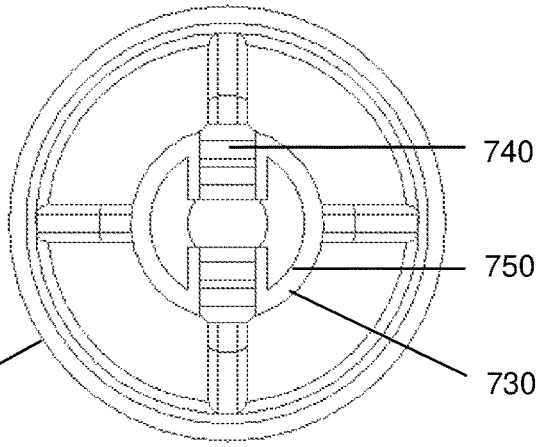
FIG. 7F is a bottom view of a snap fit divider.
Figure 7G:
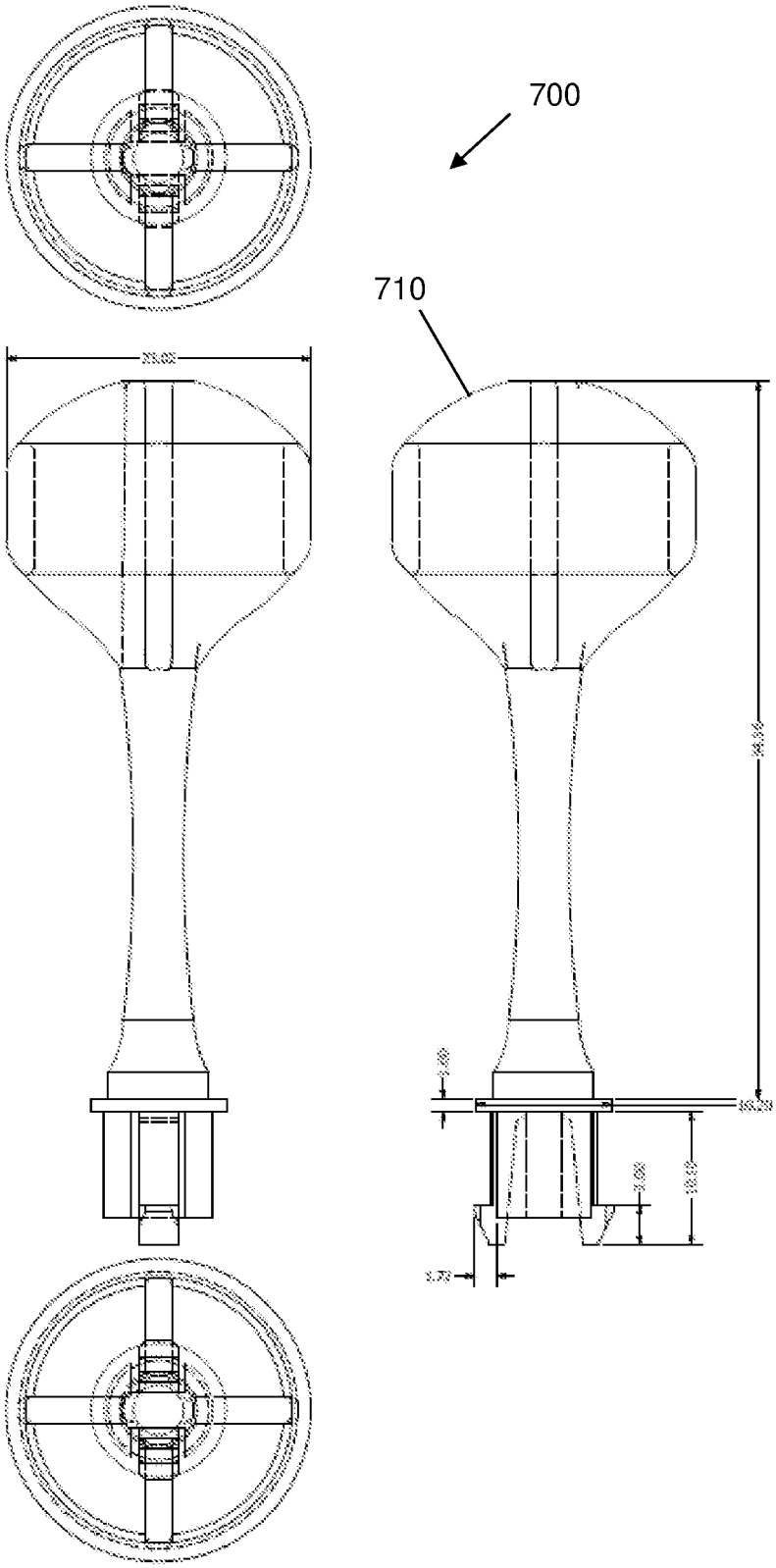
FIG. 7G is a general assembly drawing of a snap fit divider.

FIGS. 6A to 6C show a further embodiment of a divider head 610 of a divider 600 having a fluted circumference 620. This may be useful for an alternative end effector, whereby it acts as a socket wrench to engage the circumference of the divider head to rotate. To this end, the circumference may be:

i) Milled;

ii) Fluted (as shown in FIGS. 6A to 6C);

iii) External polygon shape, such as for a bolt head (eg rectangular pentagonal etc.)

iv) Internal polygon shape, such as an Allen head screw (eg rectangular, pentagonal etc.).

FIGS. 7A to 7G show various views of one embodiment of the divider 700. As noted, the head is circular in shape with this embodiment having a head 710 being an annular ring with internal supports directed radially from the throat 720 of the divider. Accordingly the head 710, whilst occupying a large volume, involves relatively small amounts of material. In this case the radial supports include four supports directed along two principle axis, but it will be appreciated that more or less supports may be used.

The throat 720 may be generally cylindrical having a tapered portion in the middle such that from the head 710 the throat 720 tapers at an intermediate point to a minimum diameter before expanding again near the base. In this way the throat will tend to bend about the intermediate point between the base and the head.

The divider base may also be generally cylindrical and arranged to fit within circular apertures in the divider plate.

The divider base 730 includes an H-shaped prism whereby the recesses in the H-shape accommodate flexible tabs arranged to engage at a distal end of the divider plate aperture. Thus the H-shape includes a generally circular outline which is arranged to fit snugly within the apertures of the divider plate allowing very little relative movement once inserted in the divider plate. In a further embodiment the tolerance of the outside diameter of the divider base may be very close to the inside diameter of the circular aperture in the divider plate.

As mentioned, the divider base 730 may include resiliently flexing tabs 740 arranged to retract into the H-beam 750 on insertion into the aperture and then spring outwards to engage the rim of the aperture once projecting therefrom. The divider base 730 and tabs 740 may be more readily seen in FIG. 7F. The H-beam resists transverse loads applied to the divider.

Figure 8A:
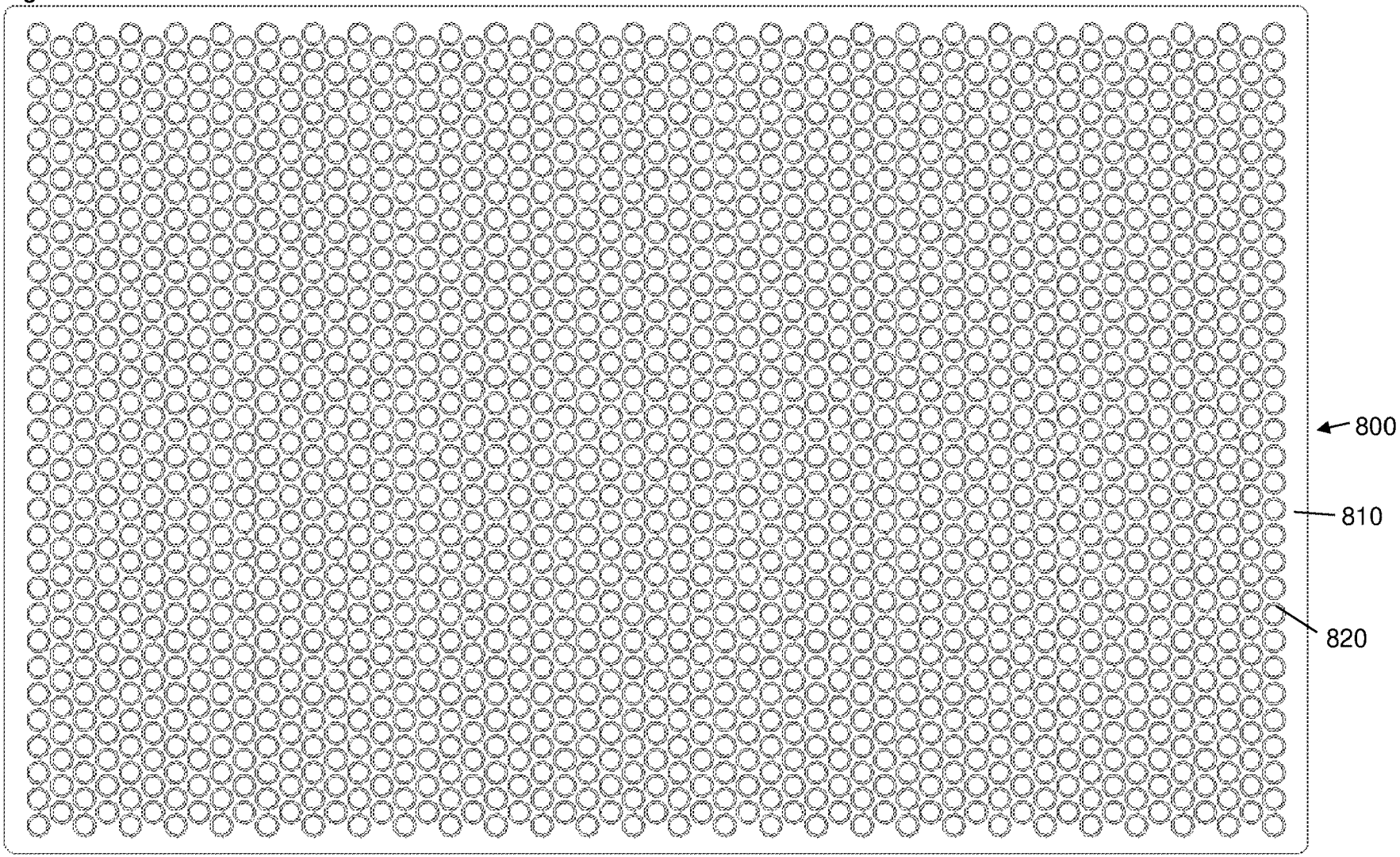
FIG. 8A is a top view of a divider plate with apertures.
Figure 8B:
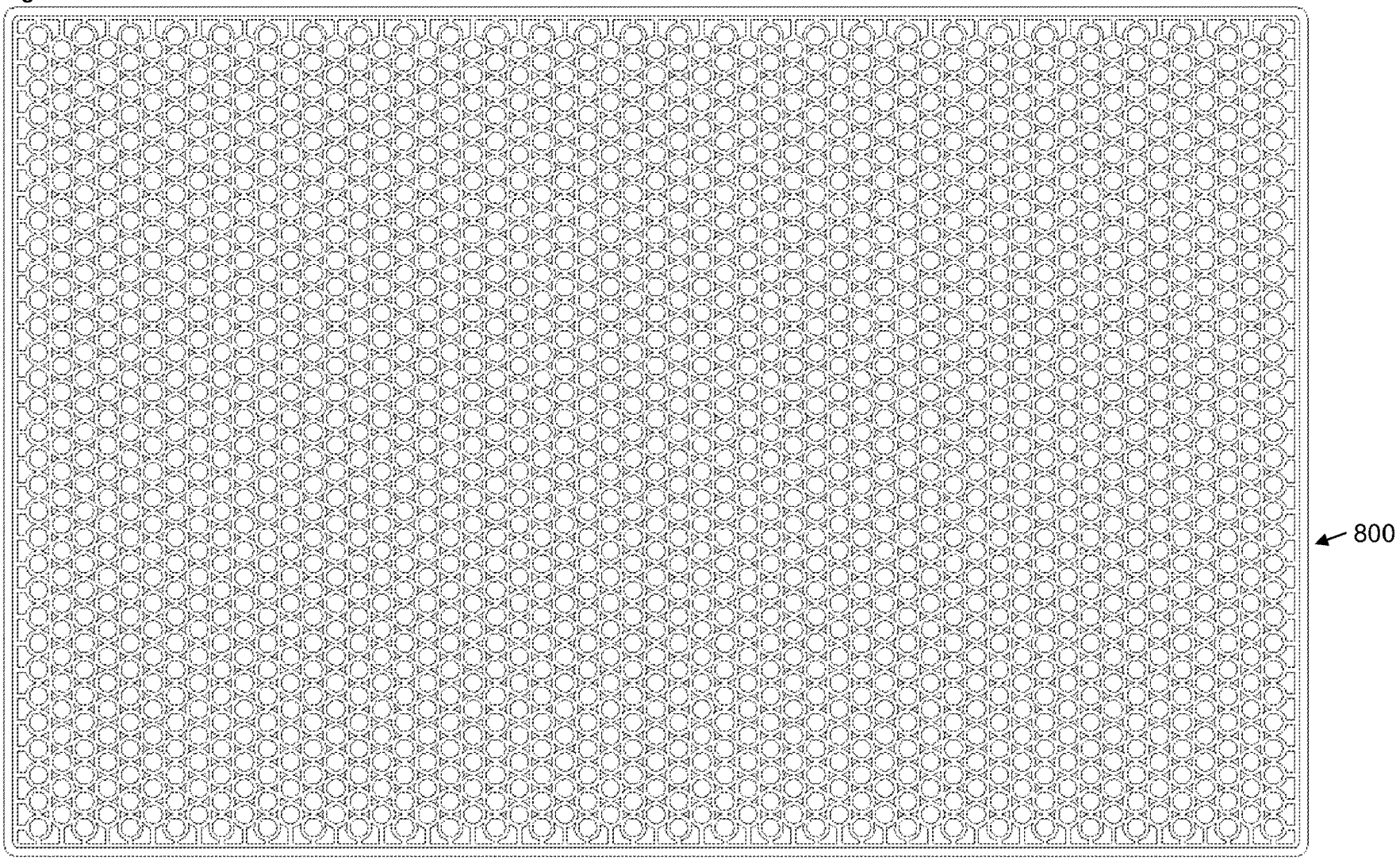
FIG. 8B is a bottom view of a divider plate with apertures.

With reference to FIGS. 8A and 8B, these are various views of one embodiment of the divider plate 800 into which the dividers of FIGS. 7A to 7G are arranged to fit. In this embodiment, the top surface 810 of the divider plate is a thin plate having a dense array of apertures 820 projecting downwards. From beneath the divider plate it can be seen that the apertures 820 are, in fact, cylinders which have been molded to the thin plate and thus having little or no material in between each cylinder. The divider plate of FIGS. 8A and 8B are therefore a single unitary element, molded as a single piece.

Figure 8C:
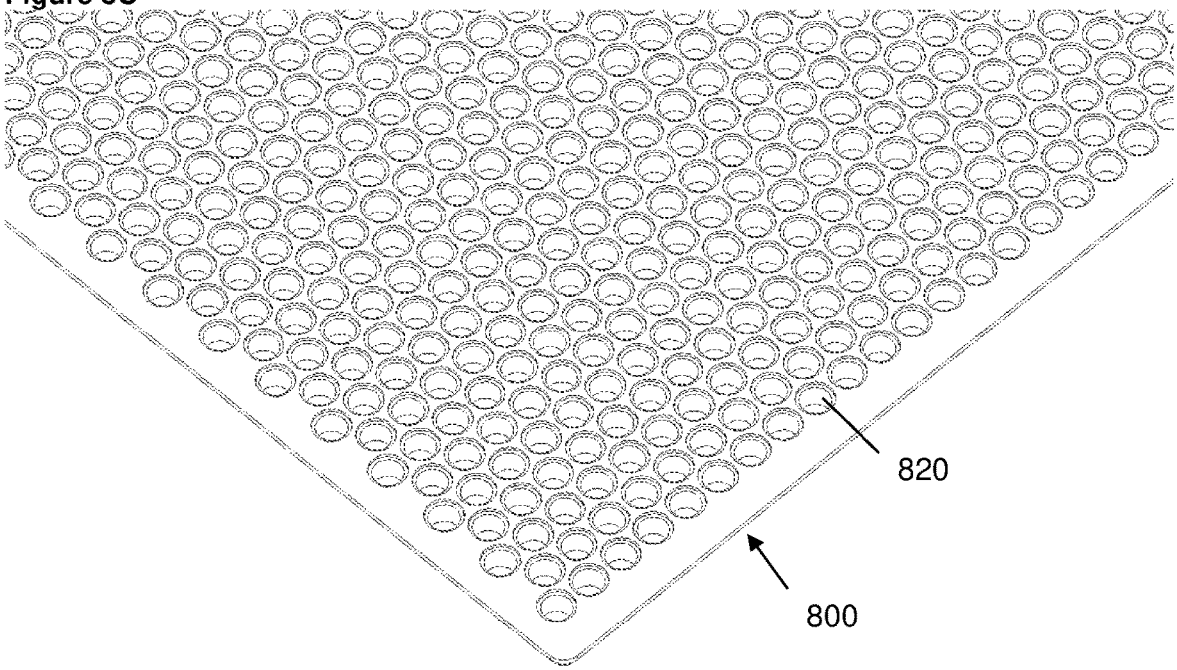
FIGS. 8C and 8D are perspective views of the top and bottom surfaces of a divider plate respectively.
Figure 8D:
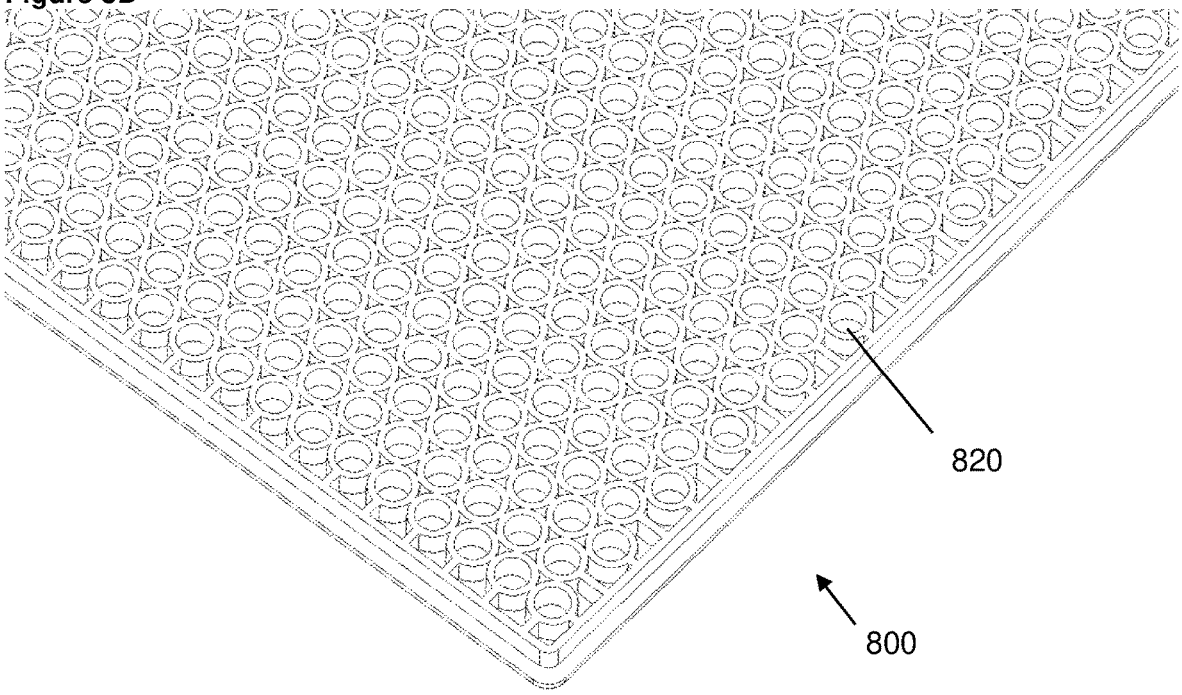

It follows that the divider plate 800 may be relatively light as compared to other forms of divider plate, where the apertures are provided within a thick plate. The cylindrical shape of the apertures 820 can be seen in FIG. 8C and 8D. In particular, the exit point for each cylindrical aperture 820 provides a rim onto which the tabs 740 of the divider may engage.

Figure 9A:
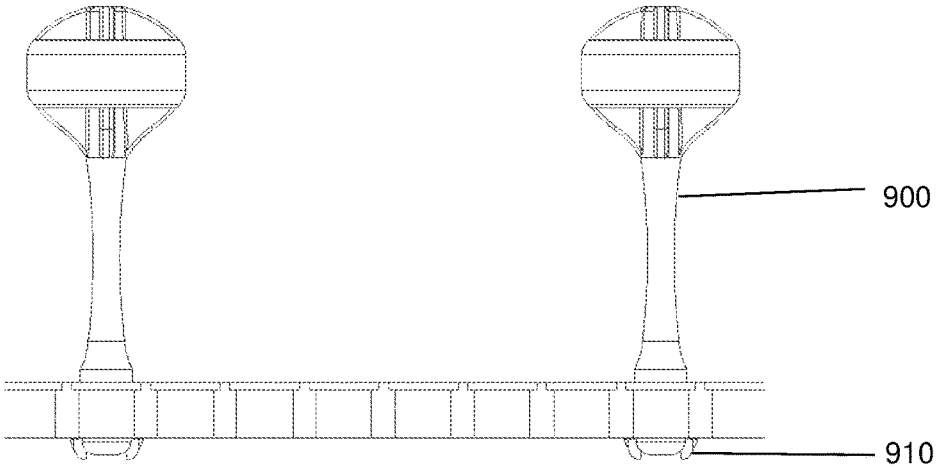
FIG. 9A is a side view of 2 dividers inserted on a divider plate.
Figure 9B:
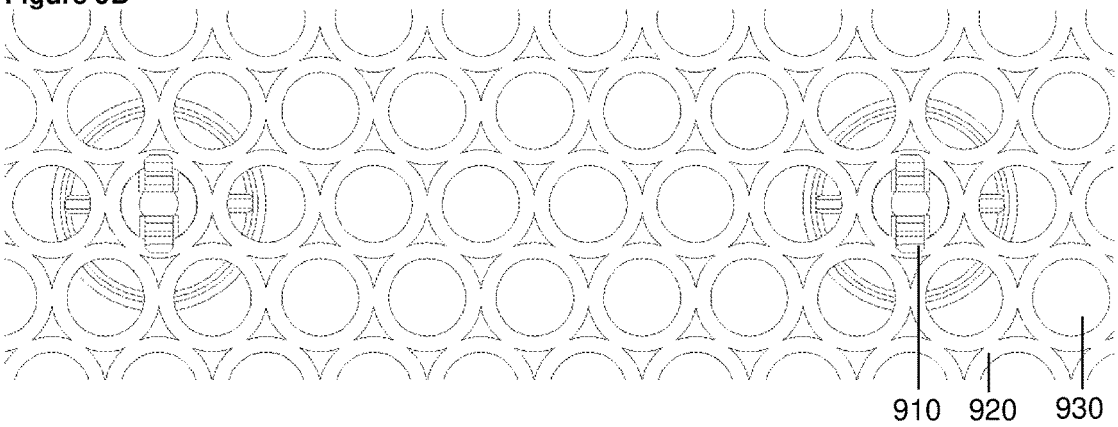
FIG. 9B is the bottom view of 2 dividers inserted on a divider plate.
Figure 9C:
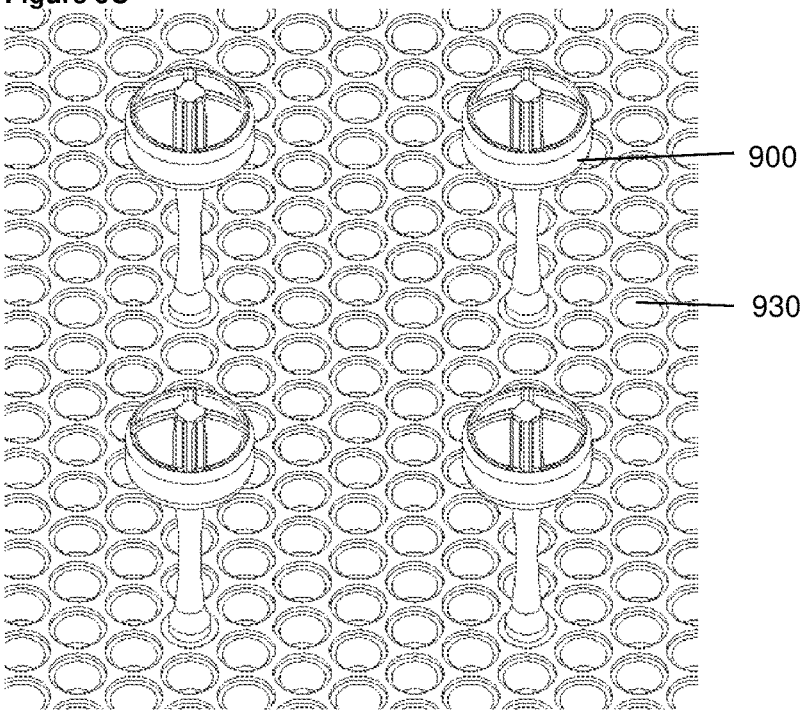
FIG. 9C is a perspective view of 4 dividers inserted on a divider plate.

FIGS. 9A to 9C provide the assembled view of the dividers 900, having the tabs 910 engaged with a rim 920 of each cylindrical aperture 930, as particularly shown in FIG. 9B.

Figure 10A:
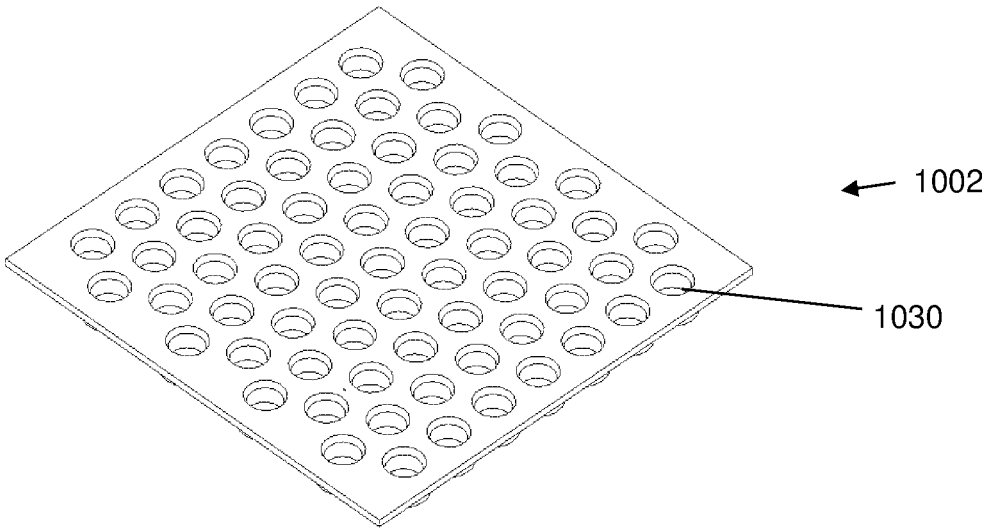
FIG. 10A is a perspective view of the top surface of a divider plate without through-holes.
Figure 10B:
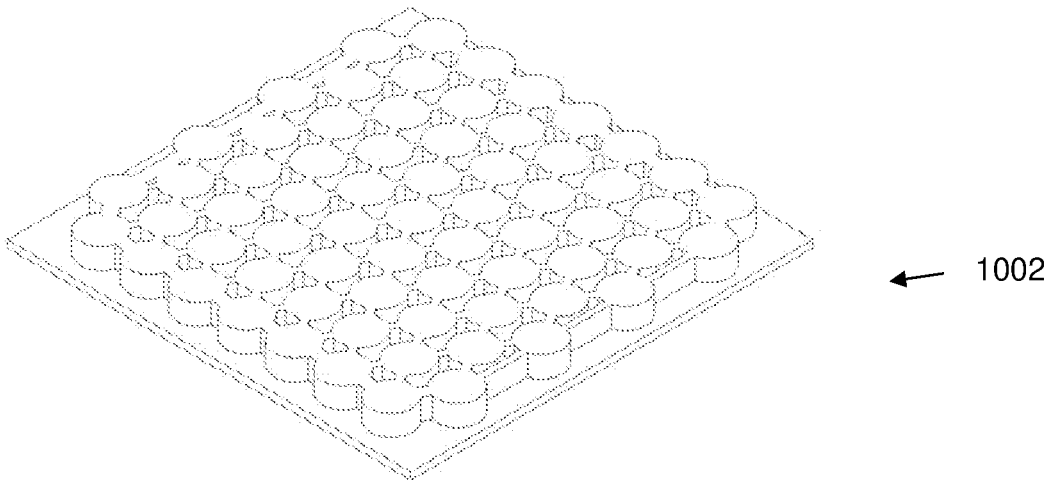
FIG. 10B is a perspective view of the bottom surface of a divider plate without through-holes.
Figure 10C:
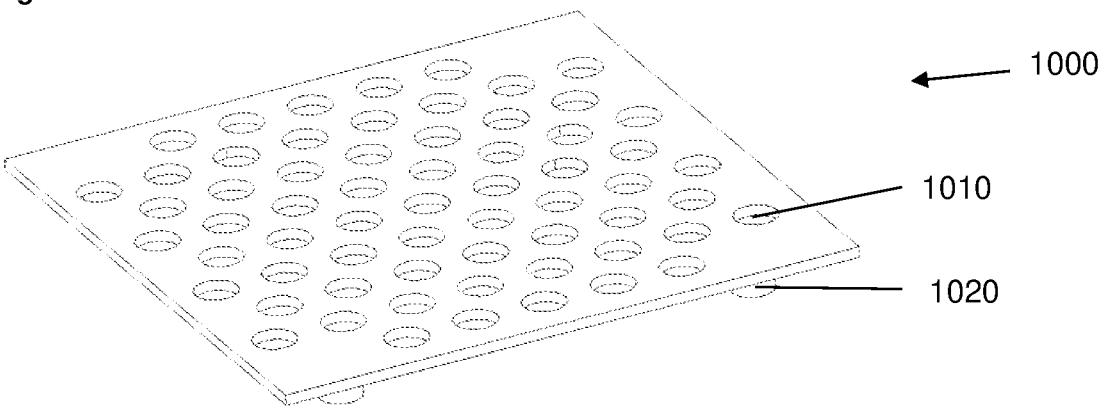
FIGS. 10C and 10D are perspective views of the respective top and bottom surfaces of a divider plate with through-holes and corner protrusions.
Figure 10D:
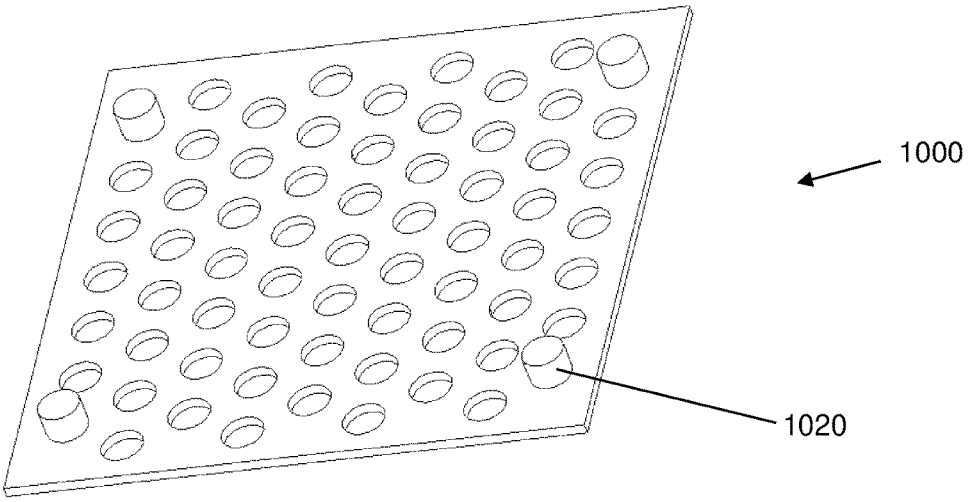

FIGS. 10A to 10E show an alternative embodiment whereby the divider plate includes two separable parts. The first part, as shown in FIGS. 10C and 10D, includes a thin plate 1000 having an array of circular holes 1010 molded therein. On an underside of the plate are solid projections 1020, which for this embodiment there are four, which are arranged to engage with apertures 1030 in the second part of the divider plate 1000 as shown in FIGS. 10A and 10B.

FIGS. 10A and 10B show second plate member 1002 having circular apertures 1030 projecting downwards and from the underside the apertures are seen to be cylindrical in shape having little material in between each cylinder. Where the embodiment of FIGS. 10A and 10B varies from the divider plate 800 of FIGS. 8A and 8B is that the cylinders forming the apertures 1030 are closed at one end and thus are arranged to receive the divider base but do not provide a rim onto which the divider may engage. Thus, the divider 700 of FIGS. 7A to 7G will not work with the base 1000 of FIGS. 10A to 10D.

FIGS. 11A to 11F show an alternative design for the divider 1100. In this embodiment the shape of the divider 1100 above the base is similar. It will be seen that the throat 1110 is not tapered in the same way that the divider 700 of FIGS. 7A to 7G. This merely demonstrates a variant which could be applicable to either divider. Hence the dividers 1100 of FIGS. 11A to 11F are purely cylindrical for no reason other than showing the alternative to the previous embodiment.

Figure 10E:
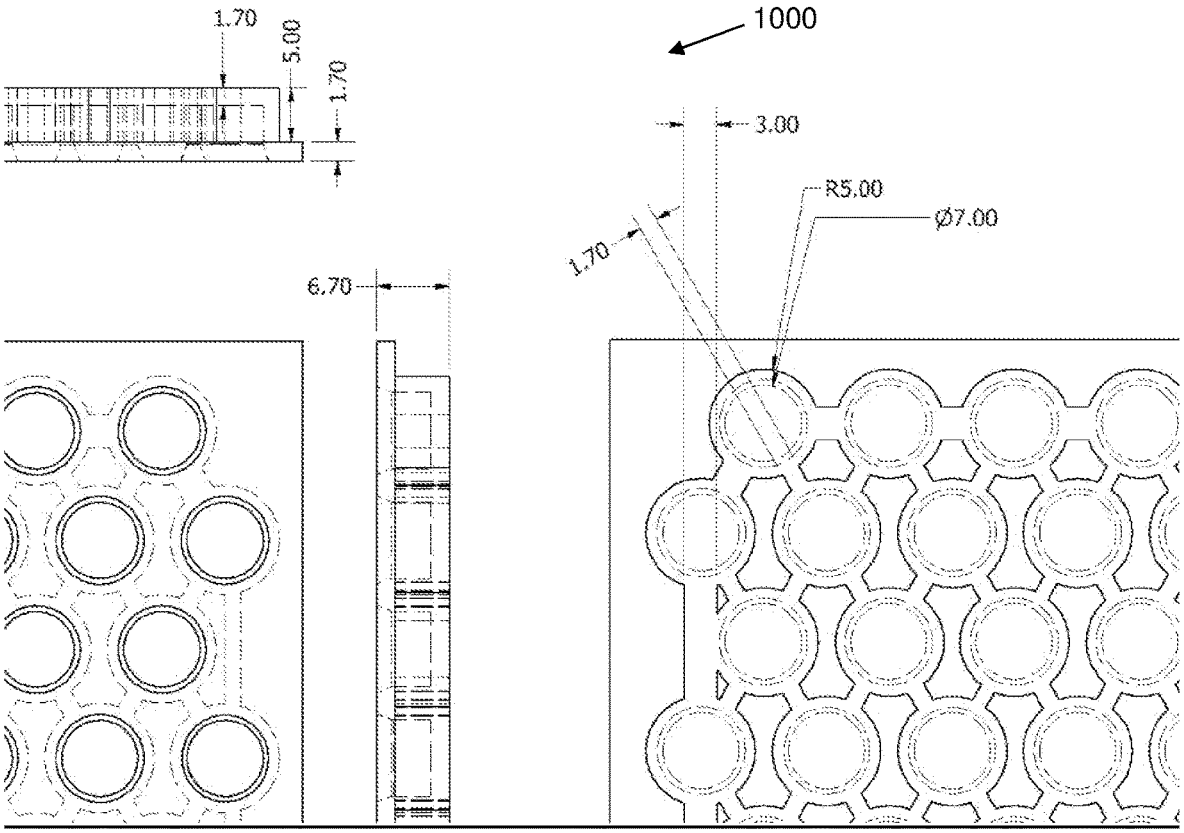
FIG. 10E is a general assembly drawing of a divider plate.
Figure 11G:
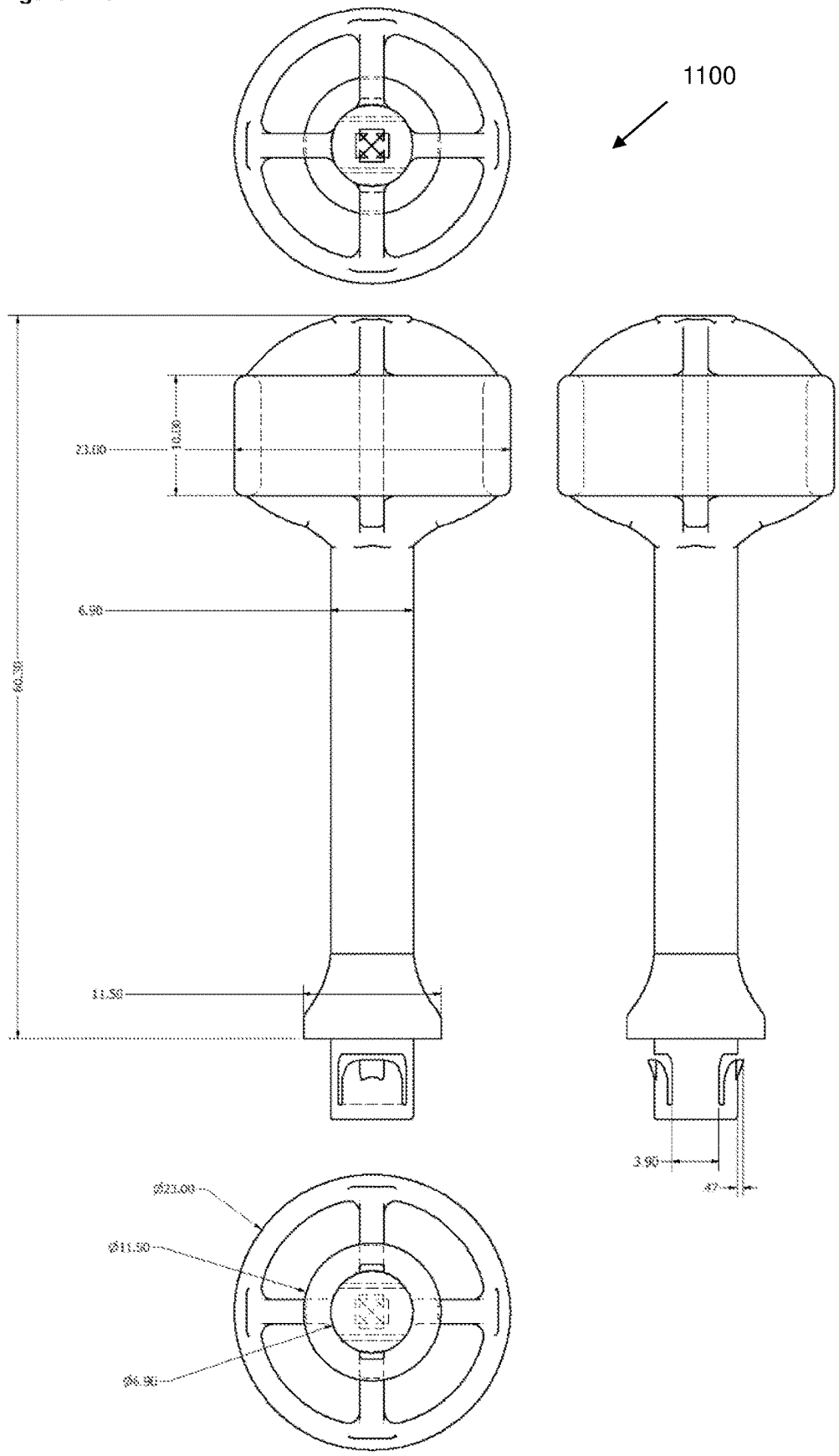
FIG. 11G is a general assembly drawing of the divider of FIGS. 11A-11F.

The important aspect of the present divider lies in the base 1120. As can be seen in FIG. 11F the base is purely cylindrical and not H-shaped as is the case in the previous embodiment. The base includes spring clips 1130 which again are arranged to engage with the divider plate. The spring clips 1130 of this embodiment, however, are purpose designed for the base 1120 of FIGS. 10A and 10B. Here the spring clips 1130 are upwardly directed and proximate to the upper side of the divider base 1120. In this case, as the divider 1100 is inserted firstly within the separable thin plate, the spring clips 1130 are compressed and once clear of the thin plate, spring outwards to engage the underside of the thin plate. The diameter of the apertures in the thin plate is the same as the diameter in the second plate member. However, as shown in FIG. 10E, the second plate member includes a chamfer. When the thin plate is fixed to the second plate member, the chamfer forms a ridge against the underside of the thin plate member, and so allowing the spring clip 1130 to engage the ridge. The divider base is therefore held tightly in the second plate member, with the spring clip 1130 engaged with the ridge.

One advantage of the arrangement of FIGS. 10A-10E is the ability of the second plate member 1002 to be placed in the container with the dividers being insertable at a separate time and/or location into the separable thin plate. Second plate 1002 may be integral with a box. Both features of the second plate may be applicable to all divider plates.

Dividers may be inserted separately into thin plate 1000, and then the thin plate 1000 and dividers are inserted into the box. When ready for packing the pre-loaded thin plate 1000 having the dividers already in place can then fit directly into the lower base with the four projections fitting into the lower base together with the various bases of the place dividers. By pressing the thin plate 1000 into the lower base 1002 it may be securely engaged ready for packing.

Thus, having a separable two-piece divider plate may provide further modularity to the system as compared to the embodiments shown in FIGS. 7 to 9.

Because the dividers 1100 of FIGS. 11A to 11F engage with the thin plate 1000, in a still further embodiment, the thin plate may act as a standalone divider plate, without the second plate member. In this way, the divider system includes a very light weight option, by excluding the added weight of the second plate member.

FIGS. 12, 13A, 13B and 13C show a divider 1200 which is insertable into an aperture of a divider plate. The divider plate may have an array of apertures to receive the dividers 1200, providing a wide scope to form two dimensional shapes in the divider plate using the dividers 1200. Various aspects of FIGS. 12 and 13A-13C may be applied to other dividers.

The two dimensional shapes may be selectively formed and reformed, depending upon the type of goods being transported. To this end, the dividers may be inserted into the apertures of the divider plate according to the shape and size of the goods in question. For the next transportation contract, different goods may be involved, whereupon the dividers can be extracted and reinserted into the desired shape for the new goods.

An aspect of the dividers is the ability to act as a buffer between items, which may be damaged should the divider plate (or container in which it is placed) be mishandled. Thus, the dividers act as a barrier between adjacent goods.

In the embodiment shown in FIG. 12, the dividers 1200 include buffer stripes 1210 which span from the base to the top. On contact, the buffer strips 1210 flex so as to prevent damage of the goods.

The stem 1220 of the divider may be relatively stiffer than the buffer strips 1210. This may be achieved by making the stem 1220 thicker than the buffer strips 1210 as can be seen in FIG. 12. Alternatively, the stem 1220 and buffer strips 1210 may be a co-injected piece of different materials.

In one embodiment, the dividers may be made from a relatively soft material such as HDPE, PP, or other polymer having a glass transition temperature below ambient conditions, and so being relatively soft. For highly resilient applications, the dividers may be made from polyoxymethylene (POM) or acrylonitrile butadiene styrene (ABS).

Figure 51C:
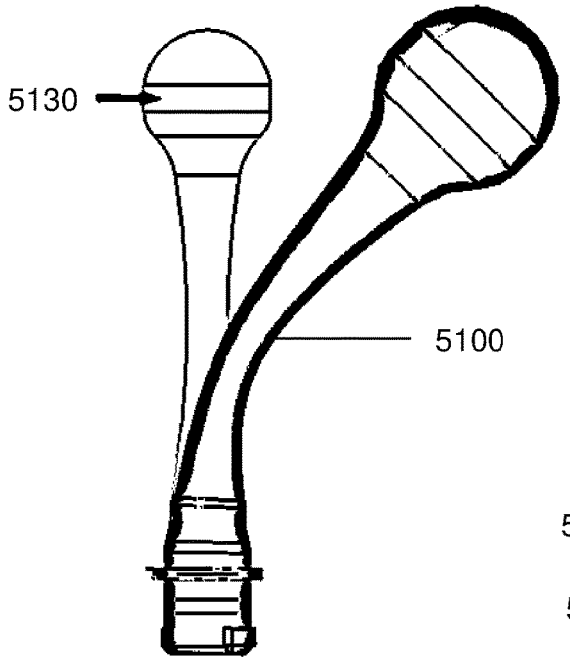
FIG. 51C is a side view of a force exerted on the divider of FIGS. 51A-51B.

The arrangement of the dividers may be such that there is a gap between the dividers and goods allowing for some movement. Alternatively, the dividers may be placed such that the buffer strips 1210 are slightly compressed, and so apply a small force to the goods. This may hold the goods tightly so as to limit movement, but without having a fixed immovable barrier. Instead, the applied holding force may be resilient. Alternatively, the divider may be deflected or flexed as shown in FIG. 51C to hold the goods tightly.

Figure 14:
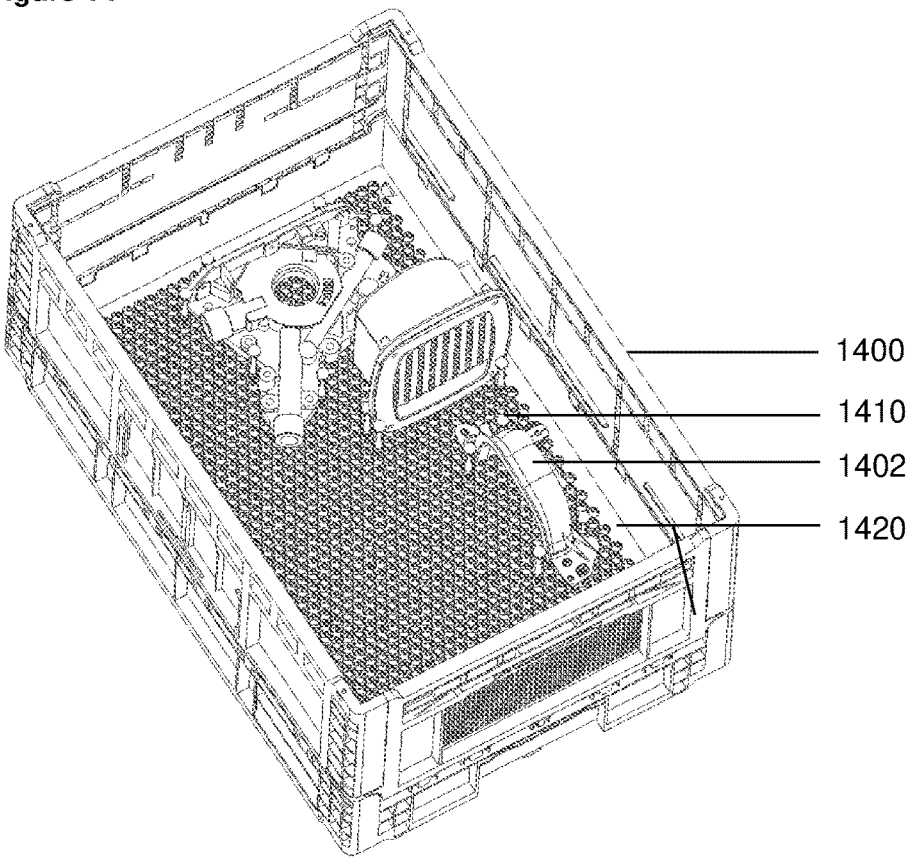
FIGS. 14 and 15 are respective perspective and top views of objects with dividers on a divider plate in a container.
Figure 15:
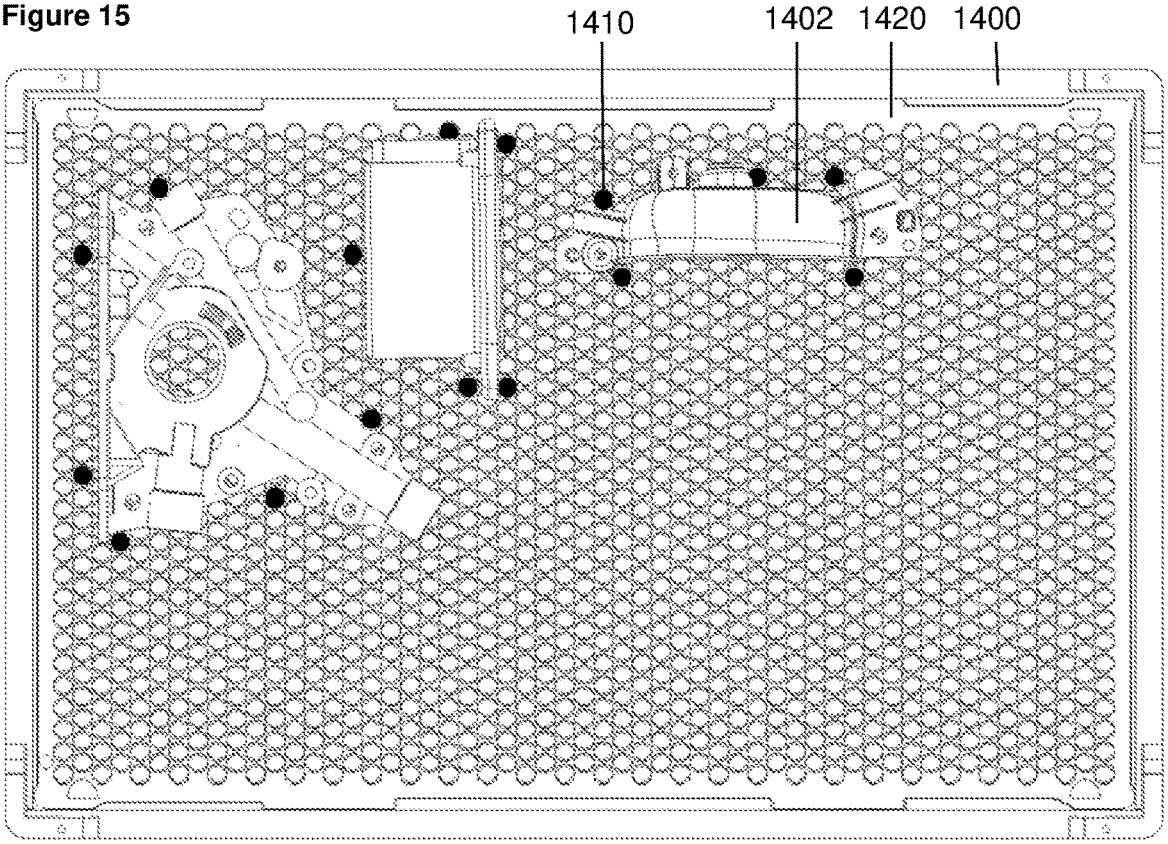
Figure 16:
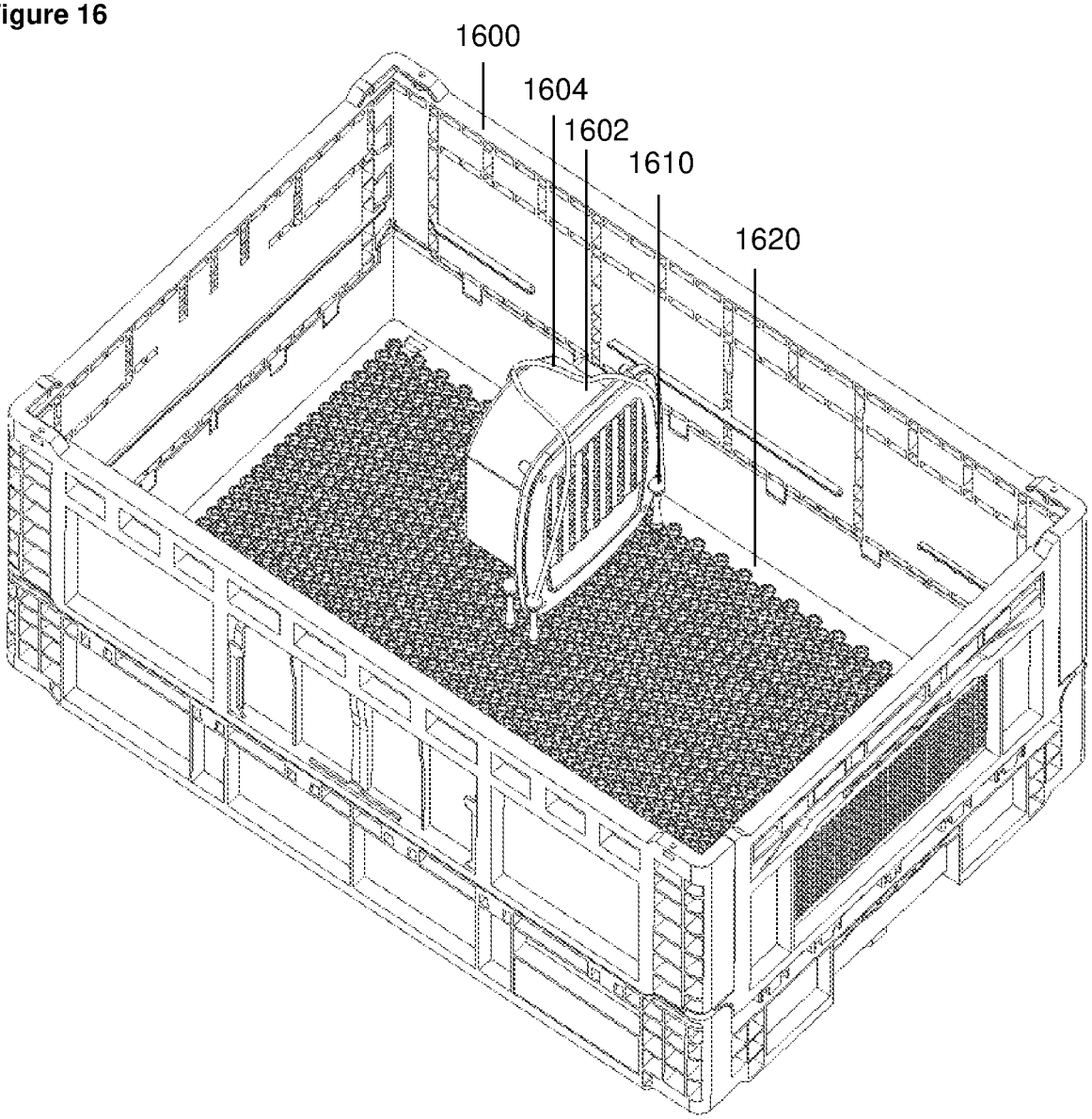
FIG. 16 is a perspective view of an object with dividers and straps on a divider plate.
Figure 17D:
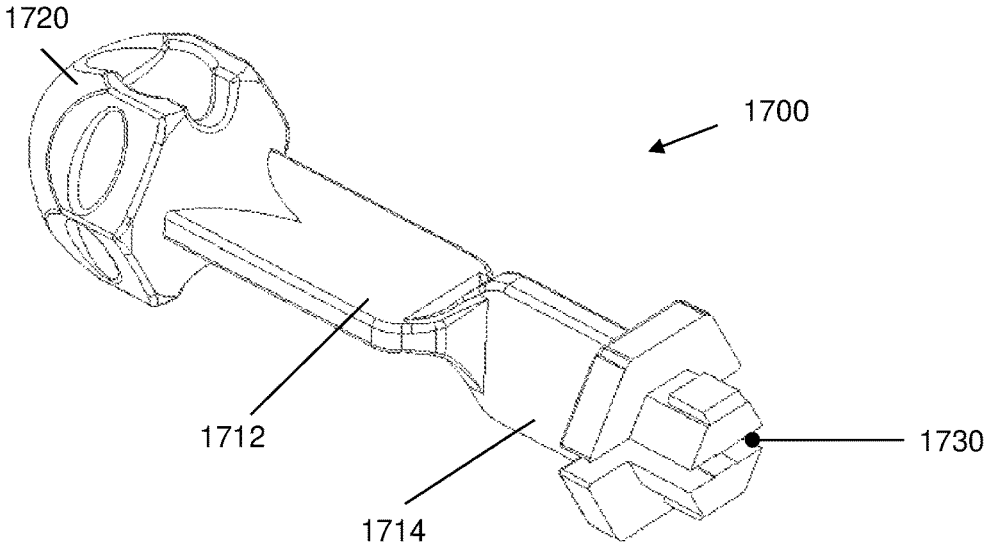
Figure 18A:
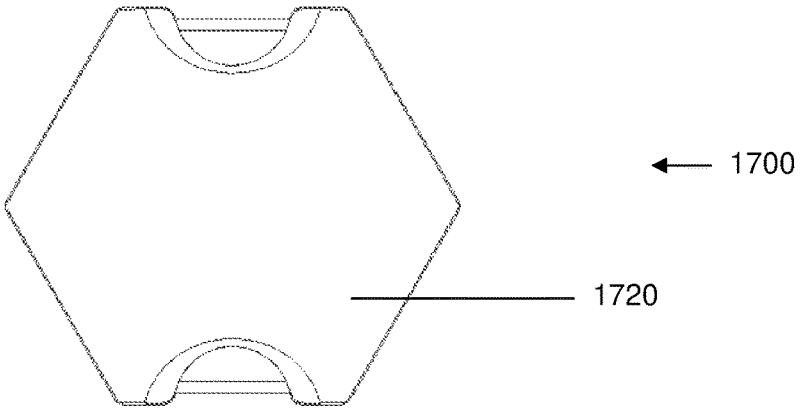
FIG. 18A is a top view of the divider of FIGS. 17A-17D.
Figure 18B:
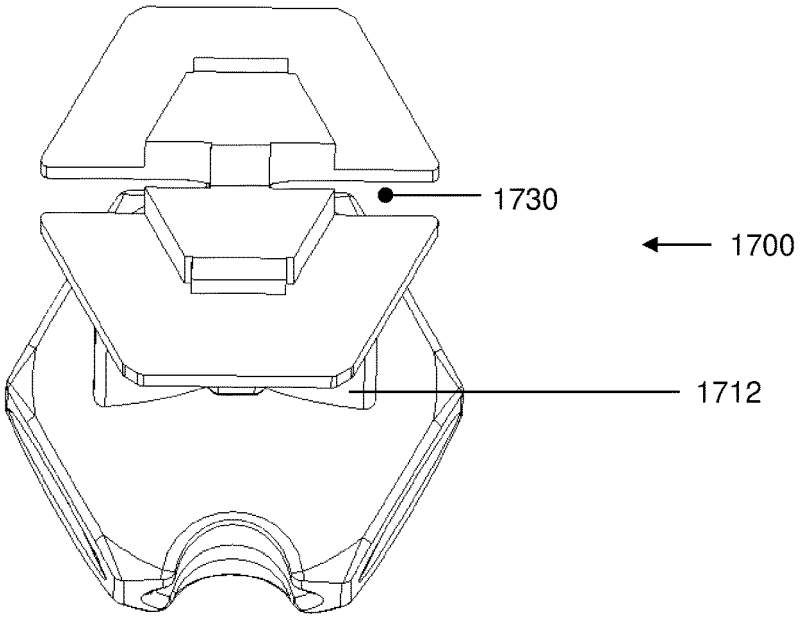
FIG. 18B is a bottom view of the divider of FIGS. 17A-17D.
Figure 19:
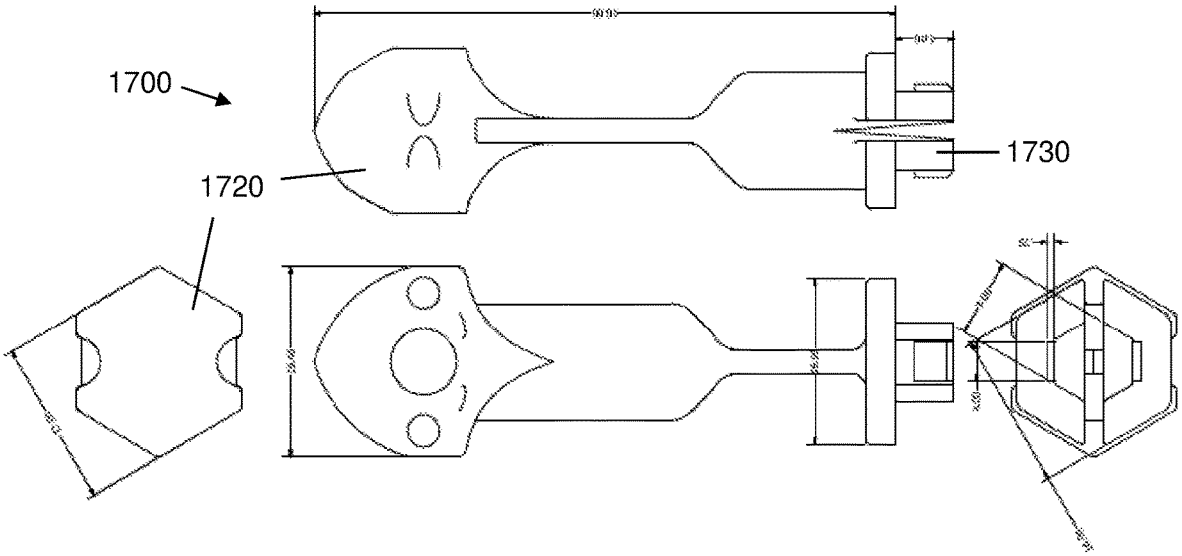
FIG. 19 is a general assembly drawing of the divider of FIGS. 17A-17D and 18A-18B.

FIGS. 14 and 15 show the arrangement of dividers 1410 with objects 1402 on a divider plate 1420 in a container 1400. The dividers 1410 are shown as black dots in FIG. 15 to distinguish from the apertures. FIG. 16 shows that straps 1604 can be used in addition to the dividers 1610 to secure a bulky object 1602 to the divider plate 1620 in the container 1600.

Another embodiment of the divider 1700 with a conical head 1720 is shown in FIGS. 17A to 17D, 18A to 18B and 19. Here the stem 1710 comprises an upper 1712 and lower portion 1714. The upper portion 1712 may be longer than the lower 1714. The two portions are flat and elongate in shape, with the planes of the two portions rotated 90° to each other. The flat elongate shape of the two portions mean that when the face of flat portion faces an applied load, the resistance is less than when the face at right angles. By positioning the dividers 1700 of this embodiment with the face of the upper portion 1712 facing the goods, the face of the lower portion 1714 will be at right angles. In this orientation, the lower portion 1714 will be stiffer than the upper portion 1712. Thus, the divider of this embodiment, depending upon the position, may provide stiffer encasement at the lower part and stiffer at the top, which enables it to take multi-directional forces. This may have the advantage of more securely fixing the goods, but allow some movement at the upper portion. The divider base contains bifurcations 1730 and tabs 1731.

Another embodiment 2300 as shown in FIGS. 23A-23D, 24A-24B, 25 and 26 operate in a similar manner. For instance, both embodiments include a bifurcation 2310 near the divider base 2320, which allows for squeezing of the divider base 2320. It will be noted that the embodiment of FIG. 23A-23D has a longer bifurcation 2310 as compared to the embodiment of FIG. 17A (1730).

Insertion and retraction of the divider is therefore facilitated by squeezing the divider base 2320 to laterally move lugs 2311 on the divider base 2320 to release or engage with the apertures in the divider plate.

Figure 22:
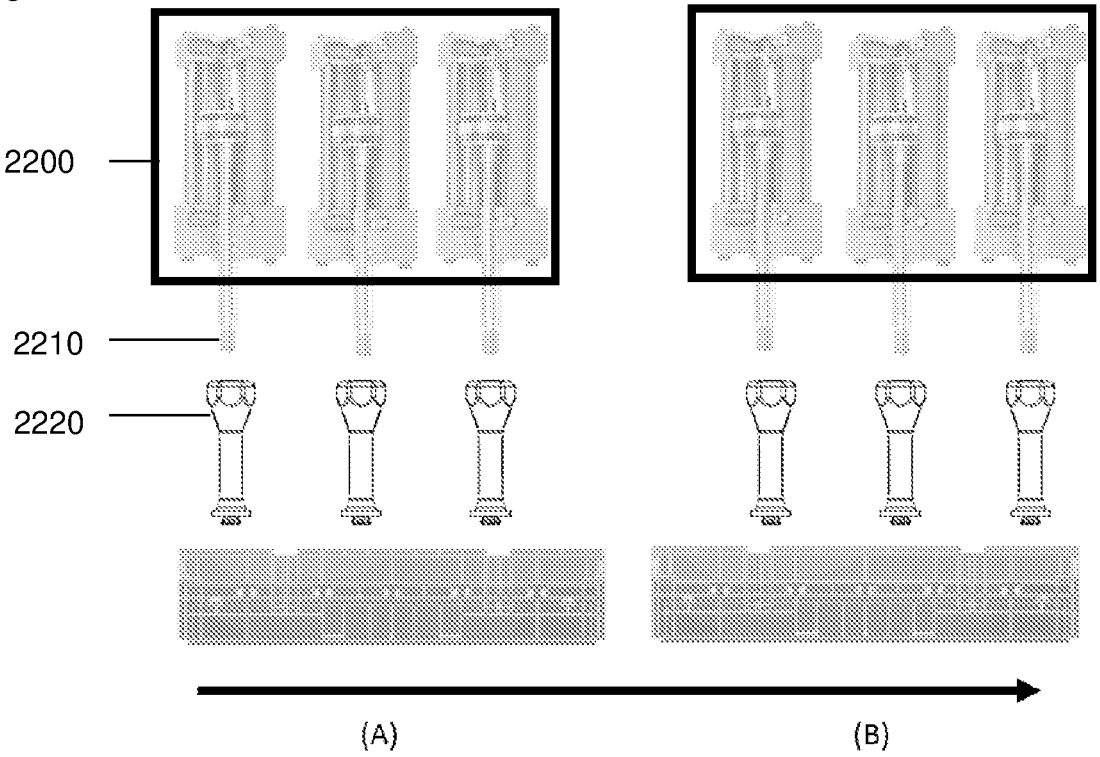
FIG. 22 is a schematic diagram of automated divider assembly.
Figure 25:
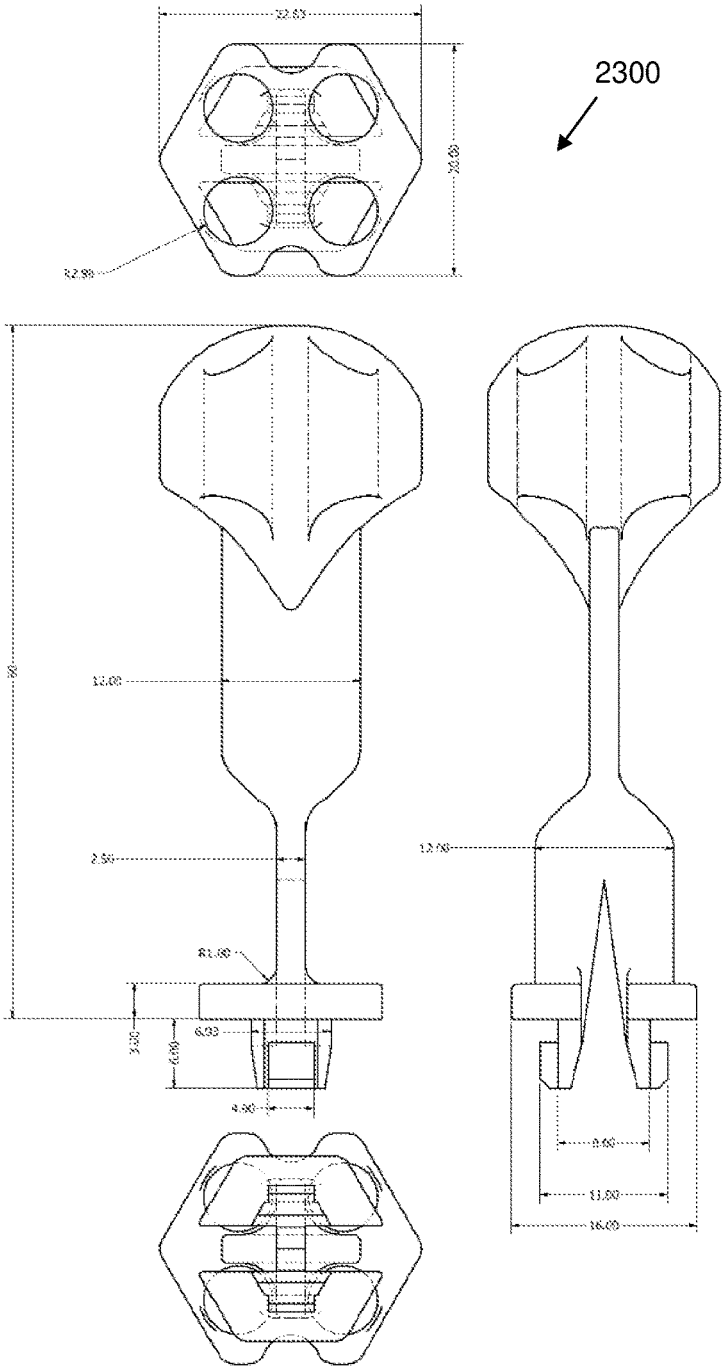
FIG. 25 is a general assembly drawing of a divider of FIGS. 23A-23E and 24A-24B.

Another common feature between the two embodiments are the pair of grooves 2332 in the head 2330 running parallel to the longitudinal axis of the divider, on either side of the bifurcated stem 2340. For automation (FIG. 22), the device 2200 may include a pair of arms 2210 which locate into the grooves. The arms 2210, once located may then apply a force to a divider 2220, squeezing the bifurcated stem, and so allowing for release or engagement of the divider base lugs. In a further embodiment to insertion/retraction device may include an enclosed hexagonal head, similar to a spanner, with lugs positioned to be located within the grooves.

A further common feature of the embodiments of FIG. 17A and 23A is the conical shaped head 1720 (2330 in FIG. 23A). This may apply to each of the described, single stem dividers. As placement of goods within the dividers may also be automated, by having conical or rounded heads, a misalignment of the automated device may contact the conical head and guide the goods into place. Thus the dividers may also act as aligning devices to provide an extra tolerance for automated or manual placement. This also applies similarly to the rounded head of FIG. 51A.

Figure 26:
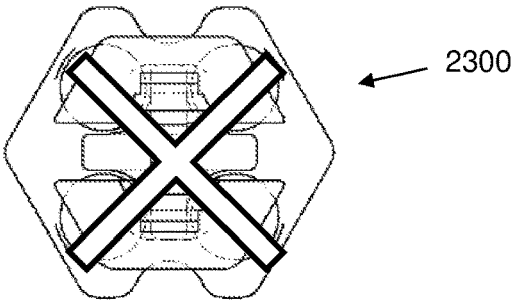
FIG. 26 is a schematic diagram of a divider base.

In a still further embodiment, FIG. 26 shows a divider having a stem with a cross in cross section, rather than the flat elongate portions of FIGS. 17A and 23A. The cross may be arranged such that the arms of the cross terminate on opposed sides of the bifurcation. This embodiment therefore allows for a more uniform stiffness, regardless of the direction of the applied force. The applied force may then be applied along principal axes, through the cross shaped stem.

Figure 20A:
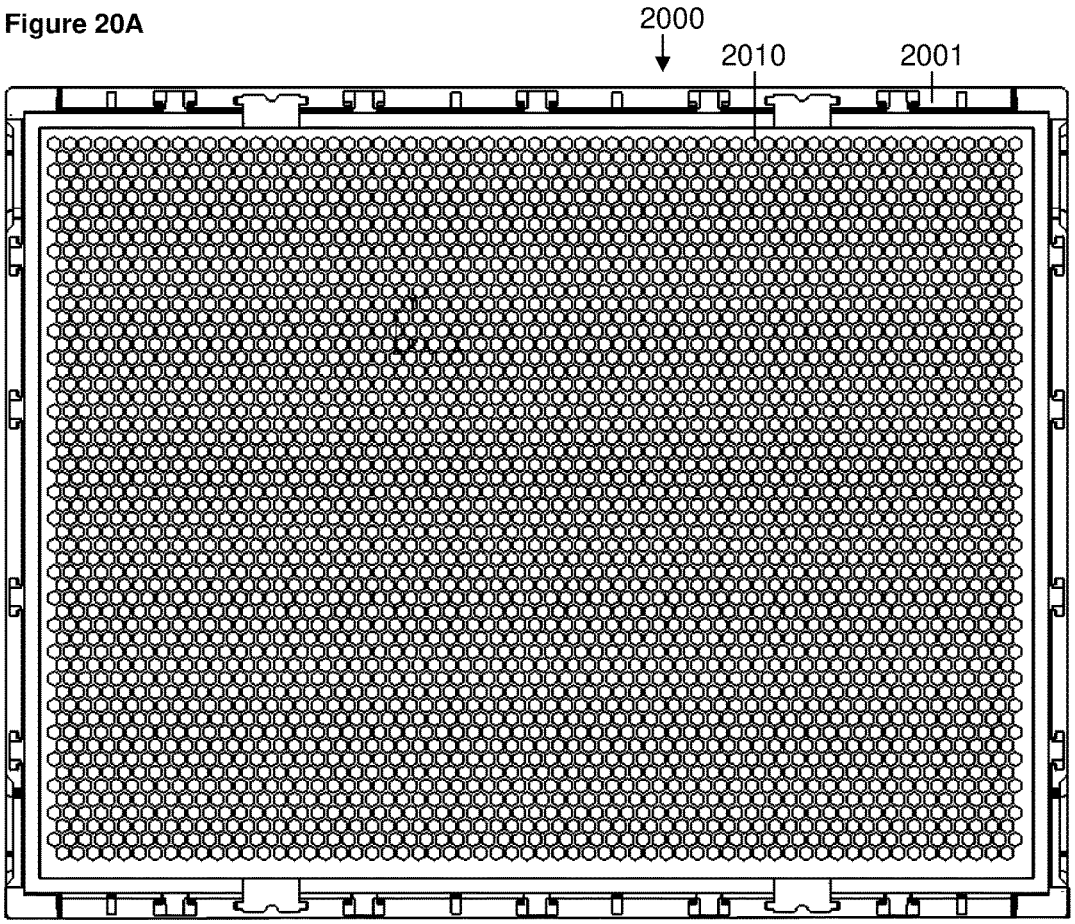
FIG. 20A is a top view of a divider plate integral with a container.
Figure 20B:
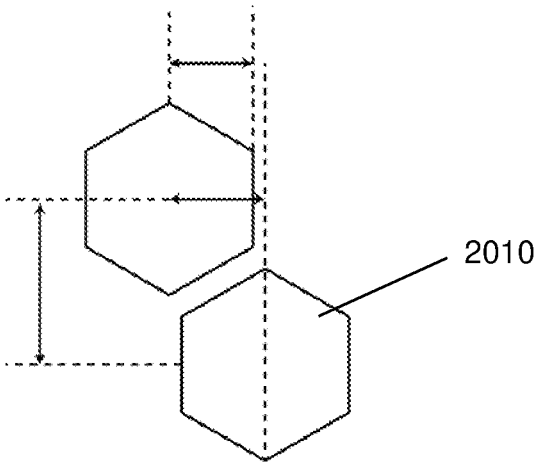
FIG. 20B is a schematic diagram of hexagonal apertures.
Figure 21A:
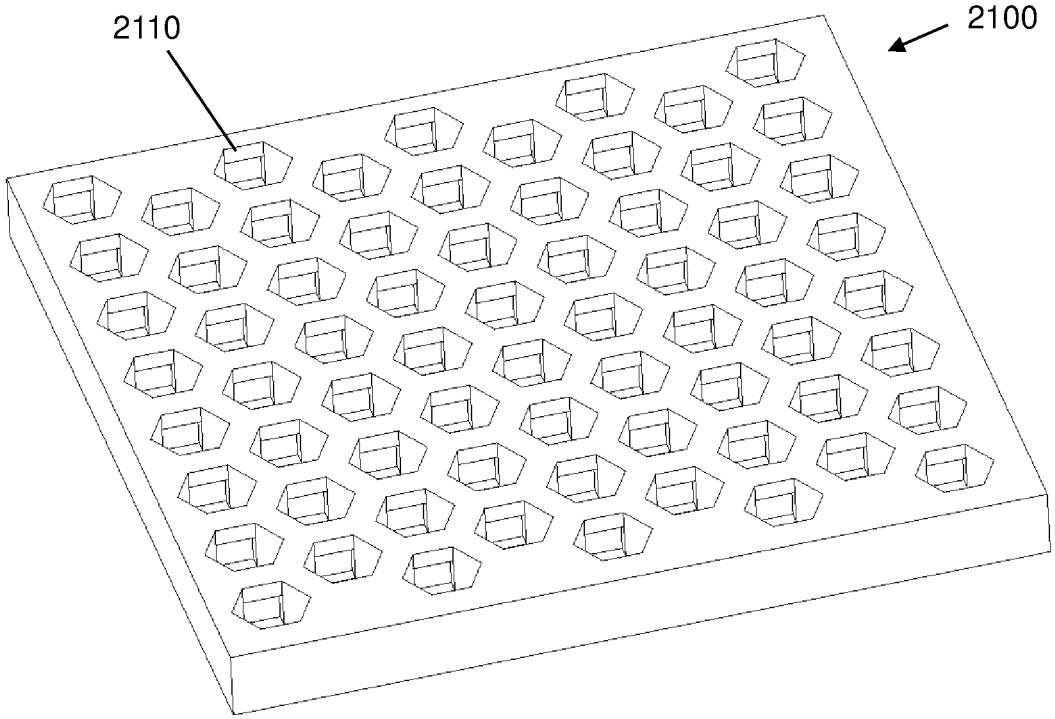
FIG. 21A is a perspective view of a divider plate with hexagonal apertures.
Figure 21B:
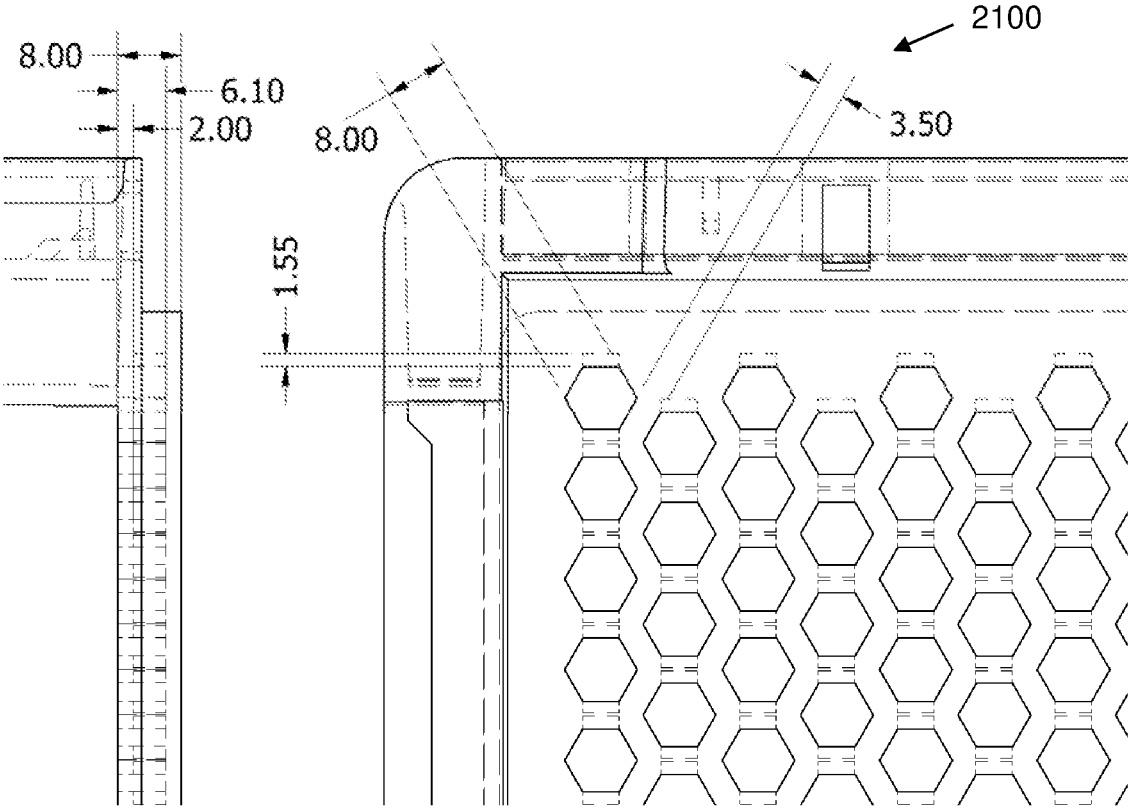
FIG. 21B is a general assembly drawing of a divider plate with hexagonal apertures.

FIGS. 20A-20B show one embodiment of a divider plate 2000 integral with a container 2001. The array of hexagonal apertures 2010 into which the hexagonal base of the dividers may be received allow for very tight configurations, with a high degree of flexibility to form two dimensional shapes, to accommodate goods and many different shapes and sizes. FIGS. 21A-21B show another divider plate 2100 with hexagonal apertures 2110.

It will be noted that the heads, bases and stems of the described dividers may project beyond the apertures 2010 as shown in FIG. 20A. In this way, by constructing a wall of dividers into adjacent apertures of the base, the formed barrier may have no gaps. This is particularly so for the dividers 1200 of FIG. 12, having buffer strips 1210 extending from the stem.

In one embodiment, the heads of the dividers may be hexagonal, each head having 6 load bearing faces as shown in FIGS. 33, 34 and 35A-35D. In another embodiment, the heads of the dividers may be circular as shown in FIG. 51A. The relationship between spacing of the base apertures and the divider heads may be such that when a plurality of dividers are placed adjacent to each other in adjacent apertures, the heads form a close packed arrangement, with the load bearing faces of the divider heads coming into contact to form in the form of a layer. Through this close packed arrangement, this layer is capable of transferring load applied to the head of a divider from one end of the layer to the other, as shown in FIGS. 27-32. In this embodiment, the goods being transported to tightly fit within a plurality of close packed dividers. Any lateral movement of the goods through movement of the container is therefore prevented through load transfer of the layer of close packed divider heads.

It will be appreciated that, although the apertures shown in some of said are hexagonal in shape, any shape other than circular may be useful, so as to prevent rotation of the dividers. To this end, square apertures may also be useful. The divider base similarly may be of a variety of shapes.

It will be appreciated further that, to achieve a close packed arrangement, any uniform shape that tessellates may be sufficient, including a square. Thus, in a further embodiment, square divider heads that tessellate in a close packed arrangement may also be used. This arrangement increases packing efficiency.

The dividers may further be linked so as to work together as a single barrier. In this orientation, the stiffness of the barrier wall may be relevant rather than the stiffness of the individual dividers.

Further, the goods may be encapsulated by several layers of dividers, rather than individual dividers, or a single layer of dividers. Thus, the required stiffness for any goods being transported become "designable"; in that additional stiffness can be readily provided by adding extra layers.

FIGS. 20A-20B, 21A-21B, 27-30, 31A-31B, 59 show various examples of divider plates having arrays of tightly arranged apertures, forming the template into which the dividers are inserted. The apertures allow for the dividers to form the multitude of shapes, as well as filler dividers between goods for tight packing and load transfer.

Figure 27:
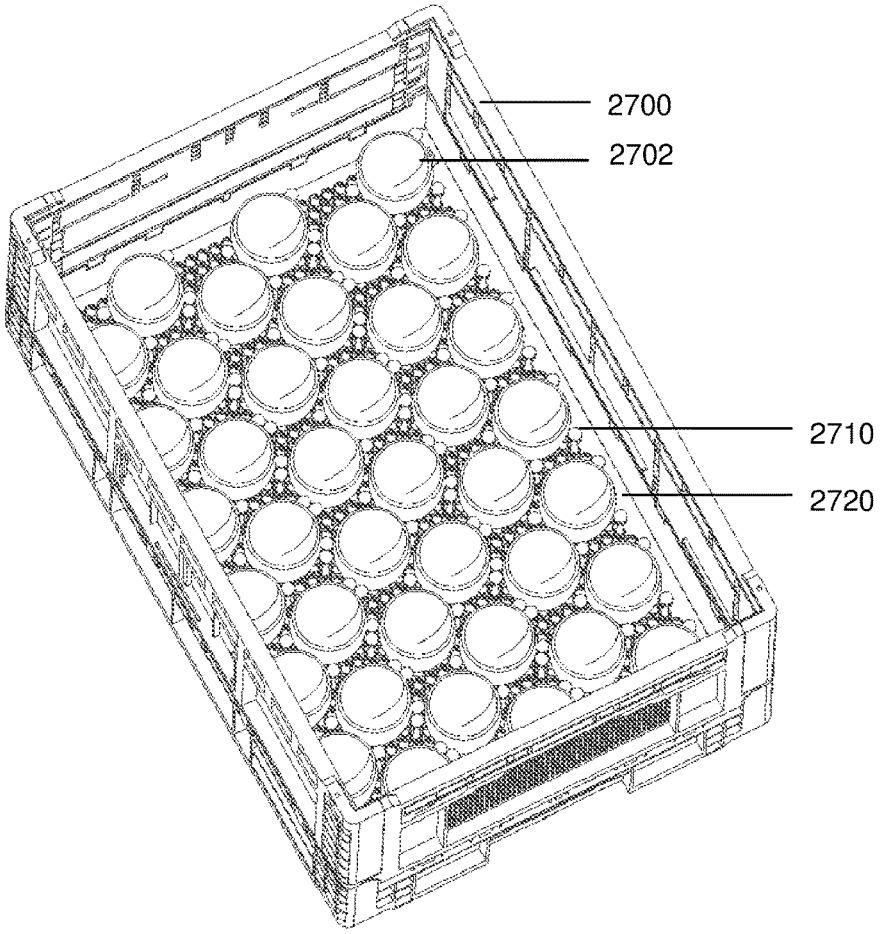
FIGS. 27, 29 and 31A are perspective view of cups and dividers in a container.
Figure 28:
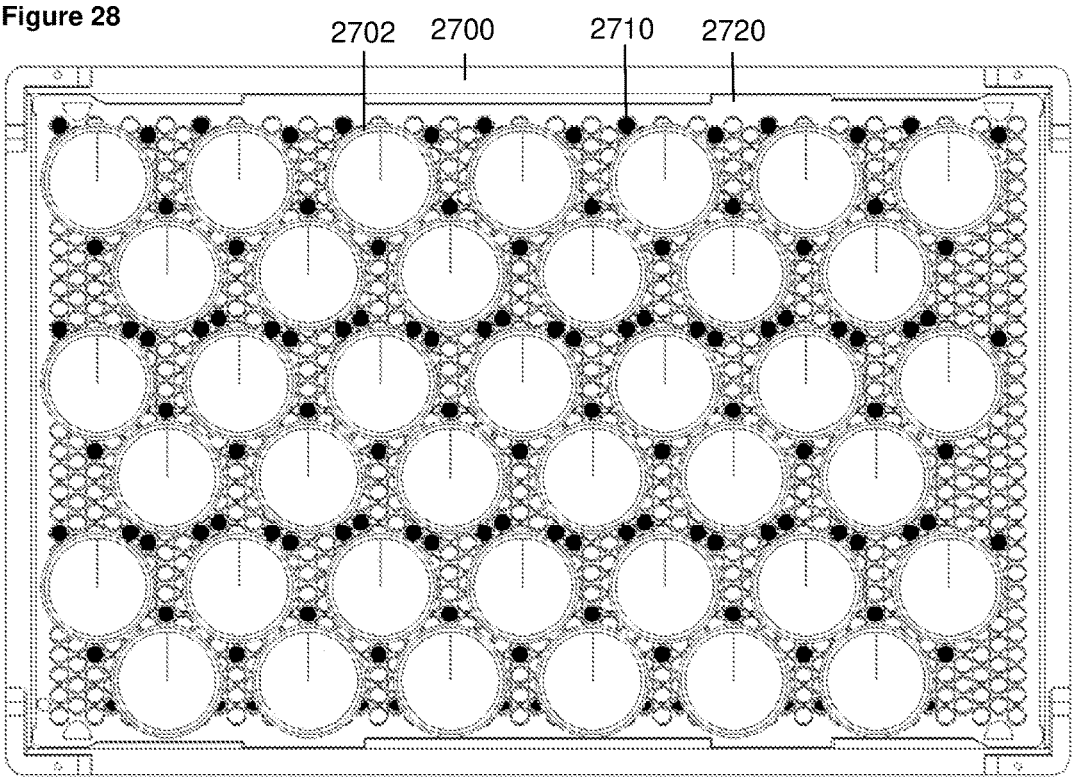
FIGS. 28, 30 and 31B are top views of cups and dividers in a container.

FIGS. 27 and 28 show an arrangement for packing cups. Each cup 2702 is held in place on the divider plate 2720 by at least 3 dividers 2710. The divider plate 2720 is fitted into the bottom of a container 2700. The dividers 2710 are shown as black dots in FIG. 28 to contrast with the apertures of the divider plate 2720. This arrangement spaces the dividers 2710 across the divider plate and holds the cups in place without adding significant weight to the package.

Figure 29:
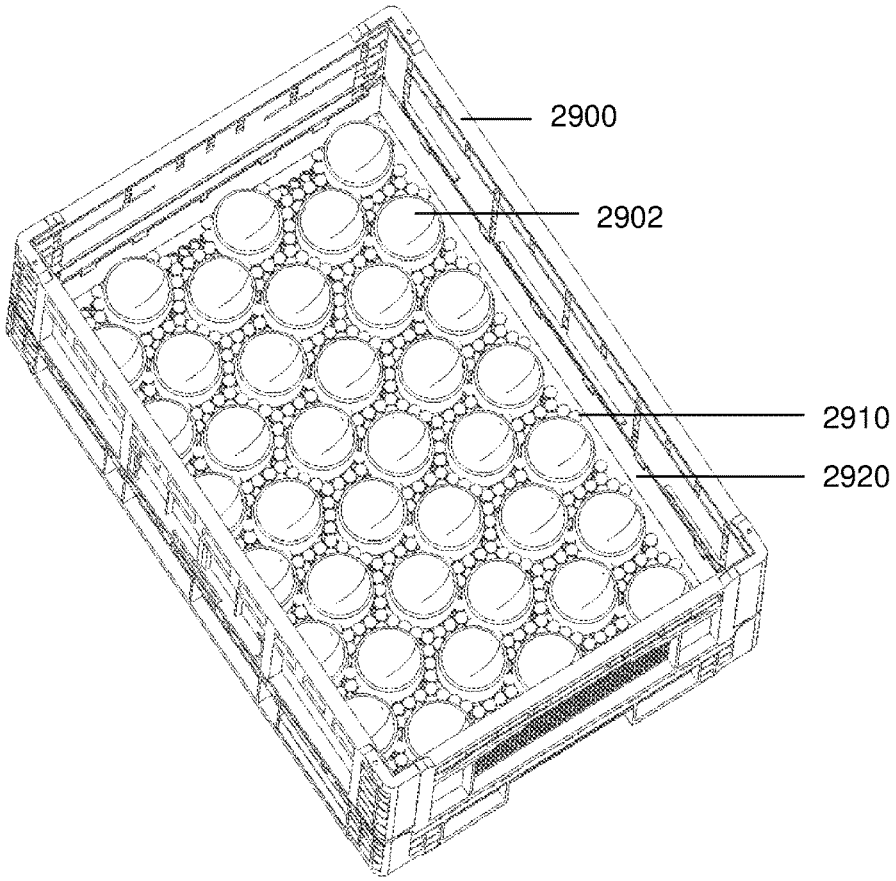
Figure 30:
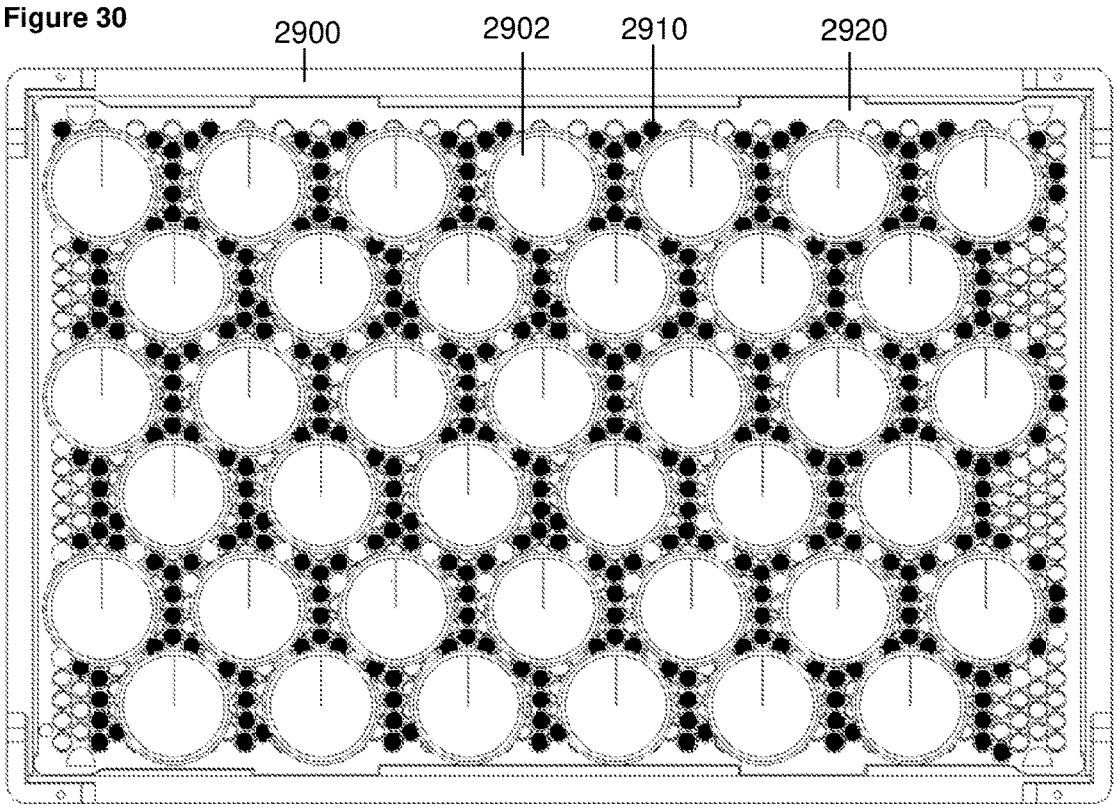

FIGS. 29 and 30 show a denser arrangement for packing cups. Each cup 2902 is surrounded by at least 12 dividers 2910 on a divider plate 2920 in a container 2900.

Adjacent dividers 2910 can transfer and distribute forces quickly across the divider plate 2920. The higher number of dividers provides more cushioning effect and greater resistance against transverse forces when transporting heavier parts. For example, 3 to 4 layers of dividers may be used.

Figure 31A:
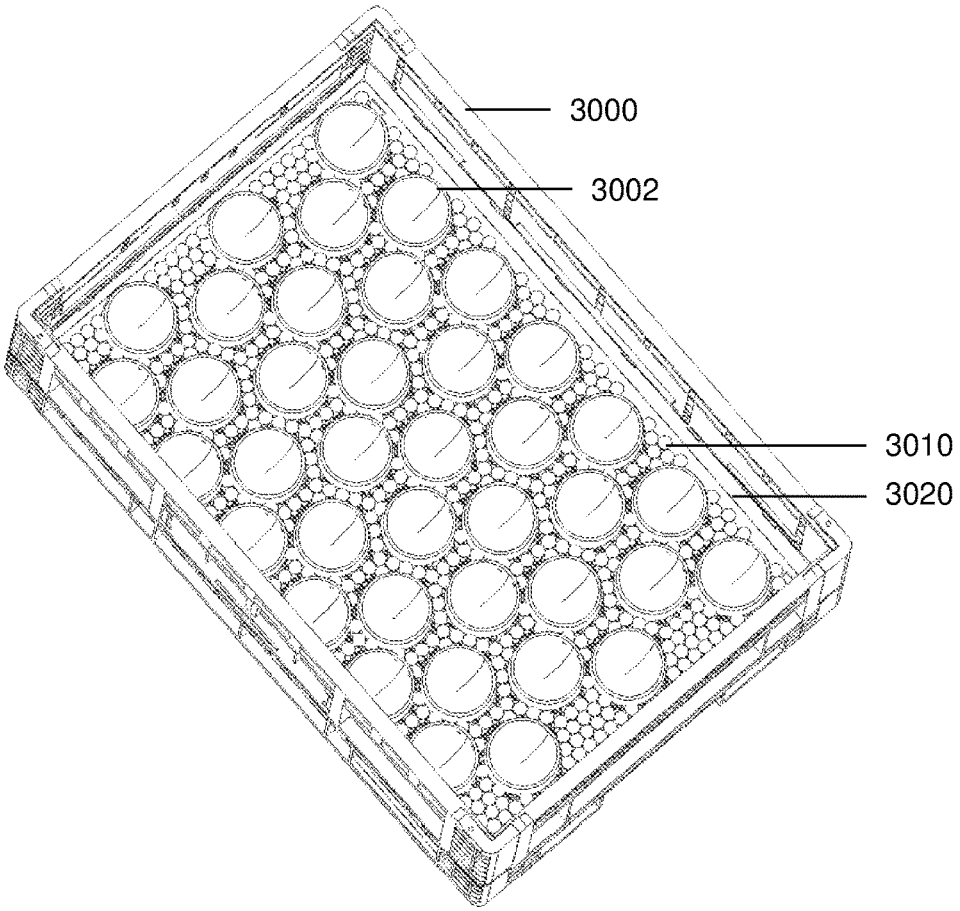
Figure 31B:
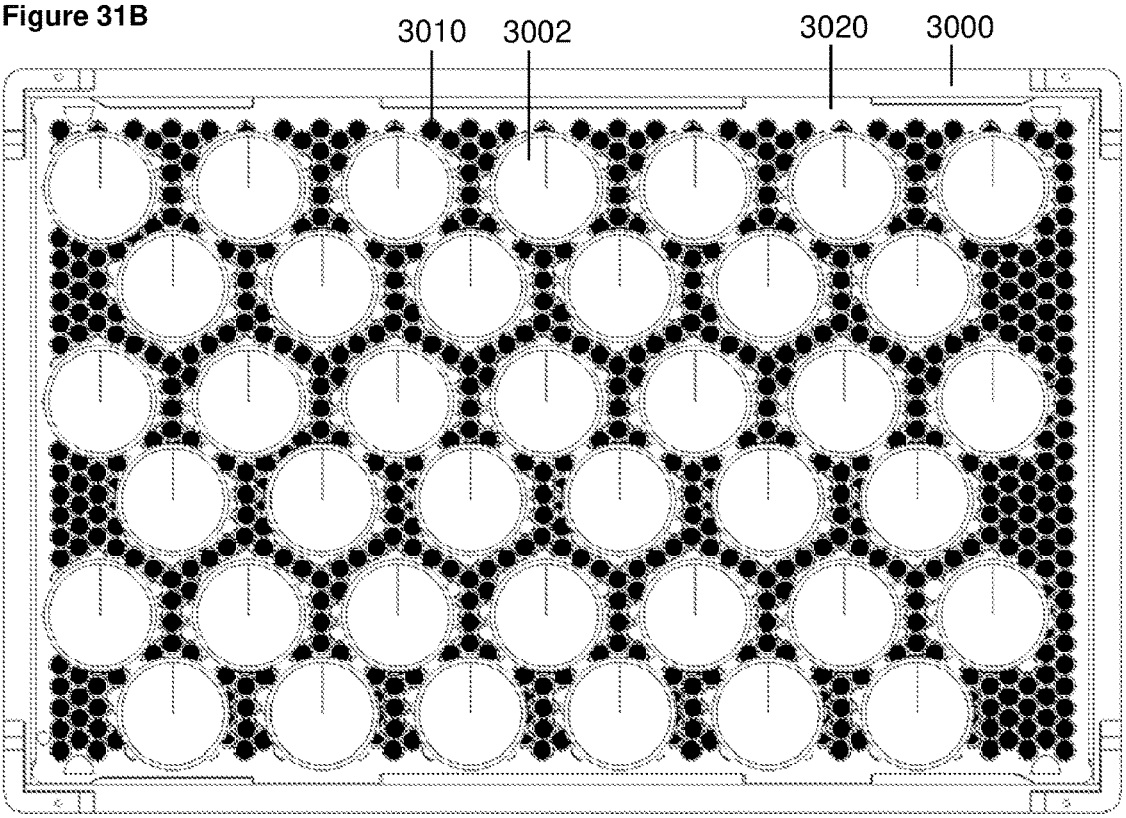

FIGS. 31A and 31B show a yet denser arrangement for packing cups. Dividers 3010 are inserted into any aperture not covered by cups 3002 on the divider plate 3020. Dividers 3010 also line up along the walls of the container 3000. The dividers 3010 form densely-packed rows on some sections of the divider plate. This arrangement provides even more cushioning for the cups 3002 because weight can be transferred by the dividers 3010 across the divider plate 3020 to the walls of the container 3000.

Further, bases tend to be flat for receiving goods in an unprotected condition. To save weight and avoid a heavy plate-like base, these flat bases are relatively thin and so must include ribbing beneath the bases to provide strength for flexure and impact. For the divider plates of the present invention, because apertures have been provided, these act like the ribbing in an inverted arrangement. Therefore, whilst ribbed bases are complex in shape, by comparison the present invention avoids the effectively wasted ribbing material and complexity, by providing a shaped base that is highly functional.

Figure 32A:
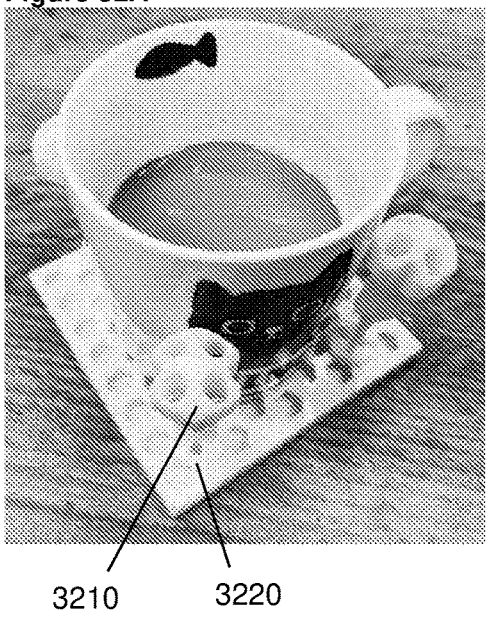
FIGS. 32A and 32B are photographs of dividers and an object on a divider sub-plate.
Figure 32B:
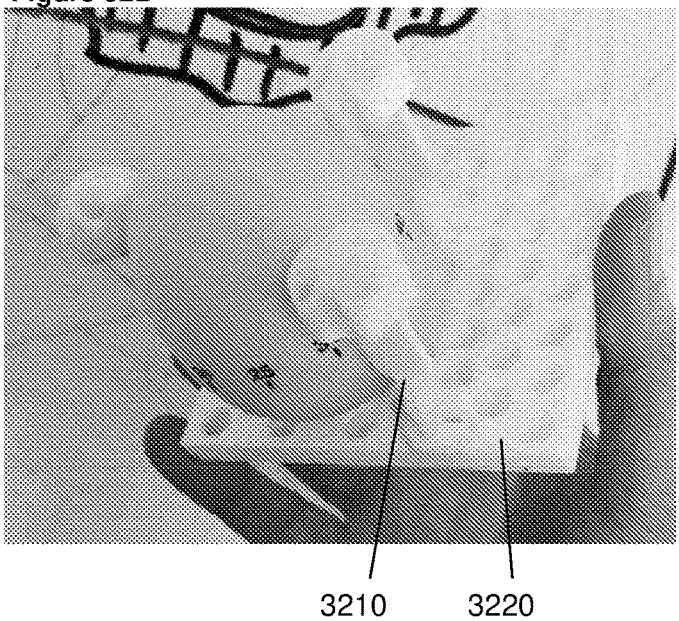
Figure 33:
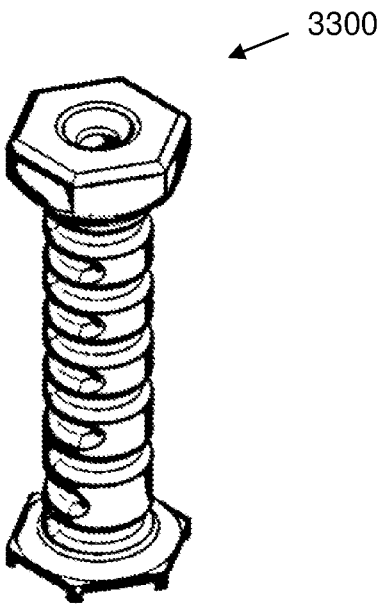
FIG. 33 is a perspective view of a divider.
Figure 34:
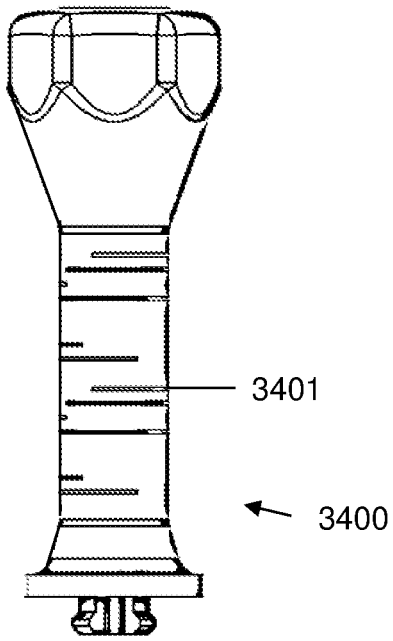
FIGS. 34 and 35A-35D are side views of dividers.

In a further embodiment, FIGS. 32A-32B show further extensions of the modularity of the invention. With the previous embodiments, modularity is provided by the dividers 3210 and the many shapes they can form in a complete unitary divider plate 3220. FIGS. 32A-32B show the base 3220 can also be modular, in that the divider plates of FIGS. 32A-32B are portions of the larger plate. By providing this plate portion to a manufacturer, the manufactured goods may be placed directly into the divider plate, having pre-inserted dividers. The package of plate portion and article enclosed within the dividers can then be inserted directly into a container, together with a plurality of other packed articles. The further embodiment, allows for the divider plate to be brought to the goods, rather than the goods brought to the container. By providing thousands of these divider plates, with pre-inserted dividers to a manufacturer, the packing process may be still further automated.

It will be appreciated that a still further advantage of the divider plate embodiment may be to provide padding, such as a padded divider plate and/or soft dividers, in the case of the article being fragile. Thus, rather than the additional risk of damage during packing, by placing the article into the divider plate at the end of the manufacturing process, the packing procedure may be done with the article already protected within the padded divider plate and/or soft dividers.

FIGS. 60A-60B, 61-62, 63A-63B, 64A-64B, 65A-65B show the adaptability of the invention, whereby the divider plate (either a unitary divider plate or an assembly of sub-divider plates) may be used in a variety of containers having different wall or partition arrangements. The invention, in its various aspects, is therefore not limited to a particular type of container, but may be applicable to many situations.

Figures 35A, 35B, 35C, 35D:
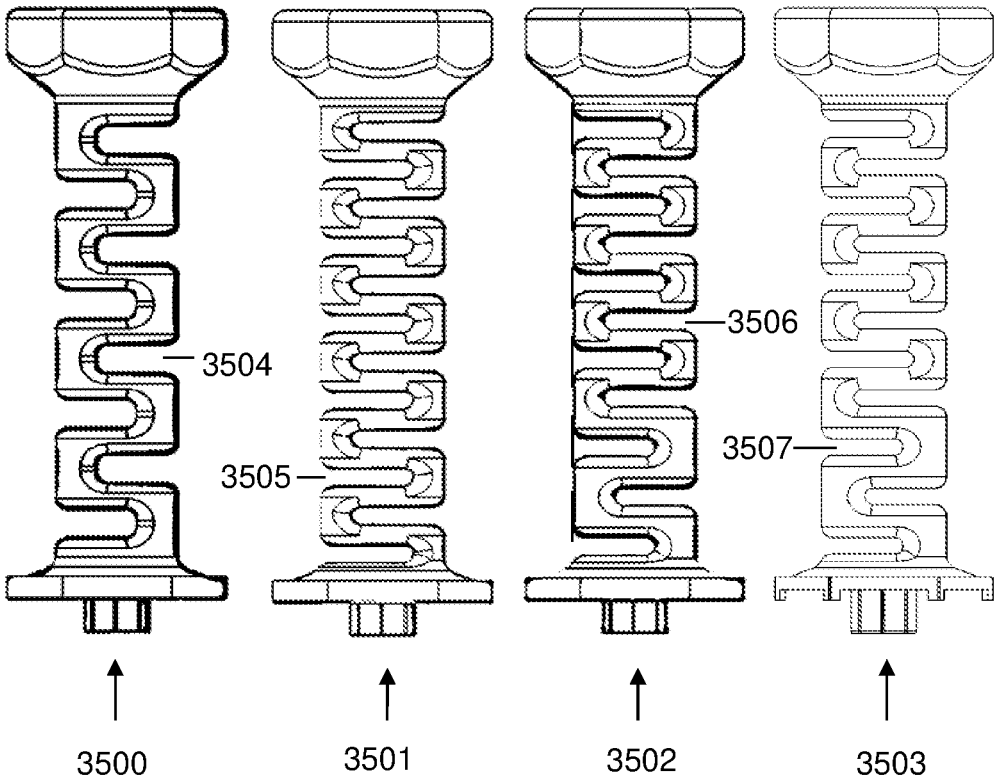
Figure 36A:
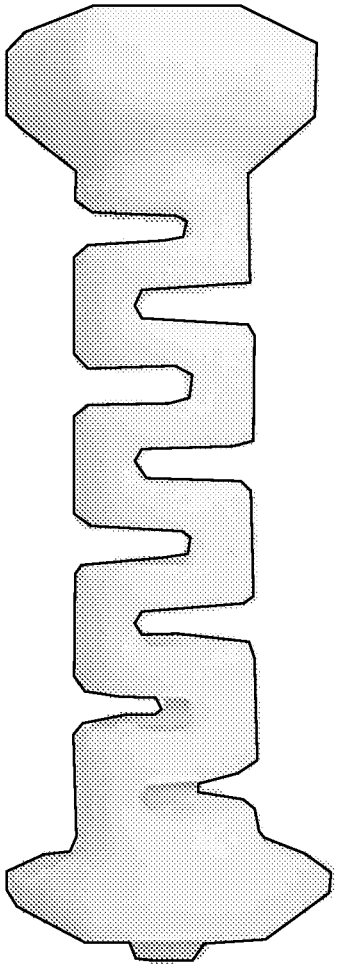
FIGS. 36A and 36B are photographs of a divider.
Figure 36B:
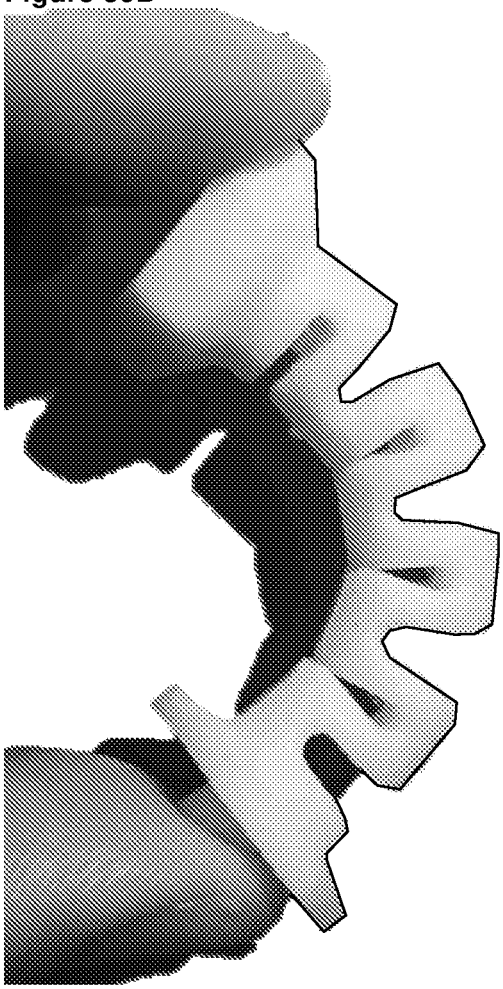

FIGS. 33, 34, 35A-35D, 36A-36B, 3738, 43A-43F show embodiments of the dividers 3300, 3400, 3500-3503, 3600-3601, 3700, 3800, 4300. The inherent flexibility of each individual divider may be provided through a combination of material selection, as well as a hinge effect which may be achieved using any one or a combination of the following:

(i) a slit cylindrical rod 3401, such as that shown in the FIG. 35A;

(ii) a generally cylindrical shape having selective necking to provide a hinge at a required location;

(iii) an accordion shaped throat 3504-3507 as shown in four out of five of the dividers FIGS. 35A-35D"

It will be appreciated that the accordion or concertina shaped throat may be of uniform thickness for the full height of the divider. Alternatively, as each repeating cycle of the accordion shape acts as a curved beam thickening at the hinge portion of the divider may be beneficial in resisting fatigue.

In a further embodiment, the repeating cycles of the accordion shape may be of non-uniform thickness. For instance, near the base the accordion shaped throat may be thicker so as to provide greater flexural strength and thinner at the head of the divider to provide a softer buffer for the cargo. Thus, the accordion shape of the divider may have differential flexure being more rigid near the base and more flexible near the head.

Each divider may have a head and that head may be hexagonal or circular in plan. This may allow a close packed arrangement of the hexagonal divider thus providing a high density of the dividers on insertion in the divider plate. In this close packed arrangement there may be little or no gap between adjacent divider heads and thus on application of a transverse load, such as shifting of cargo, the dividers may act as a single stiff uniform element. If each individual divider is relatively flexible, they may provide a softening buffer for the goods. To increase the stiffness in the transverse direction the close packed arrangement of the dividers may allow selective stiffening of the dividers. This selective stiffening may be useful as a barrier layer of dividers around a group of transported goods.

Figure 40:
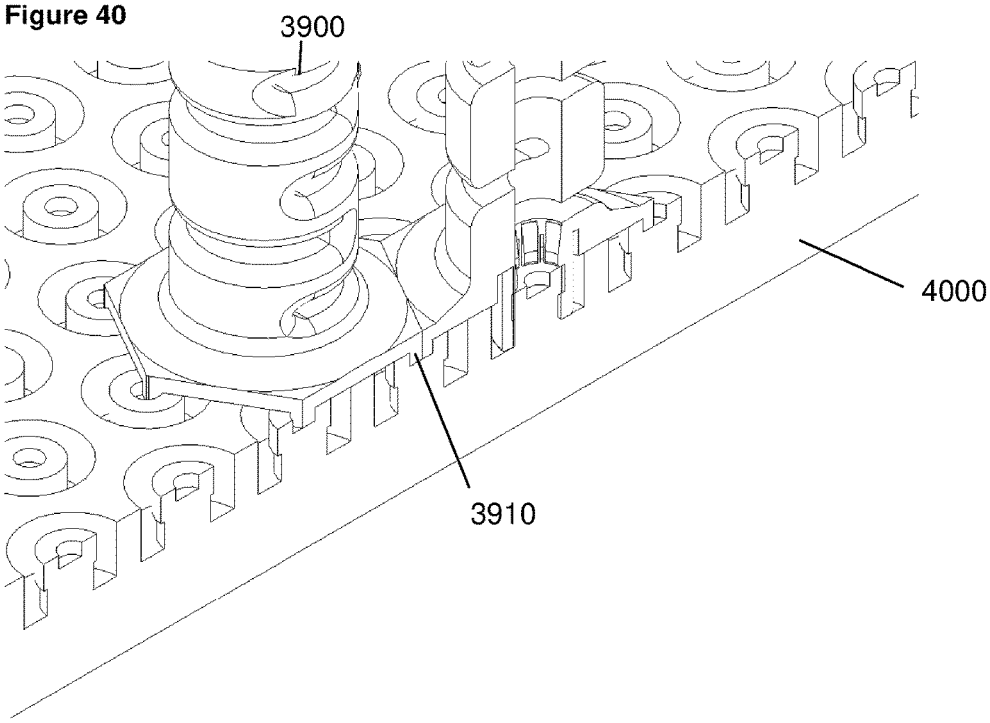
FIG. 40 is a magnified perspective view of 2 dividers inserted on a divider plate.

FIG. 39 show a magnified side view of the divider base 3900. The divider base 3900 contains a plurality of latches 3910 for attachment to a divider plate. FIG. 40 shows latches 3910 of dividers 3900 attached to a divider plate 4000.

The dividers may be arranged to act as a separator, by placing several dividers at specific locations to form groups. These groups of dividers may be placed in a range of shapes to match the shape, and number, of goods being transported. By forming groups into any types of shapes and sizes, these can take the shape of the product and placed in areas surrounding the product. Thus the dividers as described herein demonstrate packing flexibility and modularity.

A height of said dividers may be in the range of 25-50 mm. Alternatively, they may be in the range 50-75 mm. Other appropriate heights may also be applicable.

Figure 41:
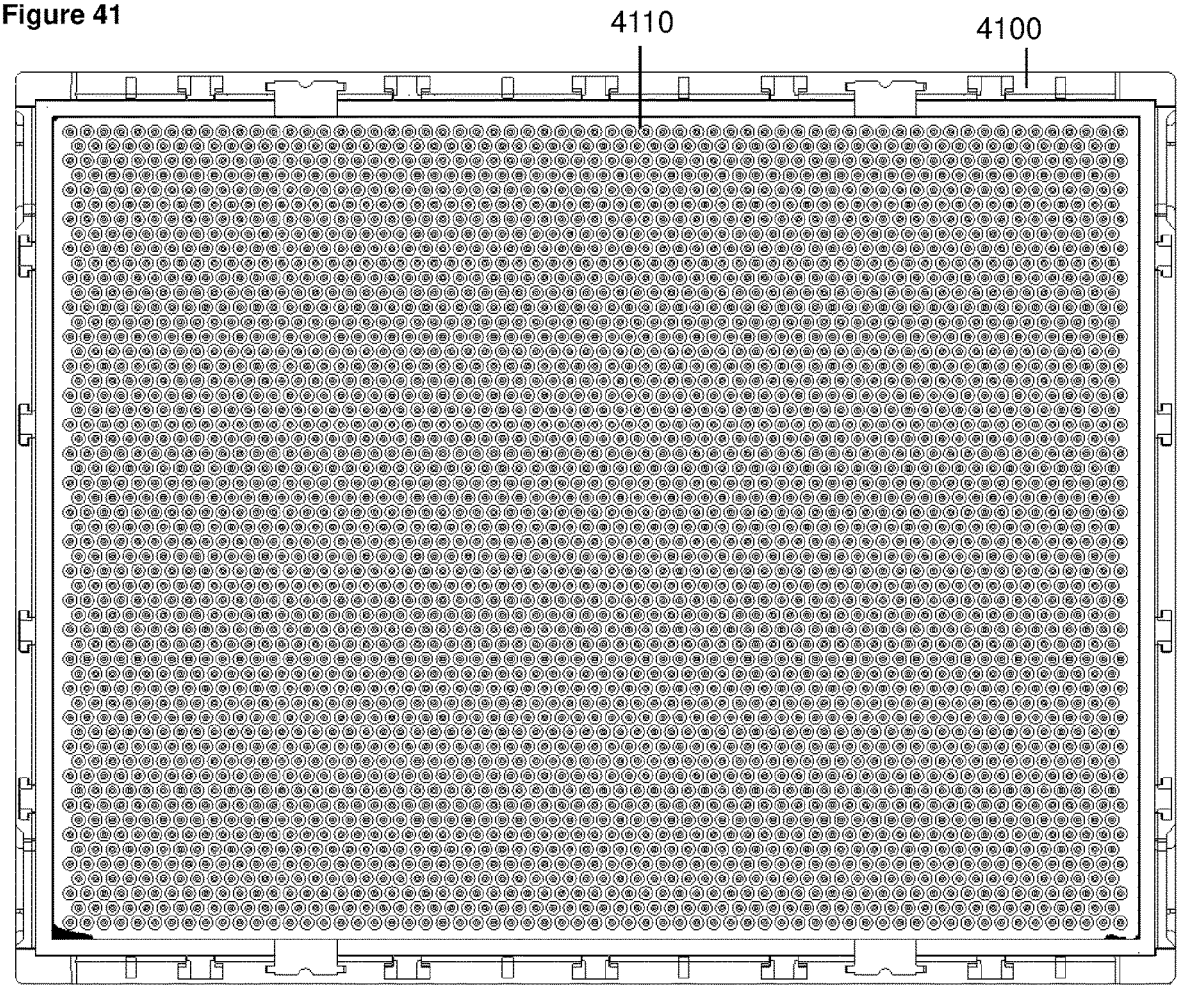
FIG. 41 is a top view of a divider plate integral with a container.
Figure 42:
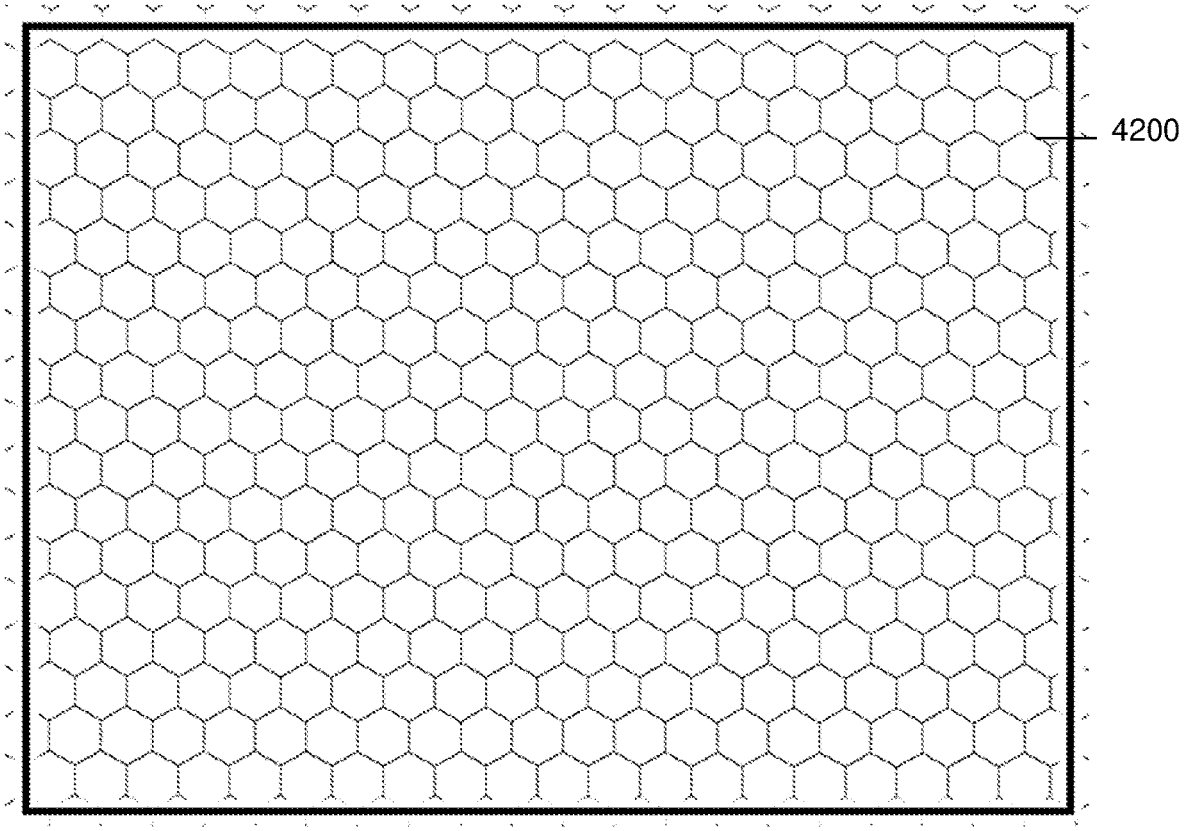
FIG. 42 is a schematic diagram of apertures arranged on a divider plate.
Figure 43A:
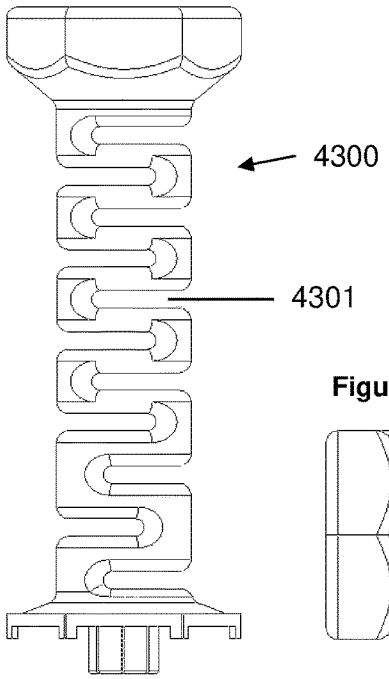
FIGS. 43A and 43B are side views of a divider.
Figure 43B:
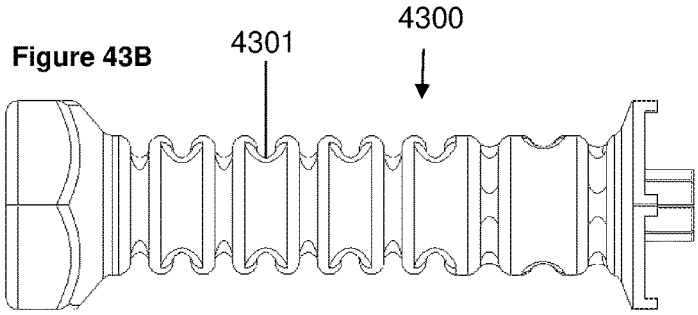
Figure 43C:
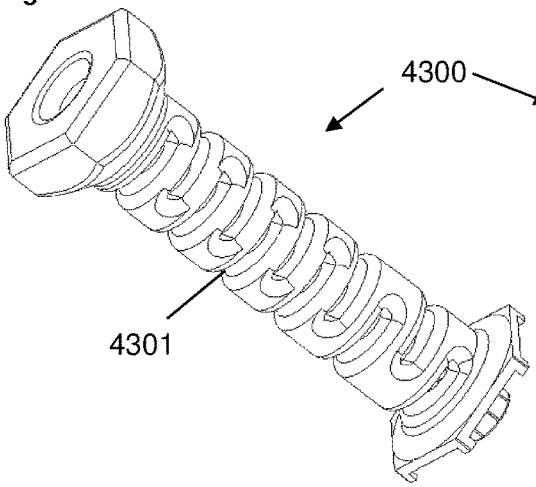
FIGS. 43C and 43D are perspective views of the divider of FIGS. 43A-43B.
Figure 43D:
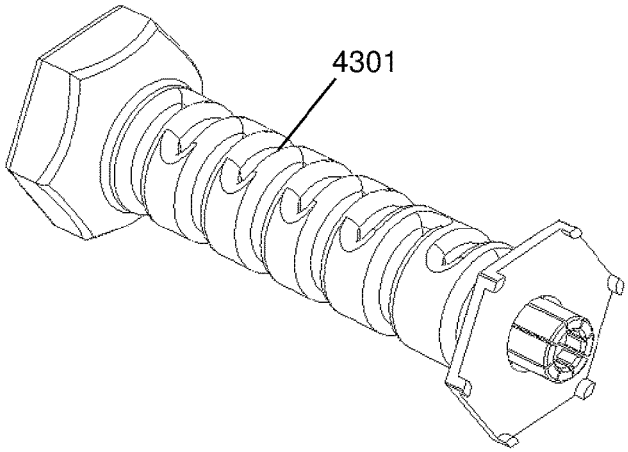
Figure 43E:
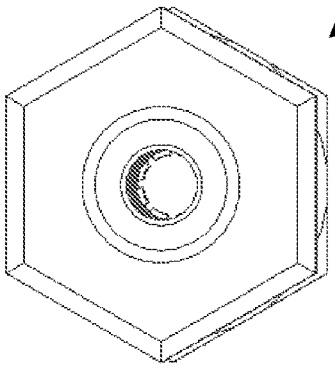
FIG. 43E is a top view of the divider of FIGS. 43A-43D.
Figure 43F:
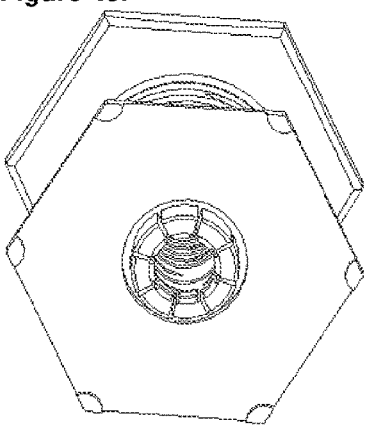
FIG. 43F is a bottom view of the divider of FIGS. 43A-43E.

FIG. 41 shows a divider plate 4100 with recesses 4110 for attaching dividers. The "overlapping" grids provide a highly modular system. FIG. 42 shows an alternate design of the grid 4200. High packing density is achieved through optimizing the gap size and using a hexagonal shape.

Figure 44:
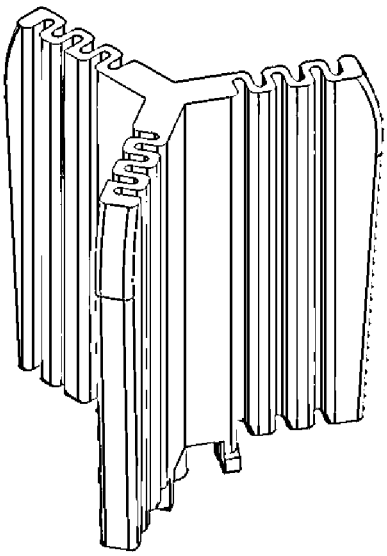
FIG. 44 is a perspective view of a divider.
Figure 45:
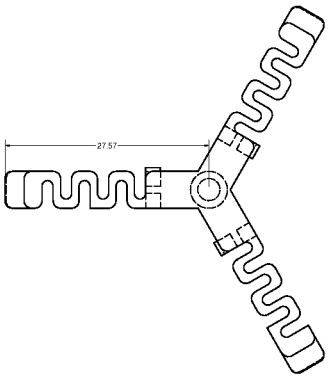
FIG. 45 is a top view of the divider of FIG. 44.
Figure 46:
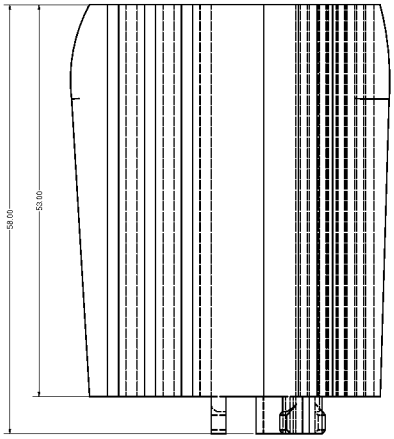
FIG. 46 is a side view of the divider of FIGS. 44-45.
Figure 47A:
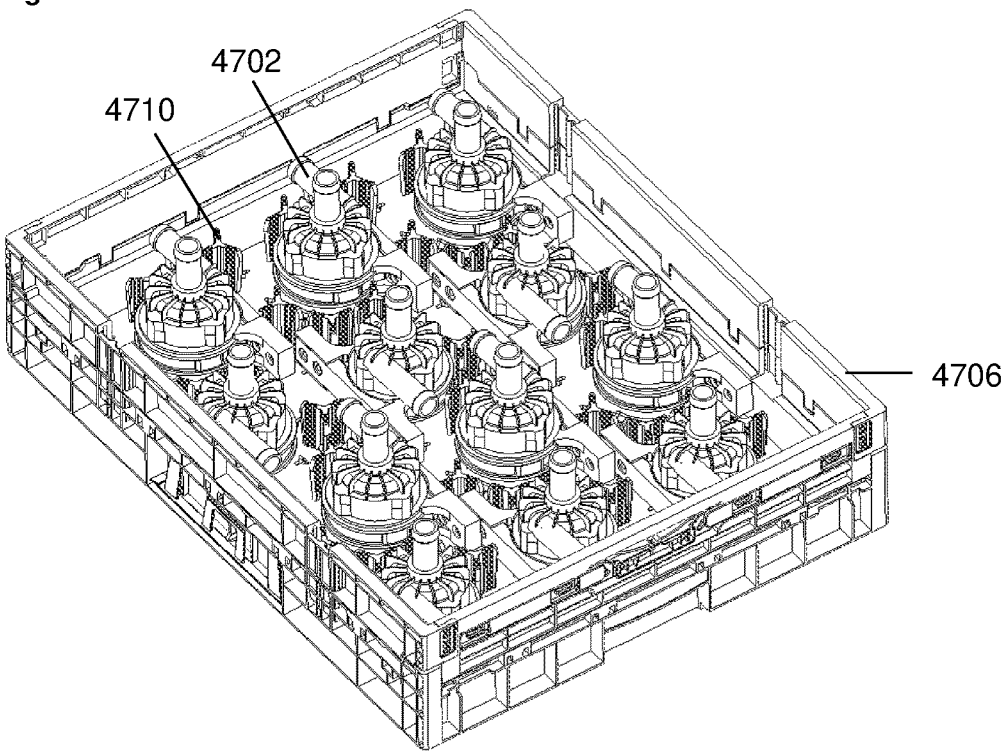
FIG. 47A is a perspective view of pumps and dividers in a container.
Figure 47B:
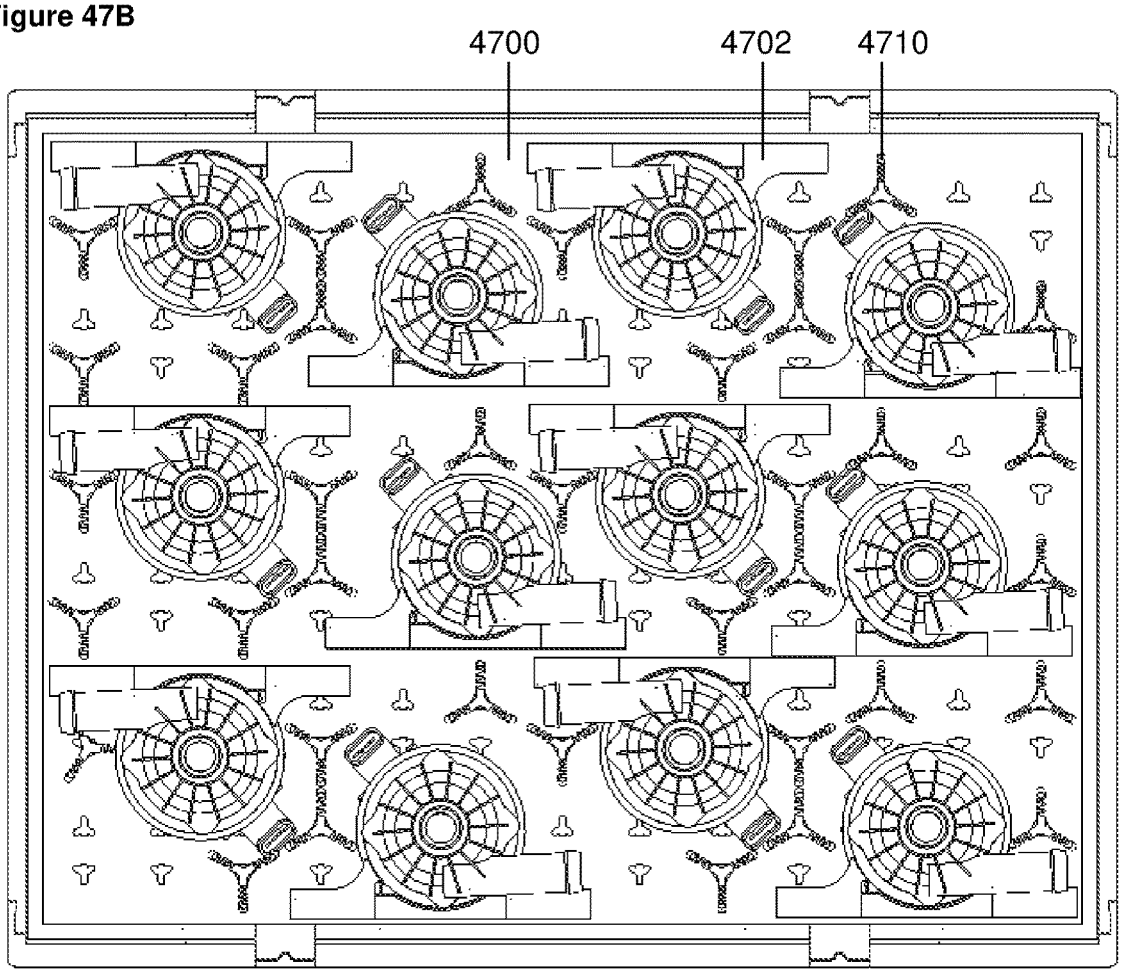
FIG. 47B is a top view of pumps and dividers on a divider plate in a container.
Figure 48A:
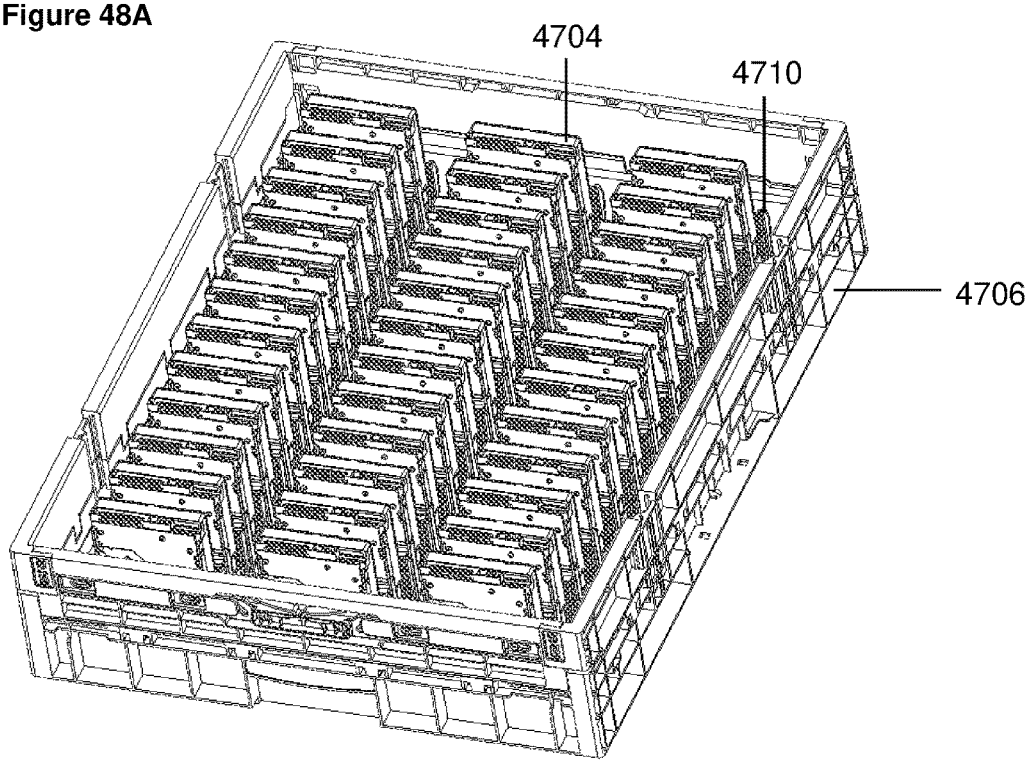
FIG. 48A is a perspective view of hard disks and dividers in a container.
Figure 48B:
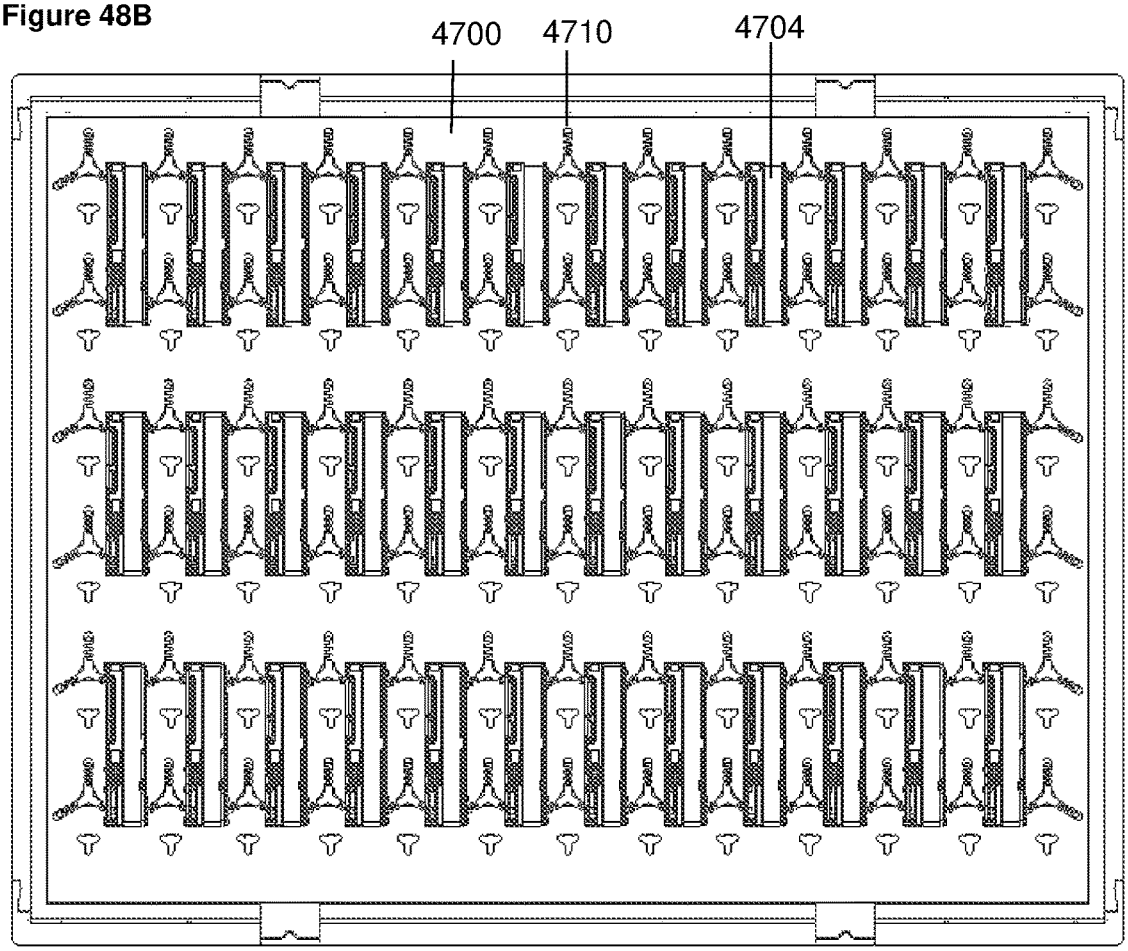
FIG. 48B is a top view of hard disks and dividers on a divider plate in a container.
Figure 49A:
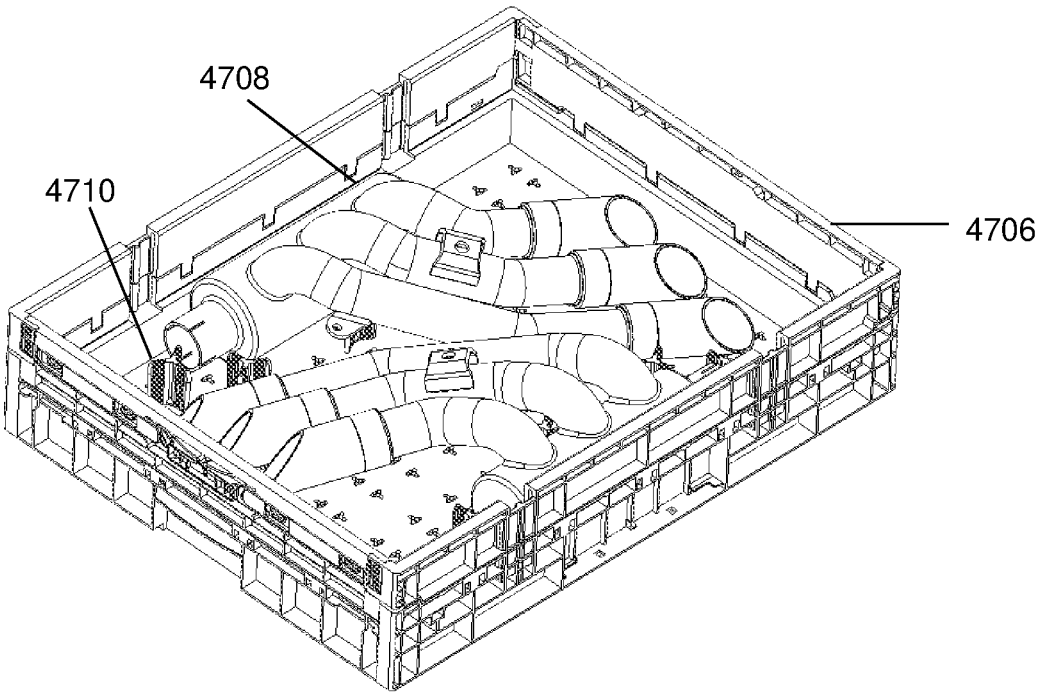
FIG. 49A is a perspective view of mufflers and dividers in a container.
Figure 49B:
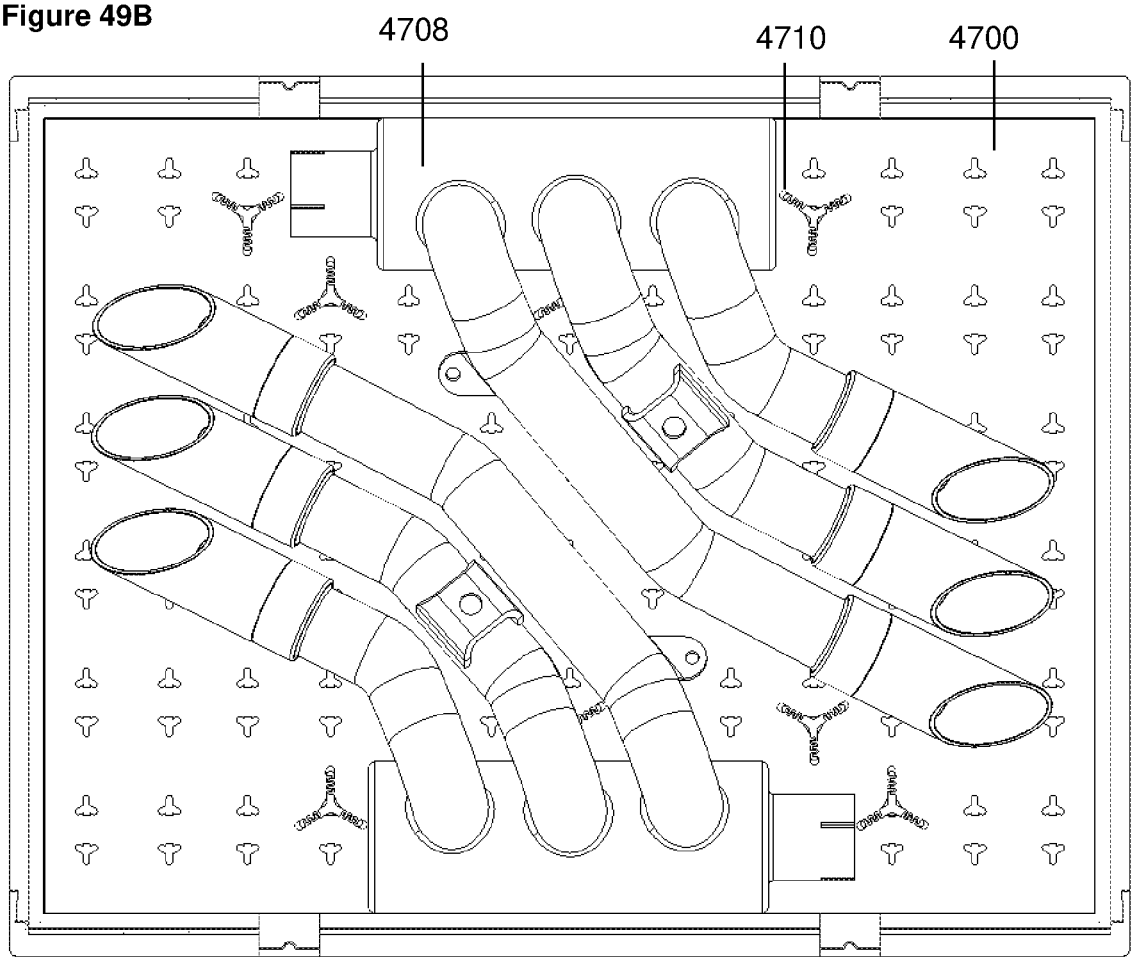
FIG. 49B is a top view of mufflers and dividers on a divider plate in a container.

In a further embodiment the divider may be isotoxal in shape such as a concave hexagon. In essence, in plan, this has the appearance of a 3-point star (4400 in FIGS. 44-46). It will be appreciated that a 4-point star such as a concave octagon may also be a useful shape as a divider.

FIGS. 47A-47B, 48A-48B, 49A-49B and 50 show arrangements on a divider plate 4700 using dividers 4710 to hold pumps 4702, hard disks 4704, mufflers 4708, or cups 4709 in a container 4706.

Further still, a divider having a substantially cylindrical throat may also be useful either separately or in combination with more flexible dividers such as the divider having an accordion shaped throat. Thus, in combination the two types of dividers may be useful having the stiffer cylindrical divider on the perimeter and the more flexible accordion shaped throat dividing goods within the perimeter.

FIGS. 51A-51B show a further example of a bayonet fit divider 5100. The divider 5100 has a spherical head 5102, an elongate throat 5103, and a base 5104. The divider base 5104 contains a depressible "smart" tab 5110 and a rigid "dumb" tab 5120. The elongate throat allows the dividers to bend slightly when a force 5130 is exerted on the divider. This enables it to take multi-directional forces and weight transfer among dividers and thus cushions any impact to the objects. This may also hold the goods tightly so as to limit movement. FIG. 51C is an exaggerated diagram showing the deflection of the divider 5100 when a force 5130 is exerted on it.

Figure 52A:
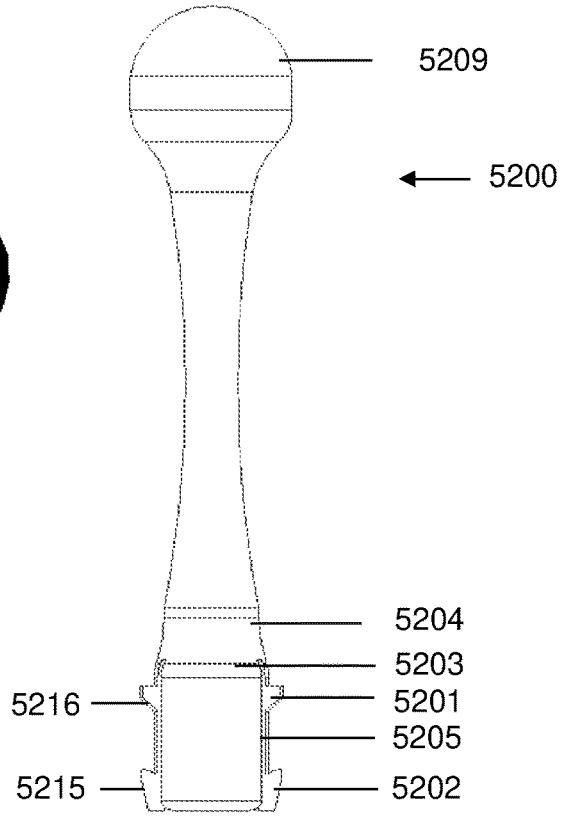
FIG. 52A is a side view of a divider.
Figure 52B:
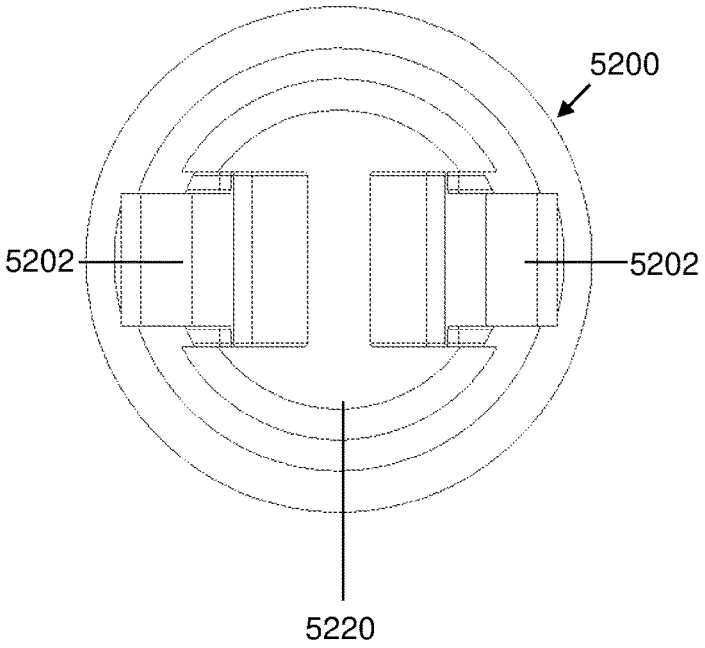
FIG. 52B is a bottom view of the divider of FIG. 52A.
Figure 52C:
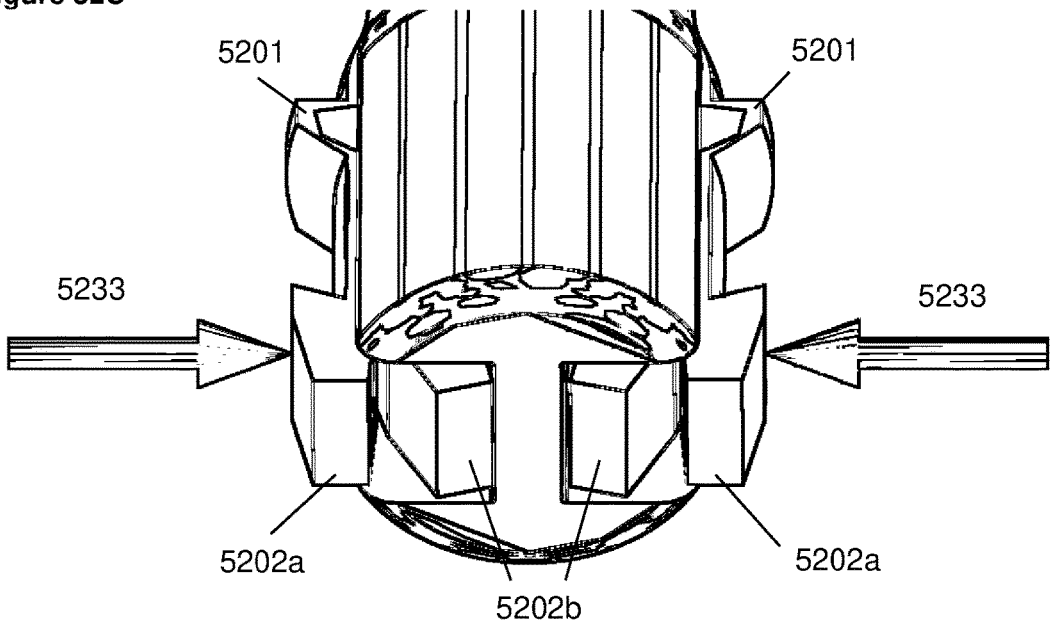
FIG. 52C is a perspective view of forces exerted on the tabs of the divider of FIGS. 52A-52B.
Figure 52D:
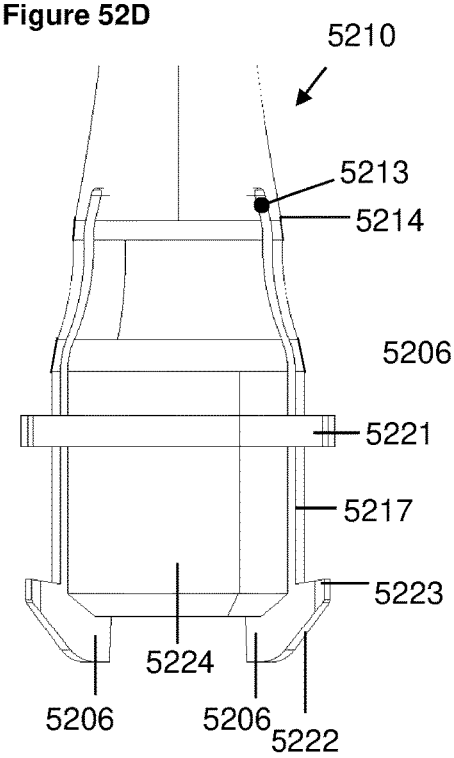
FIG. 52D is a side view of a divider.
Figure 52E:
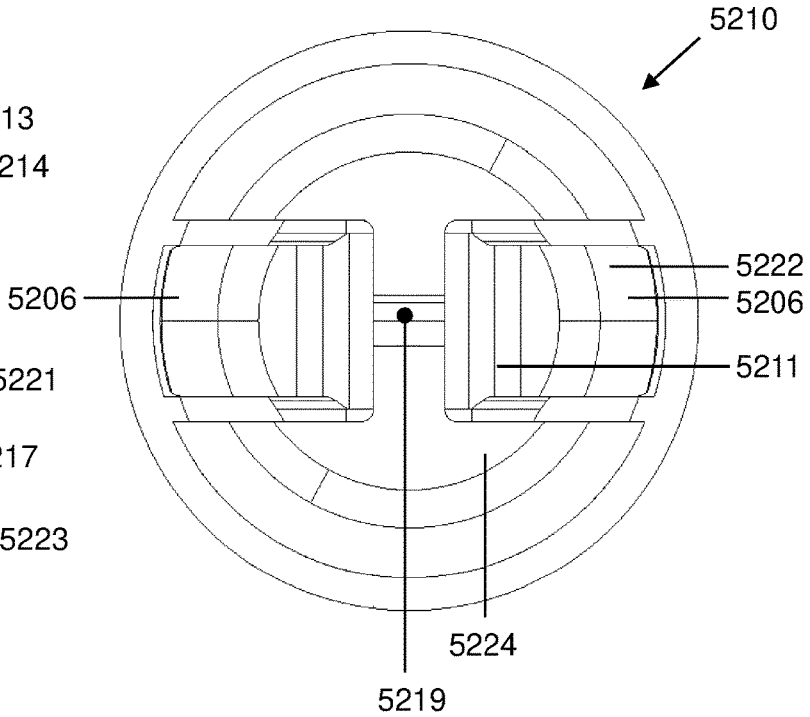
FIG. 52E is a bottom view of the divider of FIG. 52D.
Figure 52F:
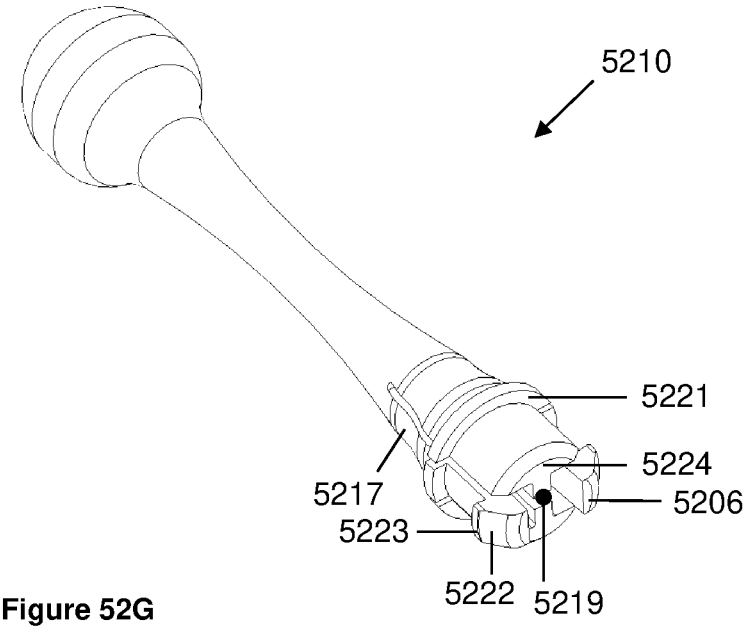
FIG. 52F is a perspective view of the divider of FIGS. 52D-52E.

FIGS. 52A-52C show another embodiment of a divider 5200 with a head 5209 and divider base 5204. A divider base 5204 contains a pair of legs 5205 connected to a trunk 5203. A depressible tab 5202 with a chamfer 5215 is located at the end of each leg 5205. A wedge 5201 with a chamfer 5216 is located between the trunk 5203 and the tab 5202. When a force 5233 is applied to the tabs 5202 or wedges 5201, the tabs 5202 move inwards from an extended position 5202*a* to a squeezed position 5202*b* (FIG. 52C). The tabs 5202 and wedges 5201 are resiliently depressible.

Figure 54A:
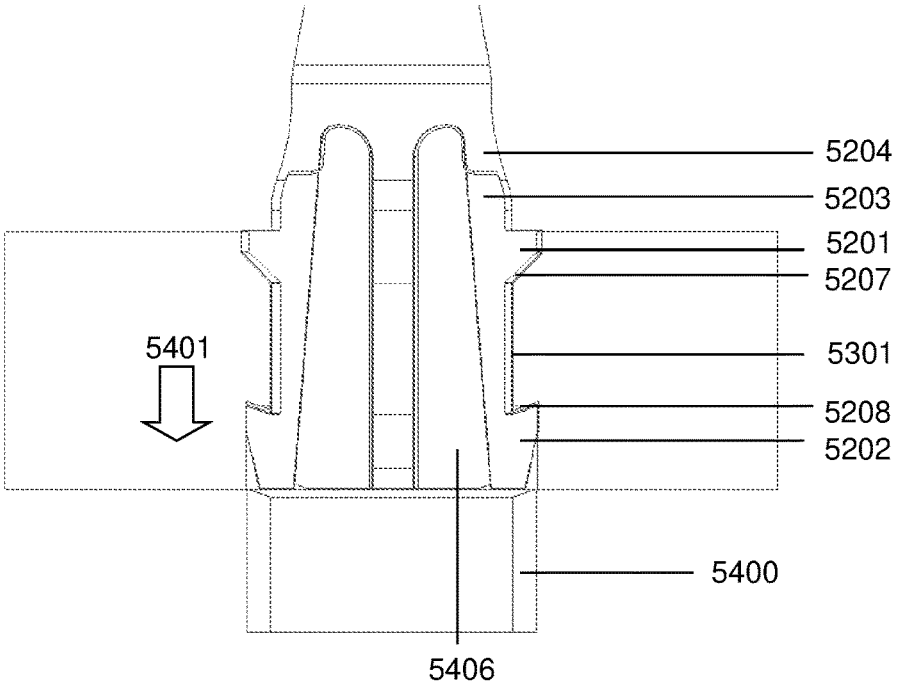
FIG. 54A is a cross-sectional view of an aperture of a divider plate with a divider and a divider removal device.
Figure 54B:
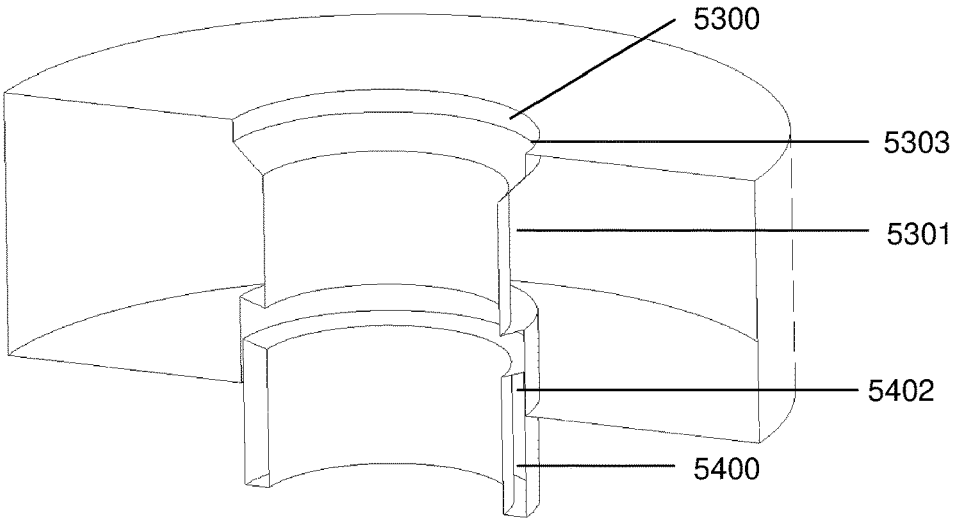
FIG. 54B is a perspective view of the aperture and divider removal device of FIG. 54A.
Figure 54C:
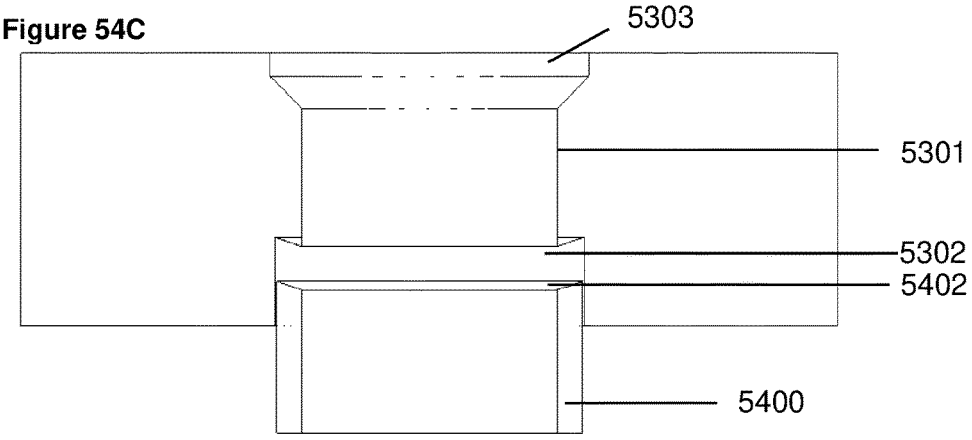
FIG. 54C is a side view of the aperture and divider removal device of FIG. 54B.
Figure 54D:
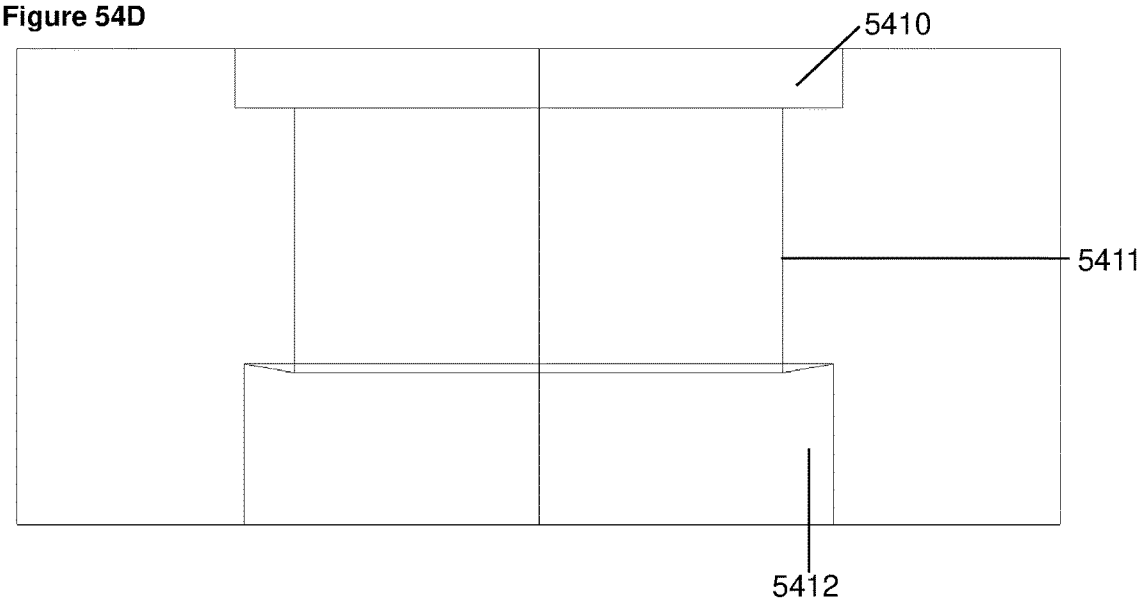
FIG. 54D is a cross-sectional view of an aperture of a divider plate.
Figure 54E:
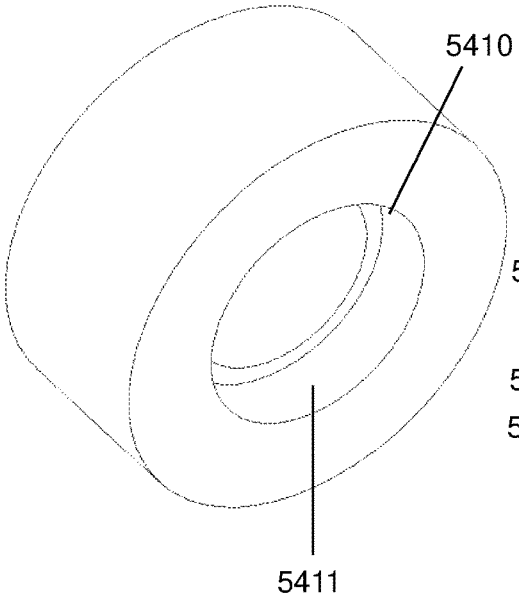
FIG. 54E is a perspective view of the aperture of FIG. 54D.

The dividers 5200 of FIGS. 52A-52C can fit into an aperture 5300 shown in FIGS. 53A-53B and 54A-54C. The aperture 5300 contains a neck 5301 that is narrower than the opening 5303. The divider 5200 is inserted into the aperture 5300 with a first push 5401 (FIG. 54A), and is removed with a second push in the same direction using a divider removal device 5400 (FIG. 54A-54C).

On the first push, the tabs 5202 are depressed inward by the neck 5301 from an extended position 5202*a* to a squeezed position 5202*b* (FIG. 52C). As the tabs 5202 move past the neck 5301 to a void 5302, the tabs 5202 push outwards from the squeezed position 5202*b* to the extended position 5202*a*. As a result, the wedges 5201 and tabs 5202 engage opposite ends 5207 and 5208 of the neck 5301, and the divider 5200 is locked in place. The internal construction of the divider 5200 may include a V-embodiment 5406 (FIG. 54A). The V-embodiment 5406 provides a longer lever arm for the tab 5202, so as to accommodate differential tolerances between the divider 5200 and the aperture 5300. The internal construction of the V-embodiment 5406 may vary depending on the force required.

On the second push, the wedges 5201 are pressed inward by the neck 5301. The tabs 5202 and wedges 5201 are both located on the leg 5205, so the inward force is transferred from the wedges 5201 to the tabs 5202 to squeeze the tabs 5202 from the extended position 5202*a* to the squeezed position 5202*b*. The tabs 5202 disengage from the neck 5301, and slide into an aperture 5402 of a divider removal device 5400 (FIGS. 54A-54C). The aperture 5402 retracts the tabs 5202 in the squeezed position 5202*b*. Once the tabs 5202*b* can pass through the neck, the divider 5200 can be removed.

Figure 55A:
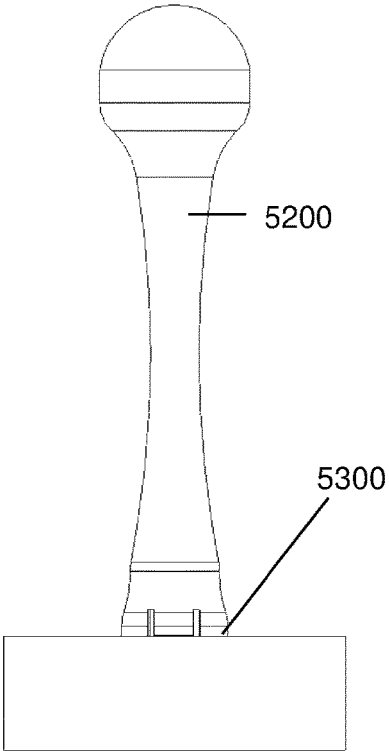
FIG. 55A is a side view of a divider inserted into an aperture of a part of a divider plate.
Figure 55B:
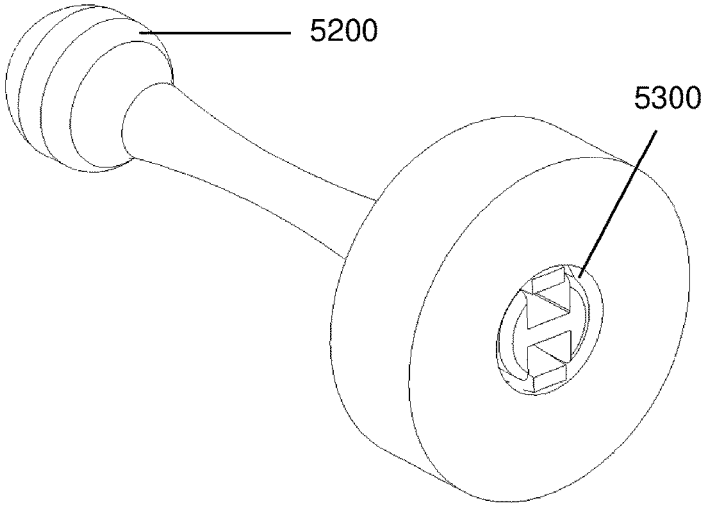
FIG. 55B is a perspective view of a divider inserted into an aperture of a part of a divider plate.

The divider 5200 inserted into the aperture 5300 is shown in other perspectives in FIGS. 55A and 55B.

Figure 52G:
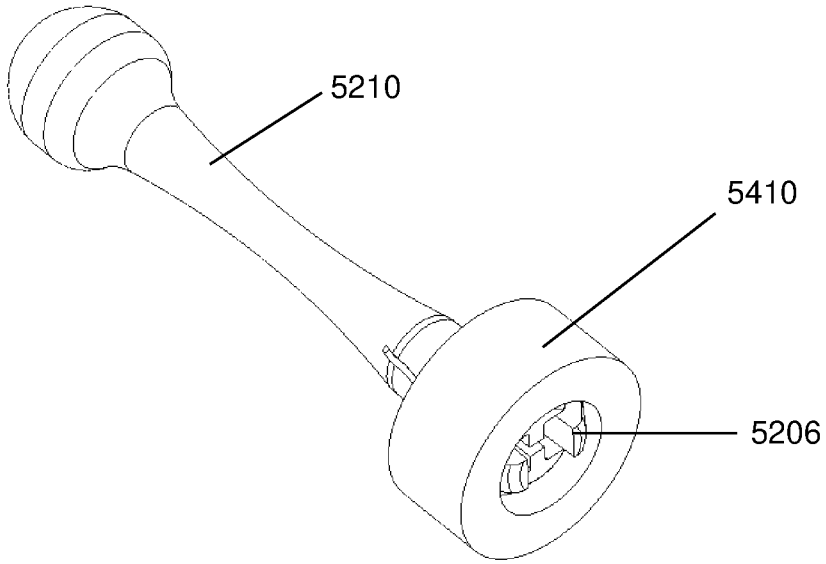
FIG. 52G is a perspective view of the divider of FIGS. 52D-52F inserted in an aperture.
Figure 53A:
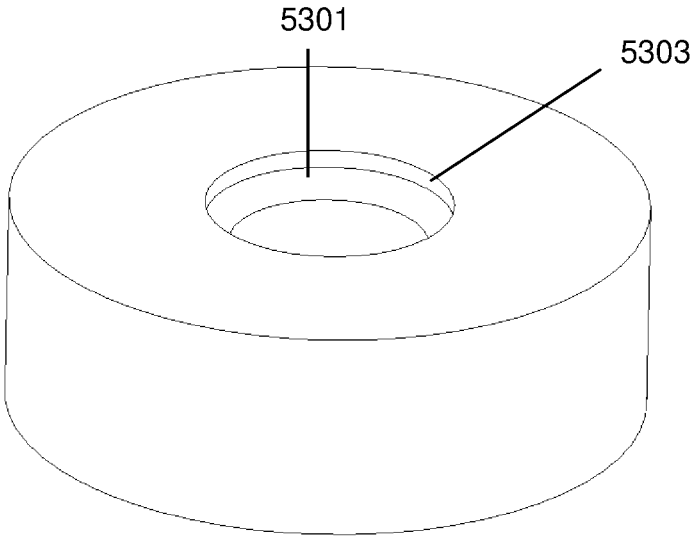
FIG. 53A is a perspective view of an aperture of a divider plate.
Figure 53B:
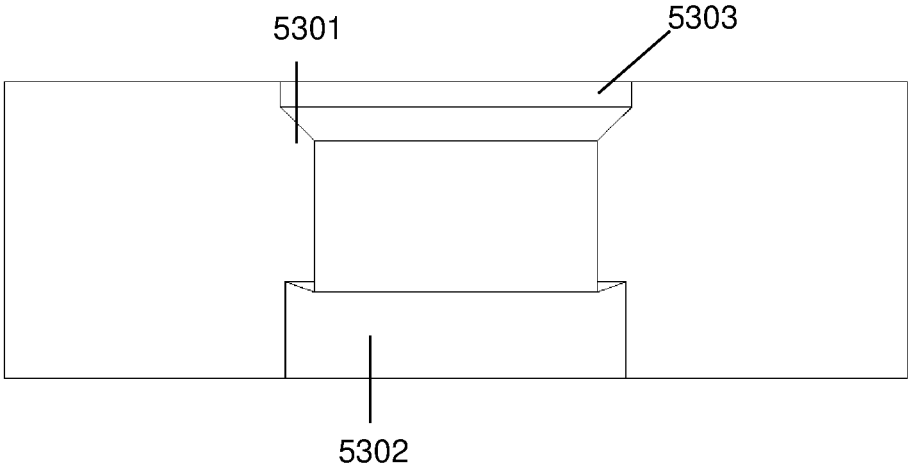
FIG. 53B is a cross-sectional view of the aperture of FIG. 53A.
Figure 54F:
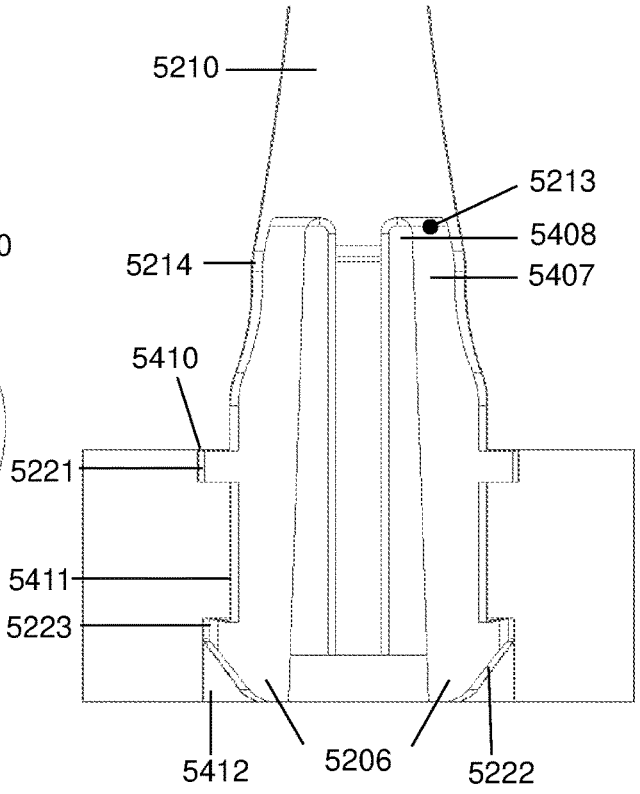
FIG. 54F is a cross-sectional view of the aperture of FIG. 54E with the divider of FIG. 52D.

FIGS. 52D-52G show an alternative embodiment of a snap fit divider 5210 having depressible fish-hook tabs 5206 on legs 5217 bifurcating from a higher split 5213 on the divider base 5214. The higher split 5213 reduces the force needed to squeeze the tabs 5206. There may be an expansion gap 5219 at the bottom to account for tolerance issues but the H-beam 5224 is still maintained. The legs 5207 have ridges 5221. Having no or minimal chamfer at the ridges 5221 provides strong resistance to transverse forces. The tabs 5206 have upwardly directed sharp edges 5223 and chamfer 5222. The divider 5210 can fit into an aperture 5410 having a neck 5411 (FIGS. 52G and 54F). The divider is locked in place when the tabs 5206 enter a void 5412 and move into an extended position. The internal construction of the divider 5210 may include a V-embodiment 5408. The angle of the lower chamfer 5222 is designed to be within the rotation radius of the tab 5206. The divider 5210 can be inserted by a single push into the aperture 5410. For removal, instead of pushing the divider 5210 down to depress the tabs 5206, the tabs 5206 are squeezed by a removal device (not shown) pushing it up from the bottom. A downward force may be used to protect the sharp edges 5223 from shearing off during removal. In a further embodiment, the removal device may have a peripheral chamfer directed in an opposed direction to the chamfer 5222 of the depressible tabs 5206, so as to engage and bias the depressible tabs 5206 inwards to the squeezed position. Specifically, the removal device chamfer may be radially directed inwards to correspond with the outward directed chamfer of the depressible tab chamfer.

Figure 56:
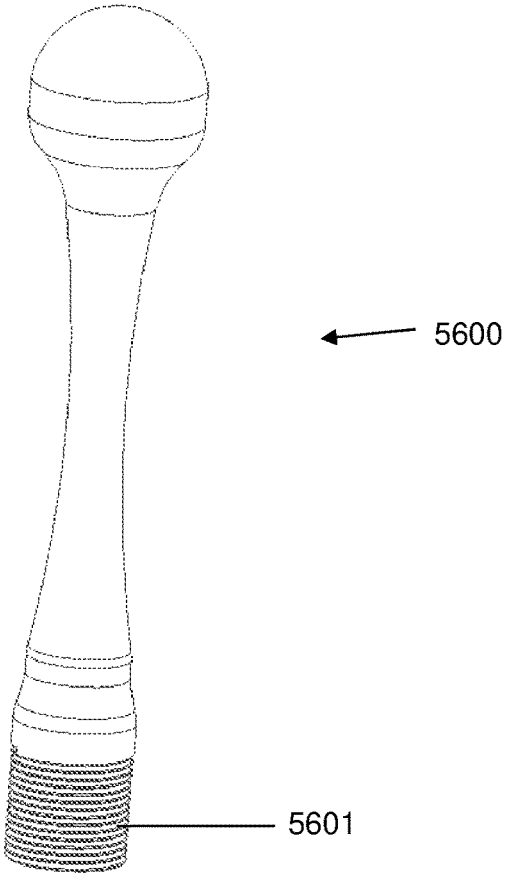
FIG. 56 is a side view of a divider with threaded base.
Figure 57A:
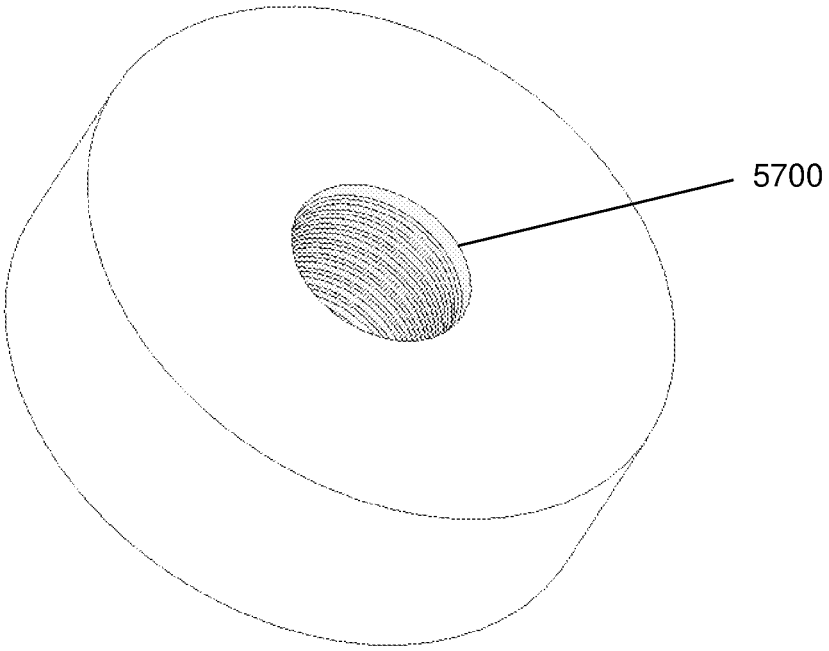
FIG. 57A is a perspective view of a threaded aperture on a part of a divider plate.
Figure 57B:
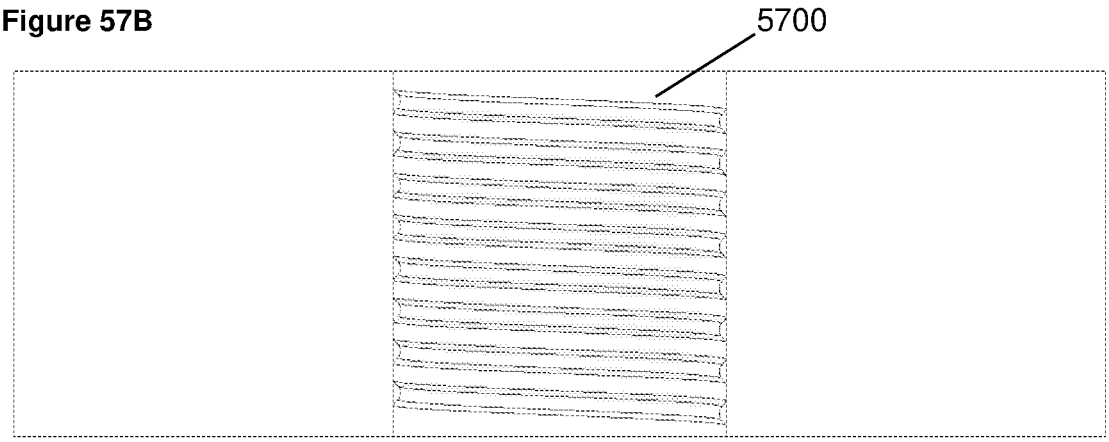
FIG. 57B is a cross-sectional view of a threaded aperture on a part of a divider plate.
Figure 58A:
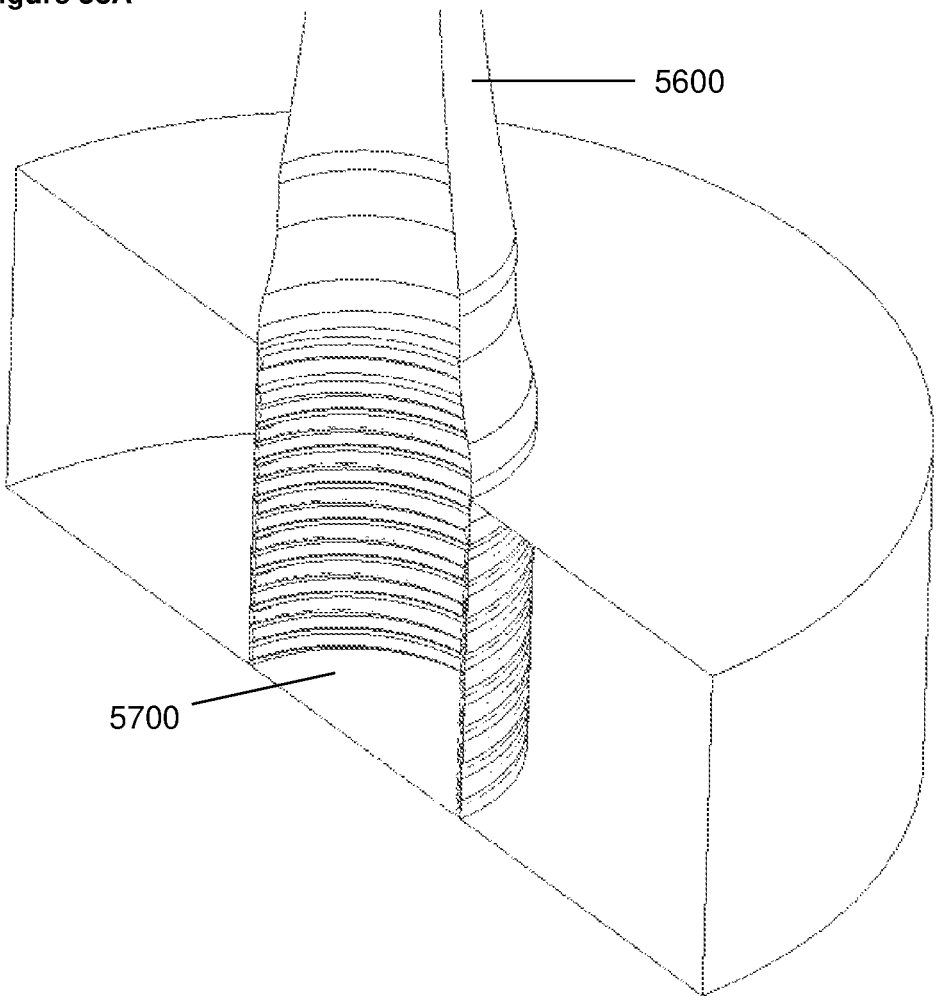
FIG. 58A is a magnified isometric cross-sectional view of a threaded divider inserted into a threaded aperture.
Figure 58B:
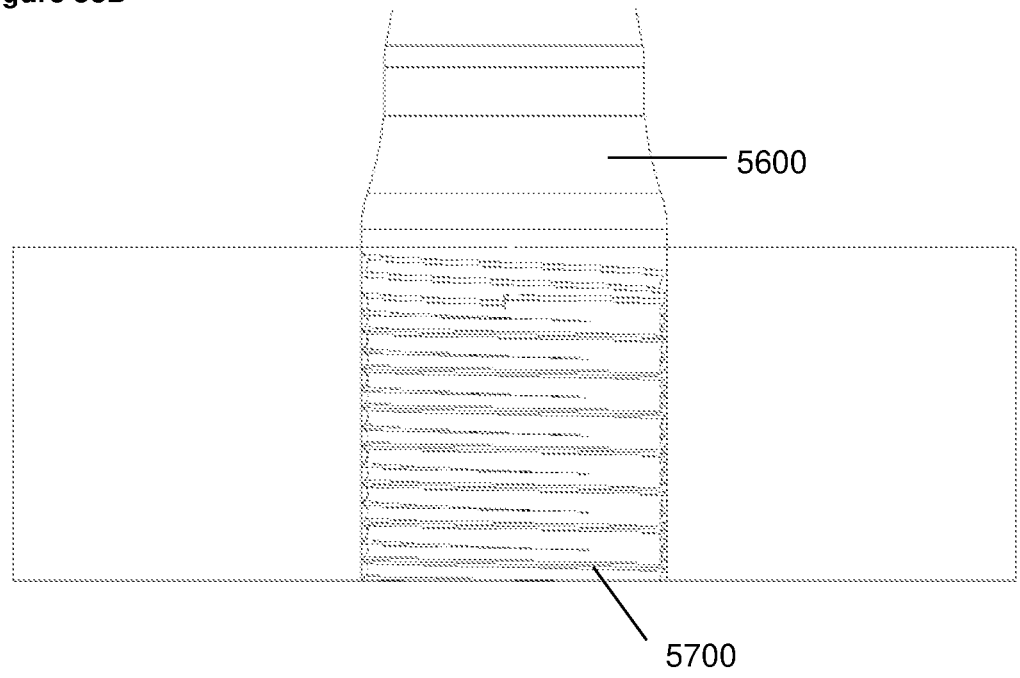
FIG. 58B is a magnified cross-sectional view of the threaded divider inserted into the threaded aperture.
Figure 58C:
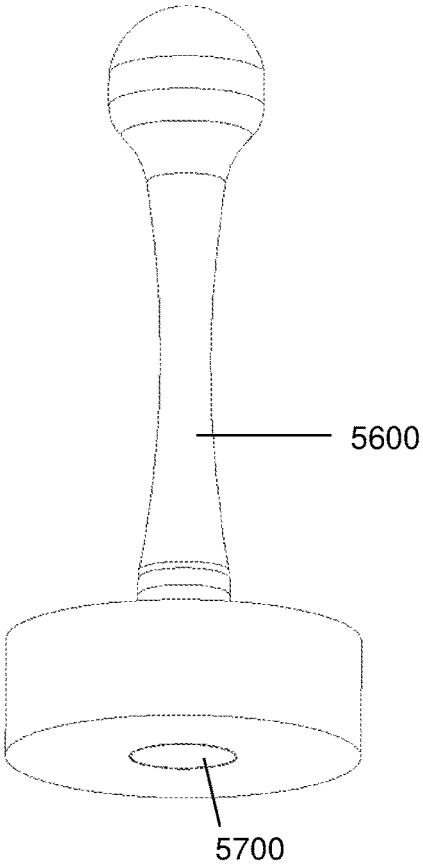
FIG. 58C is a perspective view of a threaded divider inserted into the threaded aperture.

FIG. 56 shows another embodiment of a divider 5600 with a threaded base 5601. The threading may be single or multiple. FIGS. 57A-57B show a threaded aperture 5700 of a divider plate that fit complementarily to the divider 5600. FIGS. 58A-58C show the divider 5600 inserted into the aperture 5700.

Figure 59:
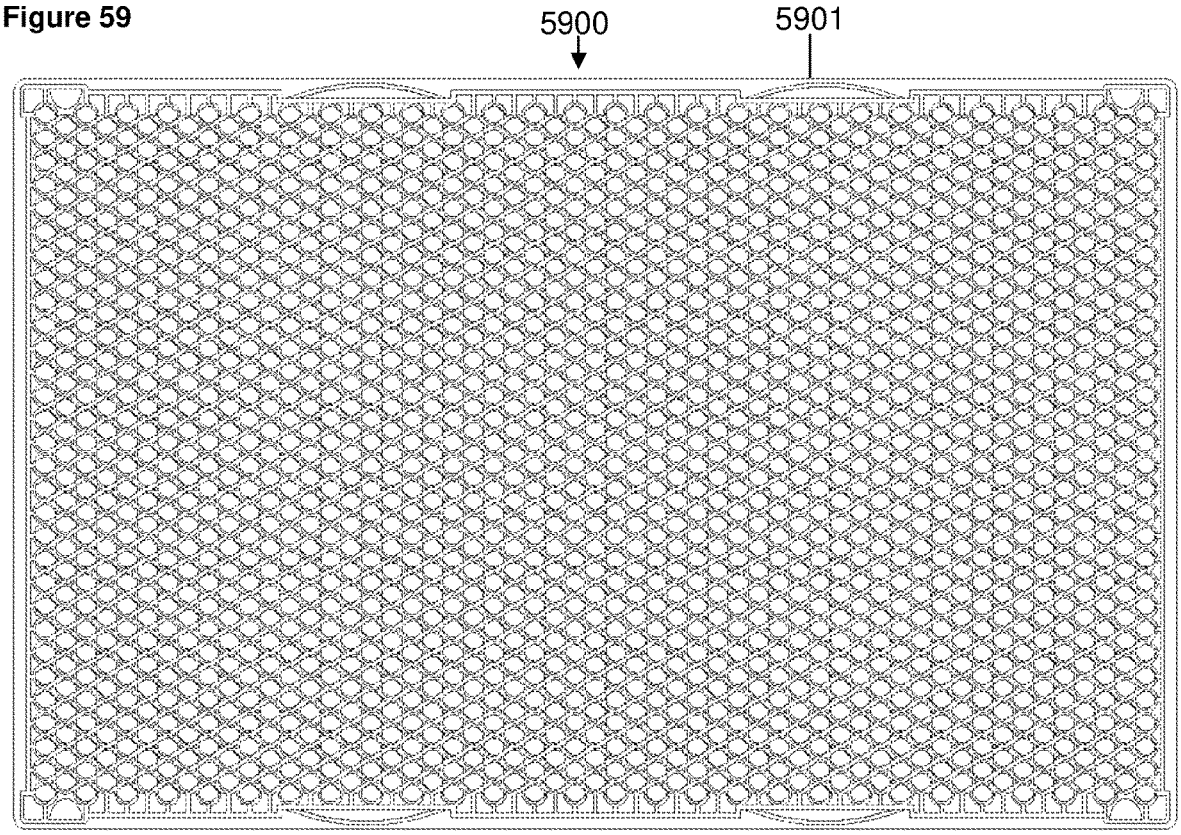
FIG. 59 is a bottom view of a divider plate.
Figure 60A:
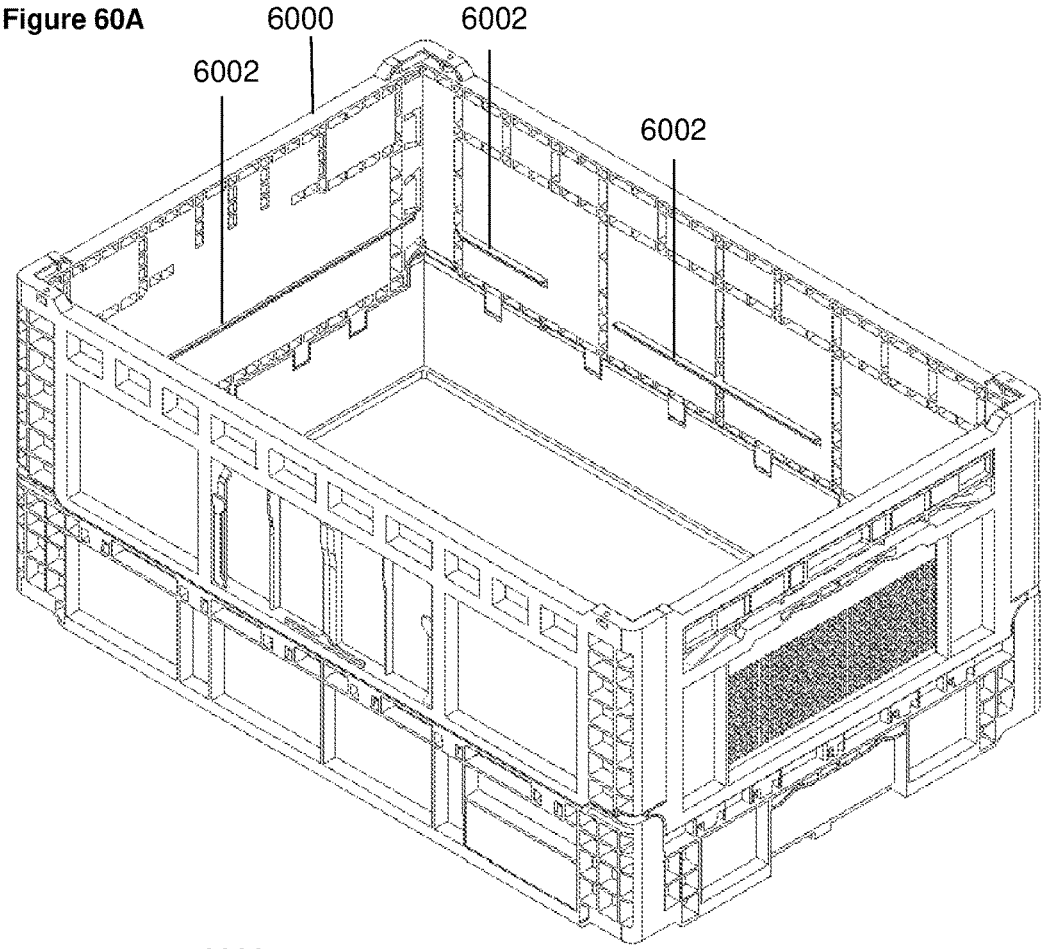
FIG. 60A is a perspective view of a container.
Figure 60B:
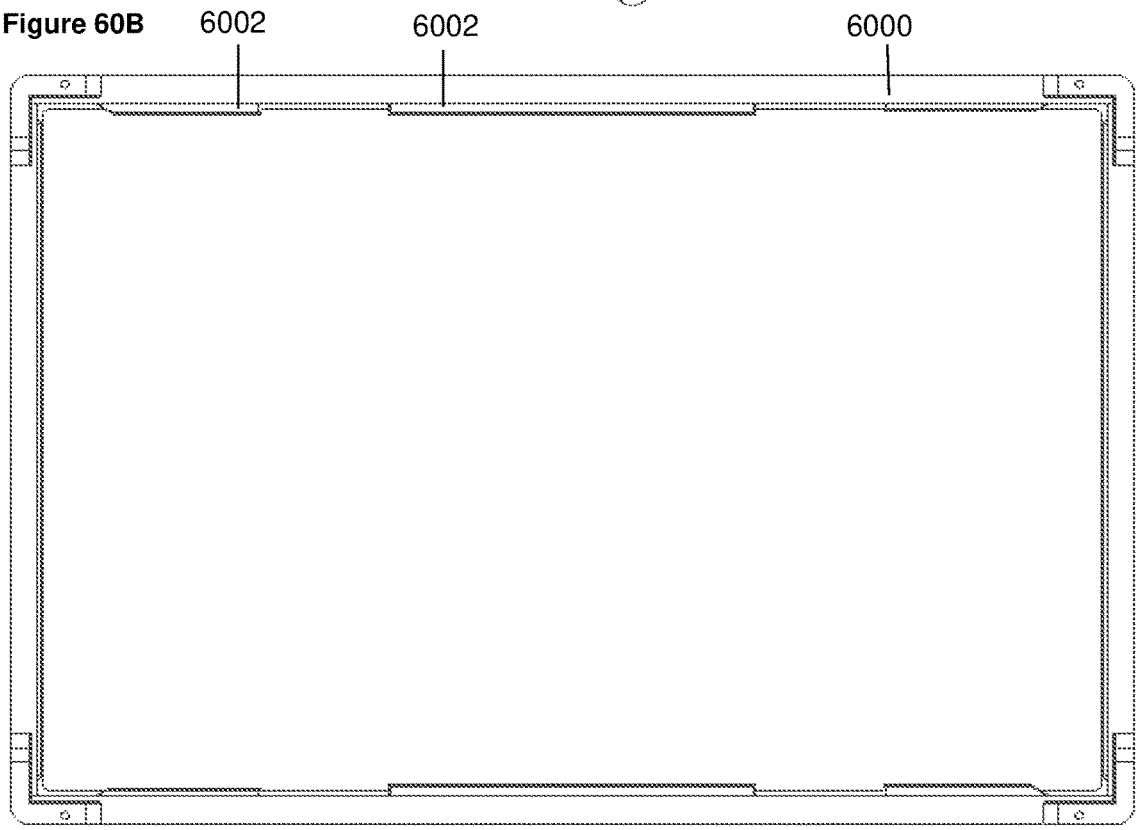
FIG. 60B is a top view of a container.

FIG. 59 shows the bottom view of a divider plate 5900. The divider plate 5900 has resilient members 5901 which push against the walls of the container to secure the plate in place during transportation. The edge of the divider plate 5900 may rest on a ledge 6002 in the container wall 6000 (FIGS. 60A-60B). This feature may be used for holding multiple divider plates in a container.

Figure 61:
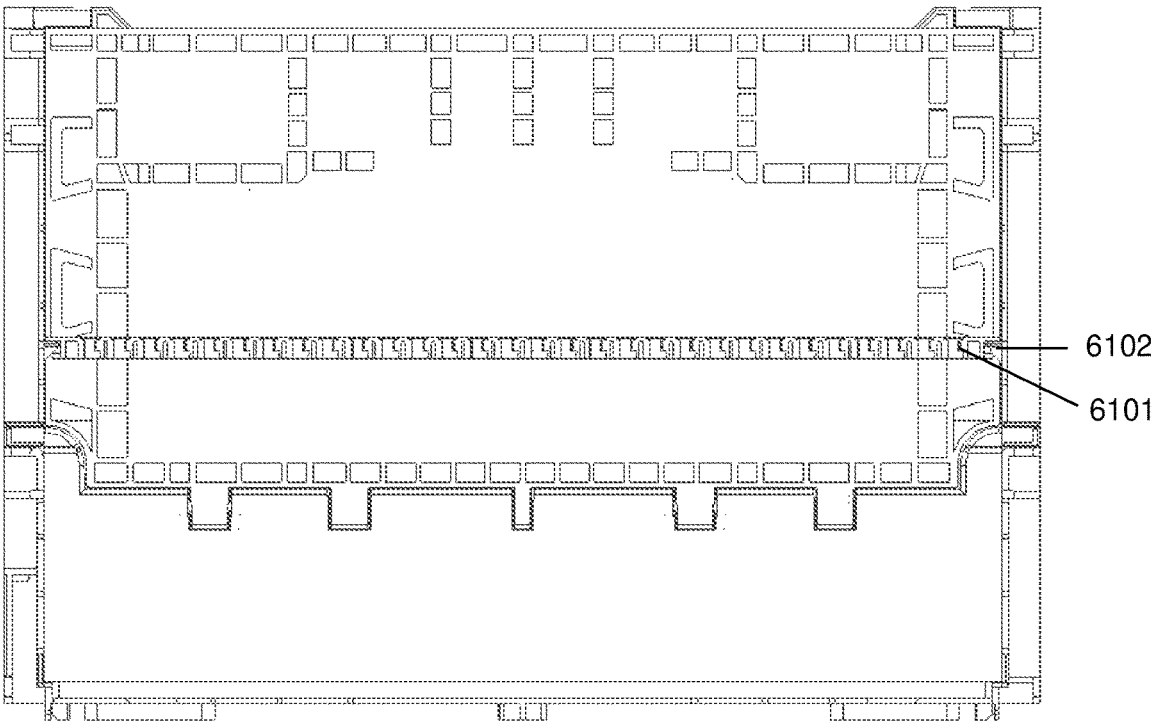
FIG. 61 is a side view of a container with a divider plate.
Figure 62:
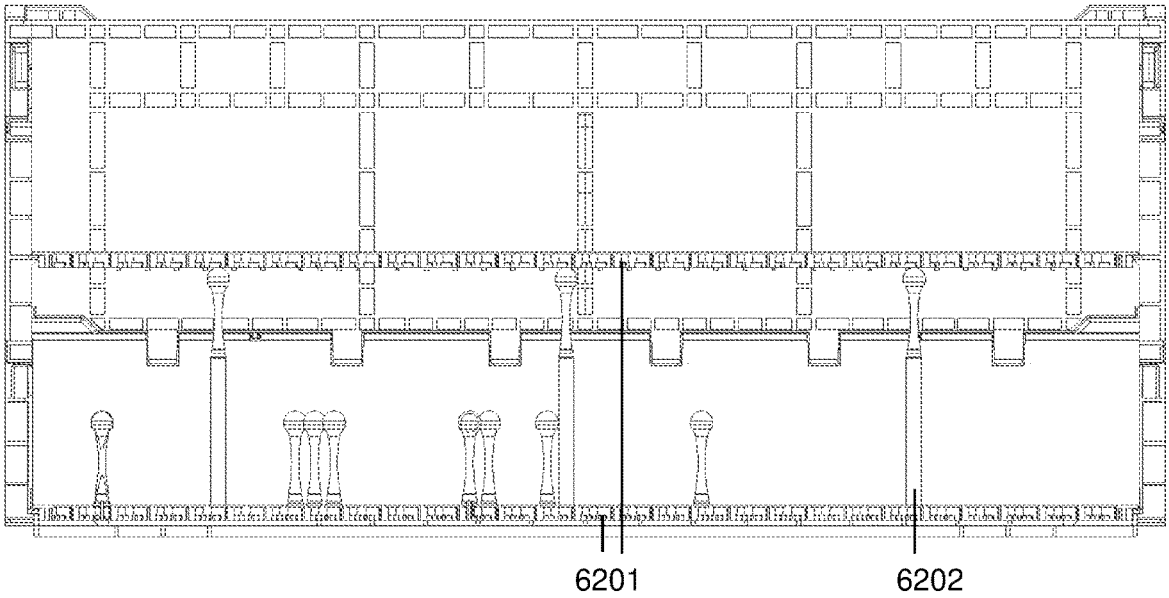
FIG. 62 is a side view of a container with dividers, column supports and 2 divider plates.

A container may contain multiple divider plates to maximise the packing space. FIG. 61 shows a side view of a container with a divider plate 6101 engaged with a ledge 6102. When multiple divider plates 6201 are used, a column support 6202 may be used to prevent the upper divider plate from collapsing (FIG. 62). The column support 6202 may also serve as a divider.

Figure 63A:
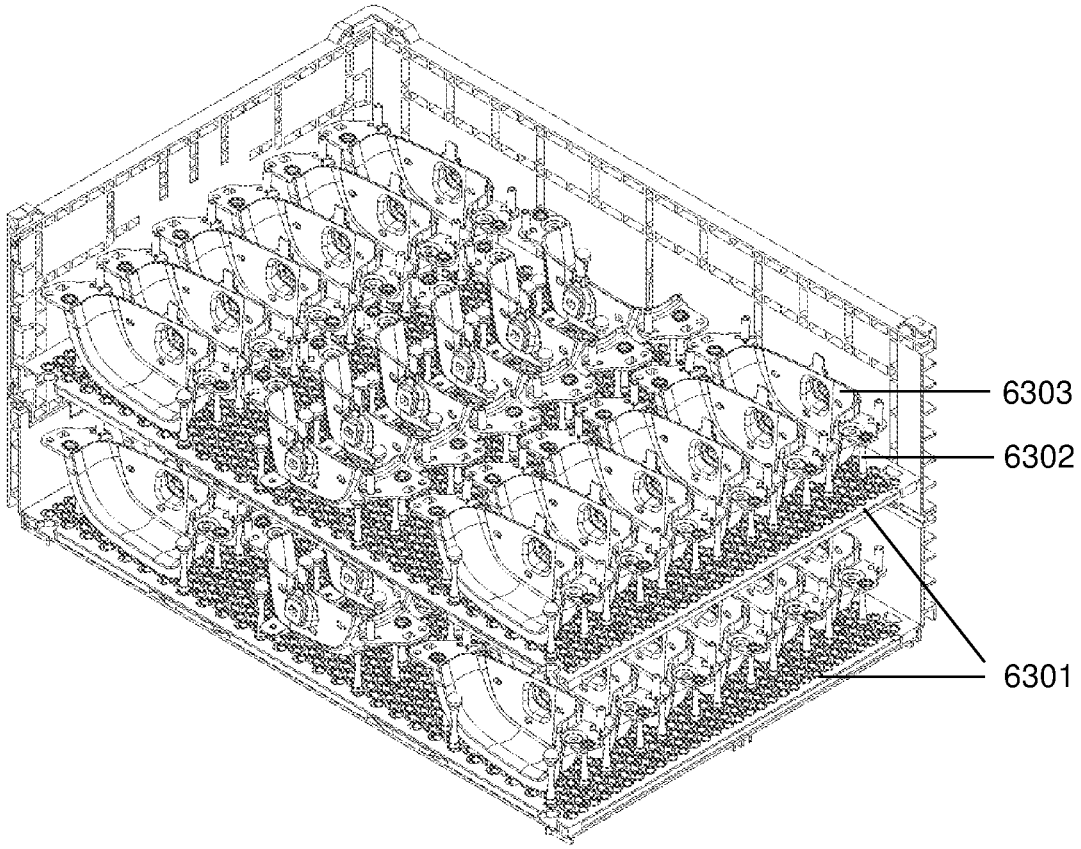
FIGS. 63A, 64A and 65A are perspective views of objects and dividers arranged on divider plates in a container.
Figure 63B:
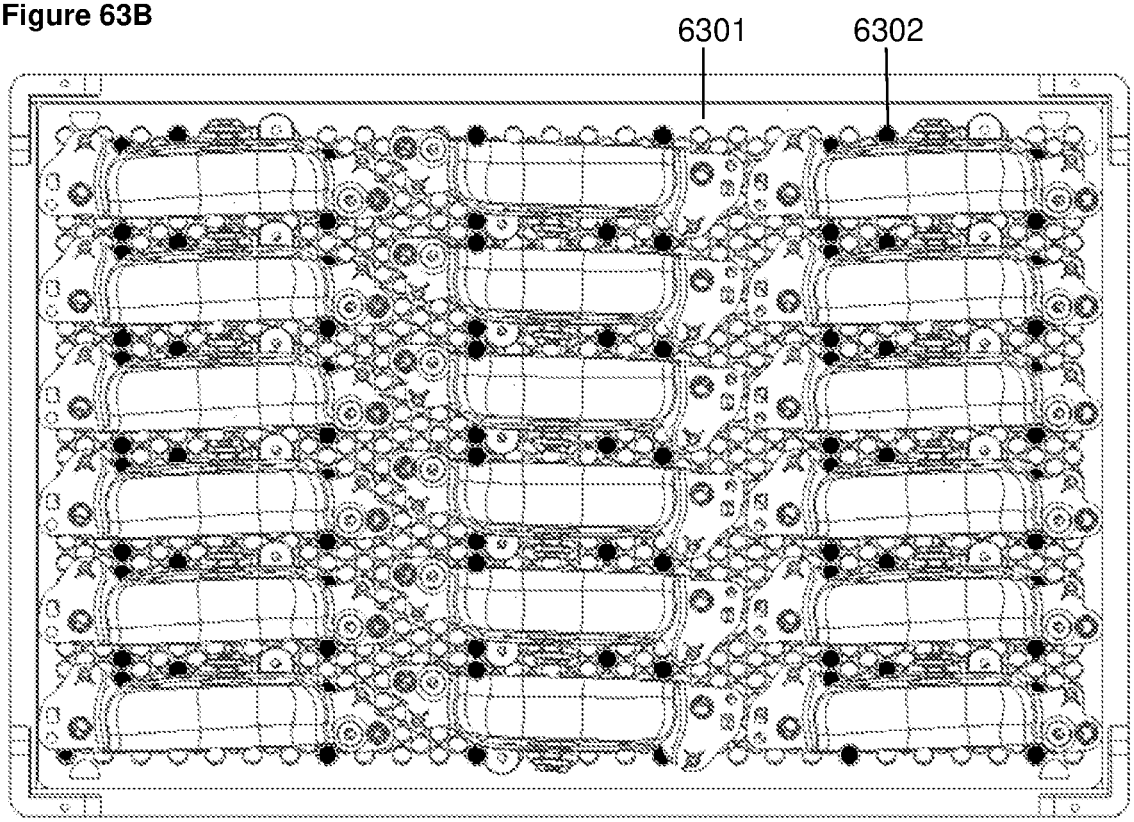
FIGS. 63B, 64B and 65B are top views of objects and dividers arranged on divider plates in a container.
Figure 64A:
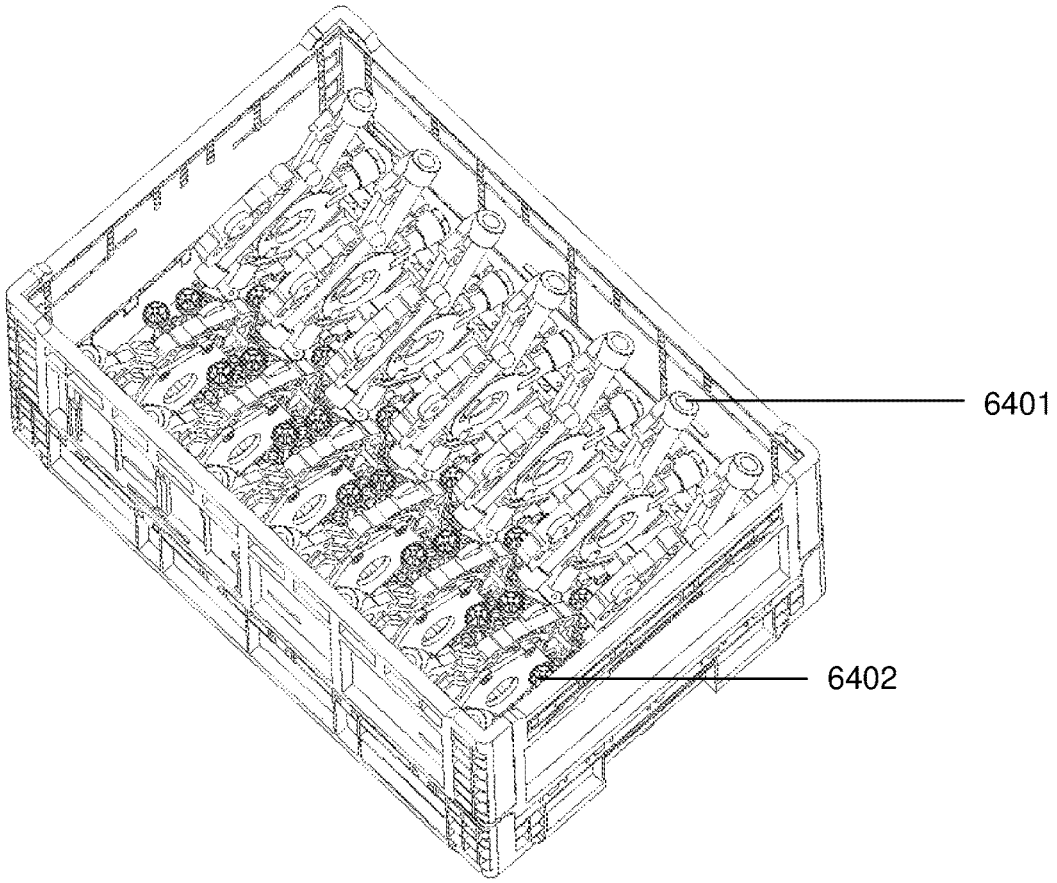
Figure 64B:
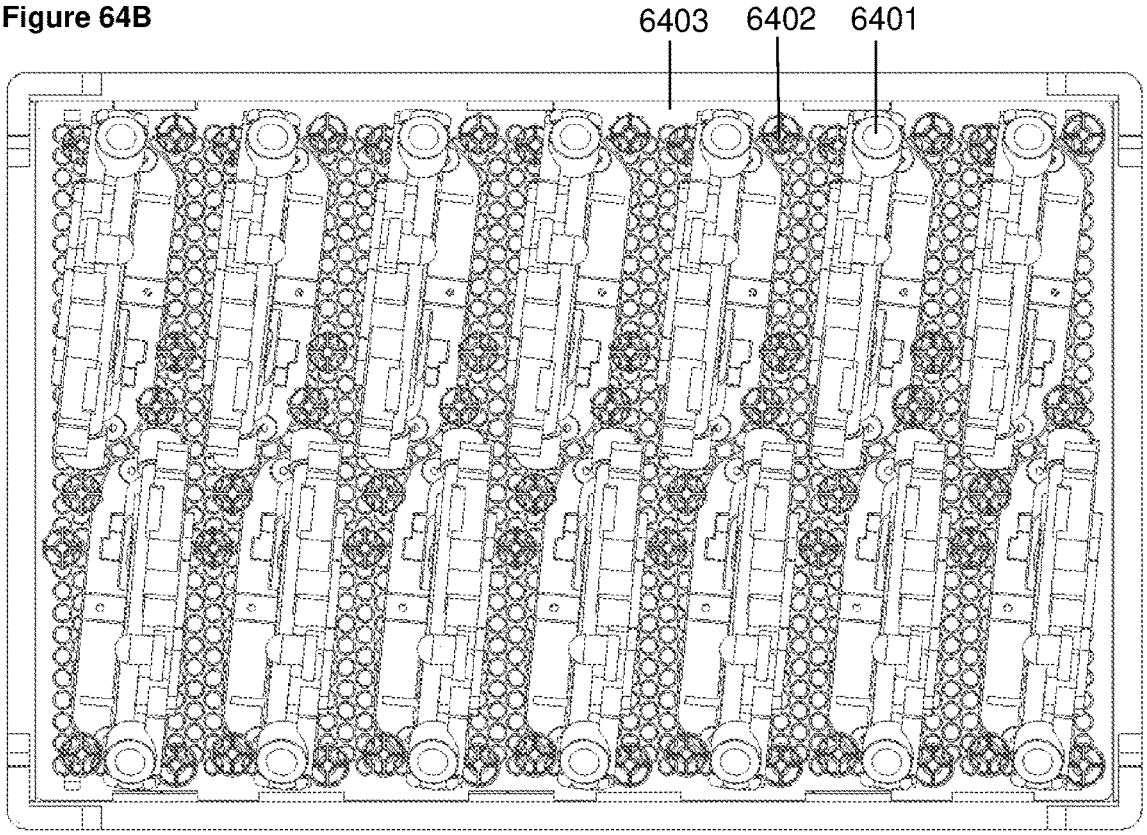
Figure 65A:
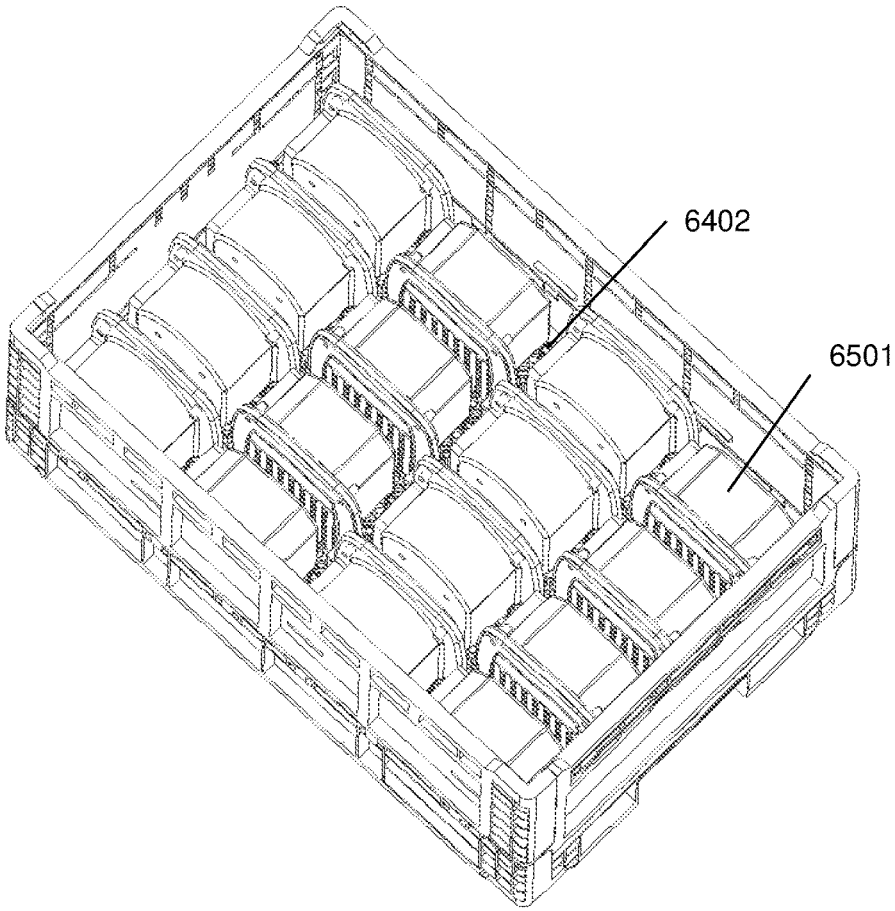
Figure 65B:
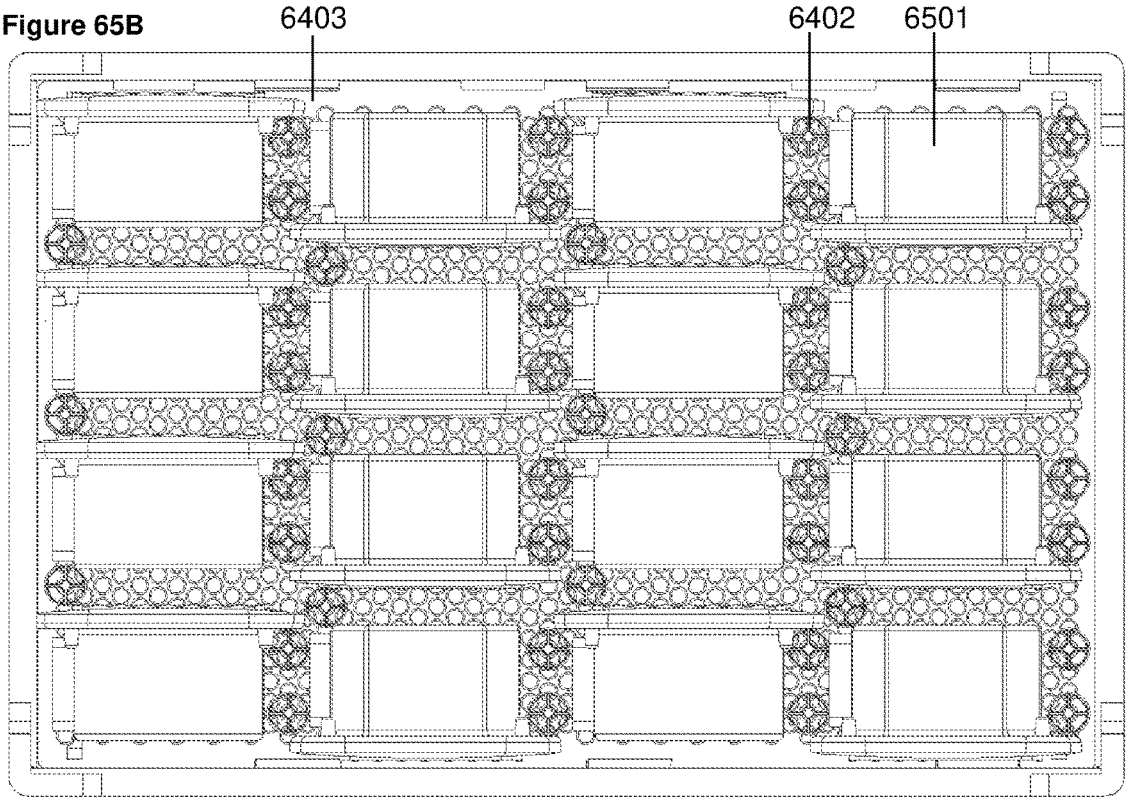

FIGS. 63A-63B show a packing arrangement of objects 6303 and dividers 6302 on 2 divider plates 6301 in a container. In FIG. 63B, the dividers 6302 are shown as black dots to distinguish from the apertures of the divider plate 6301.

Figure 66A:
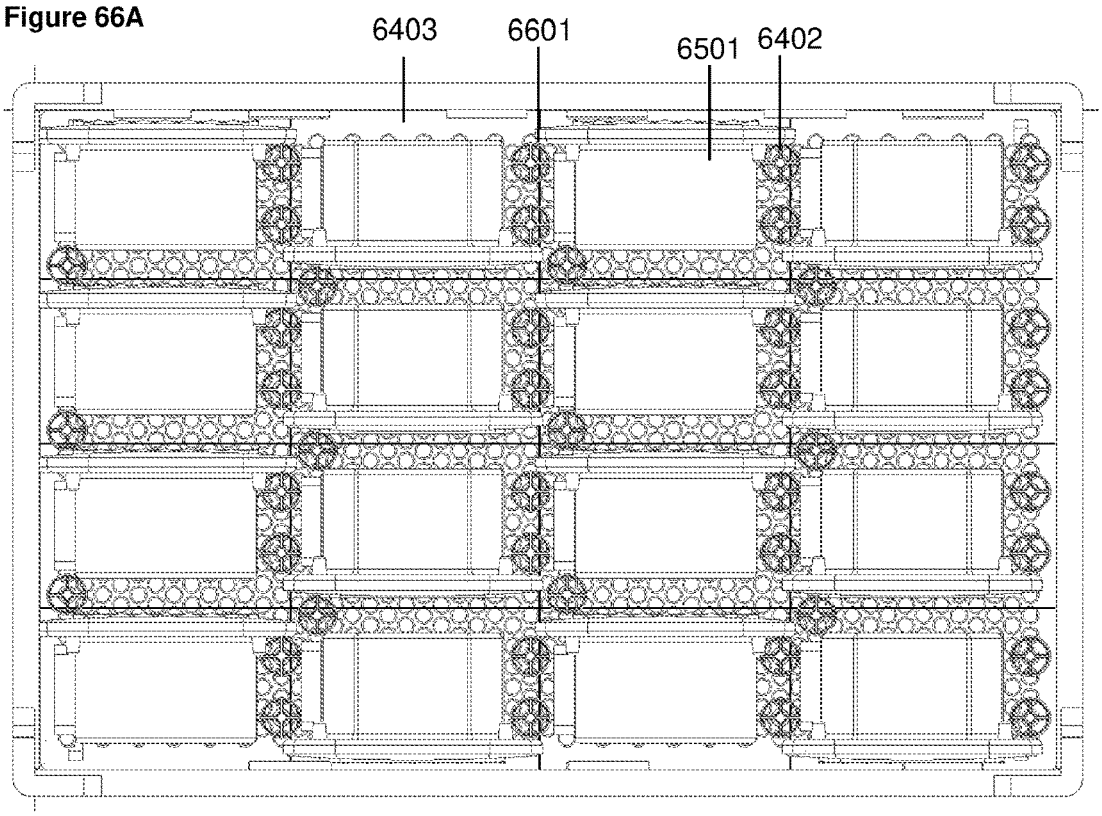
FIG. 66A is a top view of the divider plate of FIG. 65B divided into modular sub-divider plates.
Figure 66B:
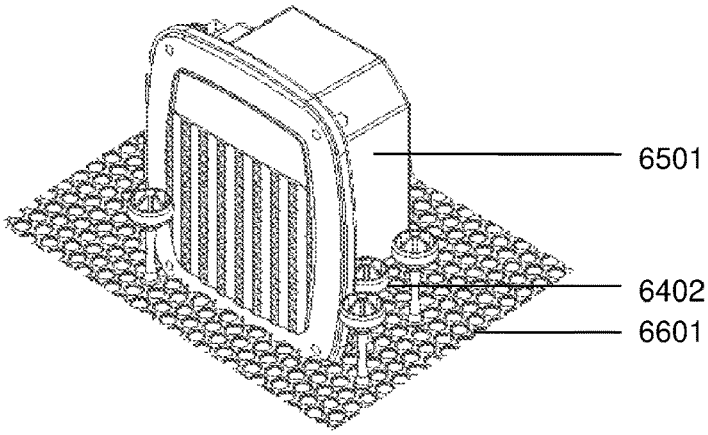
FIG. 66B is a perspective view of a sub-divider plate.
Figure 66C:
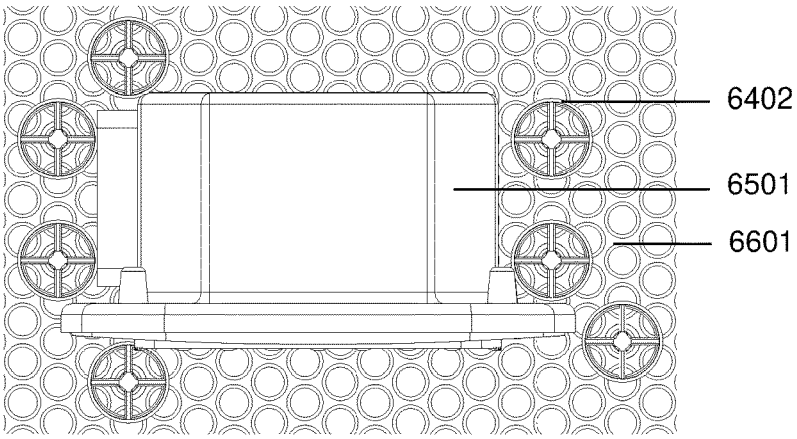

FIGS. 64A-64B and 65A-65B show alternative packing arrangements for objects 6401 and 6501 with dividers 6402 on a divider plate 6403. The divider plates may be constructed from modular sub-divider plates. For example, the divider plate 6403 of FIG. 65B may be divided into 16 sub-divider plates 6601 (FIGS. 66B and 66C) in the lines shown in FIG. 66A. Each sub-divider plate 6601 can be assembled with dividers 6402, and then assembled in a container. The objects 6501 can be added at any stage.

It is appreciated that the various embodiments relating to the head, throat and base are interchangeable to form different dividers, whilst still falling within the scope of the invention. Various embodiments relating to the apertures and divider plates are interchangeable to form different divider plates.

The invention claimed is:

1. An object transport system comprising:

a plate having an array of apertures;

a plurality of dividers, each of the plurality of dividers comprising a head, a base, and a flexible elongate throat connecting the head to the base;

wherein the base is arranged to be inserted into one of the apertures and the flexible elongate throat is arranged to deflect when a force, from an object, is exerted on the flexible elongate throat;

wherein the flexible elongate throat has a tapered portion intermediate the head and the base, a taper extending along a length of the tapered portion, the divider being arranged to bend about the tapered portion.

2. The system according to claim 1, wherein the base and aperture are cooperatively shaped for insertion using any one of: snap fit, bayonet fit, or screw fit.

3. The system according to claim 1, wherein the base includes two tabs, each moveable between an extended position and a squeezed position.

4. The system according to claim 1, wherein the head comprises a first material surrounded by a second material, wherein the second material is softer than the first material.

5. The system according to claim 1, wherein the base is symmetrical.

6. The system according to claim 1, wherein the head has a circular plan section.

7. The system according to claim 1, wherein the plurality of dividers are positioned relative to the object in layers to provide additional stiffness and so arranged to distribute the force from the object.

8. The system according to claim 1, wherein the head has rounded top and bottom portions.

9. The system according to claim 1, wherein the plurality of dividers are positionable within the array of apertures to selectively define an enclosure for the object.

10. The system according to claim 1, wherein each of the plurality of dividers comprises a first ridge positioned circumferentially about the base.

11. The system according to claim 10, wherein each aperture comprises a recess and a second ridge for receiving and engaging the first ridge of the divider upon insertion.

12. The system according to claim 1, further comprising a column support having an elongate base.

13. The system according to claim 1, further comprising a divider removal device arranged to retract a depressible tab of a divider of the plurality of dividers in a squeezed position.

14. A method of manipulating a divider within an aperture of a plate, the divider including a head, a base, and a flexible elongate throat connecting the head to the base, the throat having a tapered portion intermediate the head and the base, the base having two tabs, a taper extending along a length of the tapered portion, the divider being arranged to bend about the tapered portion, the method comprising the steps of:

inserting the base into a neck of the aperture, the neck depressing the tabs from an extended position to a squeezed position; and further inserting the base such that the base enters a void, the tabs resiliently moving to the extended position within the void, and consequently locking the divider into the aperture.

15. The method according to claim 14, further including the steps of:

inserting a divider removal device into the void;

responsive to the inserting, retracting the tabs to the squeezed position; and withdrawing the divider.

16. An object transport system comprising:

a plate having an array of apertures; and a plurality of dividers, each of the dividers comprising a flexible elongate throat connecting a head to a base, wherein the base is arranged to be inserted into one of the apertures and the flexible elongate throat is arranged to deflect when a force, from an object, is exerted on the flexible elongate throat; and wherein the flexible elongate throat has a tapered portion intermediate the head and the base, a taper extending along a length of the tapered portion, the divider being arranged to bend about the tapered portion, wherein:

spacing of the apertures and heads are arranged such that, wherein a plurality of dividers are placed adjacent to each other in adjacent apertures, the heads come into contact with each other; and the head of the divider is arranged to come into contact with a head of an adjacent divider to transfer a force, when the flexible elongate throat of the divider is deflected.

17. The system according to claim 16, wherein the head comprises a first material surrounded by a second material, wherein the second material is softer than the first material.

18. The system according to claim 16, wherein the plurality of dividers are positioned relative to the object in layers to provide additional stiffness and so arranged to distribute the force from the object.

19. The system according to claim 16, wherein the plurality of dividers are positionable within the apertures to selectively define an enclosure for the object.

* * * * *